US011202509B2

(12) United States Patent
Yajima et al.

(10) Patent No.: US 11,202,509 B2
(45) Date of Patent: Dec. 21, 2021

(54) CHAIR

(71) Applicants: KOKUYO CO., LTD., Osaka (JP); TAKANO CO., LTD., Nagano (JP)

(72) Inventors: Toshiki Yajima, Osaka (JP); Takao Sugano, Osaka (JP); Tomoaki Ichikawa, Kamiina-gun (JP); Kenta Shiozawa, Kamiina-gun (JP); Kensuke Nakamura, Kamiina-gun (JP)

(73) Assignees: KOKUYO CO., LTD., Osaka (JP); TAKANO CO., LTD., Nagano (JP)

( * ) Notice: Subject to any disclaimer, the term of this patent is extended or adjusted under 35 U.S.C. 154(b) by 29 days.

(21) Appl. No.: 16/614,962

(22) PCT Filed: Jun. 20, 2017

(86) PCT No.: PCT/JP2017/022758
§ 371 (c)(1),
(2) Date: Nov. 19, 2019

(87) PCT Pub. No.: WO2018/235173
PCT Pub. Date: Dec. 27, 2018

(65) Prior Publication Data

US 2020/0196764 A1 Jun. 25, 2020

(51) Int. Cl.
*A47C 7/14* (2006.01)
*A47C 7/62* (2006.01)

(52) U.S. Cl.
CPC . *A47C 7/14* (2013.01); *A47C 7/62* (2013.01)

(58) Field of Classification Search
CPC ..... A47C 1/031; A47C 1/032; A47C 7/14; A47C 7/62
See application file for complete search history.

(56) References Cited

U.S. PATENT DOCUMENTS 4,598,892 A * 7/1986 Franckowiak ..... A47C 3/24 248/188.7
4,828,212 A * 5/1989 Dicks ..... A47C 3/24 248/406.2

(Continued)

FOREIGN PATENT DOCUMENTS

EP 0901763 A2 3/1999
GB 2340746 A 3/2000

(Continued)

OTHER PUBLICATIONS

International Search Report dated Sep. 26, 2017, issued in counterpart International Application No. PCT/JP2017/022758, with English Translation. (3 pages).

(Continued)

*Primary Examiner* — Philip F Gabler
(74) *Attorney, Agent, or Firm* — Westerman, Hattori, Daniels & Adrian, LLP

(57) ABSTRACT

[Problem] Provided is a chair capable of changing an operation of a movable part between allowed and suppressed states, without causing an up-down movement of a seat or without requiring a complicated structure relying on a back. [Solution] For that purpose, a weight-receiving part 50, the height position of which changes due to a person sitting on a seat surface, is provided on a seat 5, the change of the height position is mechanically transmitted to a control mechanism 8X configured to control an operation of a front-rear swing part 3 being the movable part, and the control mechanism 8X changes an operation of the front-rear swing part-3 being the movable part between allowed and suppressed states.

18 Claims, 50 Drawing Sheets

(56) References Cited

U.S. PATENT DOCUMENTS

| | | | | |
|---|---|---|---|---|
| 5,197,781 | A * | 3/1993 | Tada | A47C 1/032 297/323 |
| 5,327,591 | A * | 7/1994 | Fireman | A47C 17/161 5/38 |
| 9,700,138 | B2 * | 7/2017 | Rechtien | A47C 1/03255 |
| 2015/0265052 | A1 | 9/2015 | Gehner et al. | |
| 2015/0306978 | A1 | 10/2015 | Watanabe | |

FOREIGN PATENT DOCUMENTS

| | | | |
|---|---|---|---|
| JP | 50-966 | A | 1/1975 |
| JP | 3053144 | U | 10/1998 |
| JP | 2008-149756 | A | 7/2008 |
| JP | 2014-128990 | A | 7/2014 |
| JP | 2015-171433 | A | 10/2015 |

OTHER PUBLICATIONS

Extended (Supplementary) European Search Report dated Sep. 24, 2020, issued in counterpart EP Application No. 17914600.6. (7 pages).

Office Action dated Apr. 9, 2021, issued in counterpart BR Application No. BR112019027427-8, with English Translation. (8 pages).

Office Action dated May 18, 2021, issued in counterpart JP Application No. 2019-524756, with English Translation. (9 pages).

* cited by examiner

[Conceptual diagram of left-right stopper]

[Conceptual diagram of front-rear stopper]

[Conceptual diagram of front-rear stopper when seated person leaves seat]

CHAIR

TECHNICAL FIELD

The present invention relates to a safety device configured to lock a movement of a chair when a seated person leaves a seat. In particular, the present invention relates to a safety device configured to automatically lock a movement of a chair when a seated person leaves a seat and unlock the movement of the chair when the person sits on the seat, without any special operation.

BACKGROUND ART

It is common to introduce a movable part in a chair so that a back and a seat can be used in appropriate positions during use of the chair. Such a movable part may include a return mechanism configured to return, in consideration of the next seating, the seat to a predetermined position when a seated person leaves the seat.

In a reclining chair of Patent Document 1, the reclining chair is configured such that, when a seated person leaves a seat while the reclining chair is reclined, the reclining chair automatically performs a lifting operation to abut against a foremost end of a movable range and stop.

Patent Document 2 discloses a configuration in which: a back and a seat are integrally formed and a part of the back is fixed at a fulcrum; the back and the seat are deformed to twist left and right in front view around the fulcrum by the elasticity thereof in accordance with the movement of a seated person; and when the seated person leaves the seat, the back and the seat return to the original state by the elasticity thereof.

Patent Document 3 discloses a chair in which a lifted state of a back frame is locked when no load applied by seated person is applied to a seat frame, and the lifted state of the back frame is unlocked when a predetermined or more load applied by seated person is applied to the seat frame, and thus, the lifted state of the back frame does not need to be manually unlocked.

CITATION LIST

Patent Literature

Patent Document 1: Japanese Unexamined Patent Application Publication No. S50-000966

Patent Document 2: US Patent Publication No. 2015-0265052

Patent Document 3: Japanese Unexamined Patent Application Publication No. 2015-171433

SUMMARY OF THE INVENTION

Problem to be Solved by the Invention

Incidentally, when it is attempted to move a seat to the front, rear, right, or left, or it is attempted to achieve a movement not known in conventional chairs in which the movement of a back matches the movement of the seat, such a movable part is not locked after a seated person leaves the seat to cause inconvenience occurring when the chair is moved by holding the back of the chair, and instability and anxiety at the time of the next seating.

However, the chairs described in Patent Documents 1 and 2 merely return to the original position when the seated person leaves the seat, and do not actively suppress this movement.

Thus, it is conceivable to configure these movable parts to be mechanically restricted. However, it is troublesome for a seated person to operate an operating part to restrict the movable part every time the seated person leaves the seat, and when the person forgets to restrict the movable part, the same state is reached as if there was no restriction.

The configuration according to Patent Document 3 certainly allows for automatic restriction of the movable part in accordance with a seating state, however, the movable part is unlocked/locked only when a seat frame moves up or down, and thus, there is a problem in which there is a discomfort in an up-down movement of the seat always occurring when a person sits on or leaves the seat, when the up-down movement is more likely to occur, not enough support force is provided, and when enough support force is provided, the up-down movement is less likely to occur.

Alternatively, in the configuration according to Patent Document 3, even if the up-down movement of the seat is utilized, a back frame rotatably coupled to a pedestal is used as a constituent element of a control mechanism configured to control the movement of the seat, and thus, in addition to the problem of requiring a large structure, this configuration is unsuitable for a chair in which the back is not directly attached to the seat, and further, this configuration is unsuitable for a chair in which the back is attached to a seat requiring a swinging operation to the front, rear, right, or left not found in conventional seats.

The present invention focuses on such problems and an object thereof is to realize a chair capable of changing an operation of the movable part between allowed and suppressed states, without causing an up-down movement of the seat or without requiring a complicated structure relying on the back.

Means for Solving the Problem

The present invention adopts the following means to achieve such object.

That is, in a chair according to the present invention, a weight-receiving part, the height position of which changes due to a person sitting on a seat surface, is provided on a seat, the change of the height position is mechanically transmitted to a control mechanism configured to control an operation of a movable part, and the control mechanism changes an operation of the movable part between allowed and suppressed states.

With such a configuration, a seating state is detected based on the change of the height position of the weight-receiving part, and the control mechanism controls the operation of the movable part through the mechanical transmission. Thus, when suppression of an operation of the movable part such as rearward tilting of the back, swinging of the seat, rotation of the seat, or rolling of a caster is desired before sitting, the suppression can be achieved by the chair without performing a separate operation. Further, since the height change of the weight-receiving part provided in the seat rather than the height change of the seat itself is utilized, no movement of the seat itself is necessary for allowing and suppressing the operation of the movable part, and thus, ease of use without discomfort is achieved and the control mechanism can be configured independently of the support force of the seat.

An example of a specific structure not requiring manual operation includes a configuration in which the control mechanism changes the allowed/suppressed states of the operation of the movable part when an engagement state between an engaged part provided in one of the movable part and a support part configured to operatively support the movable part and an engaging part provided in the other of the movable part and the support part changes due to a load applied by seated person, and when the load applied by seated person is removed, the control mechanism returns the changed operation state to an original state by an elastic member.

To reliably prevent a failure and achieve a sense of security when a person sits on the seat, it is desirable that the engaging part- and the engaged part are disengaged due to the load applied by seated person, and when the load applied by seated person is removed, the engaging part and the engaged part are engaged by an elastic force so that the operation of the movable part reaches the suppressed state.

To reliably suppress the operation of the movable part, it is desirable that the chair is configured such that the engaged part is a recess, and when the load applied by seated person is received in a state where the engaging part is fitted in the recess, the fitting state is released.

To provide suppression at the nearest engagement position when the seated person leaves the seat, it is desirable that any one of the recess and the engaging part is provided at a plurality of locations along an operation direction of the movable part.

When the operation direction of the movable part includes a plurality of directions including one direction and another direction crossing the one direction in plan view, it is desirable that the allowed/suppressed states of the operation in at least one of the directions are changed to allow for selection of a direction in which the seat should be stopped or a direction in which the seat should be moved in accordance with a preference of the seated person and the seating state.

If the seat is a movable part, a timing for controlling the seat can be easily taken.

In a chair in which the seat tilts at least back and forth, when the load applied by seated person is removed in a state where the seat tilts forward, the seat tilts rearward, it is desirable that the engaging part is configured to engage with the engaged part in the middle thereof.

To suppress the movement of the seat in consideration of the weight balance of the seated person to the front, rear, right, or left, it is desirable that the seat is attached to a one-direction operating part-operable in one of a front-rear direction and a right-left direction, the one-direction operating part is operatively supported by an other-direction operating part operable in the other of the front-rear direction and the right-left direction, the other-direction operating part is operatively supported by a seat support part, and the control mechanism is configured between the one-direction operating part and the other-direction operating part and/or between the other-direction operating part and the seat support part.

To ensure smooth movement of the movable part when the seated person leaves the seat and reliable suppression afterwards, it is desirable that the control mechanism includes: an engaging part; and a groove-shaped recess being an engaged part provided on a sliding surface relatively operating at a position facing the engaging part, and the engaging part is configured to be elastically biased toward the sliding surface and to fit in the groove-shaped recess at a predetermined position.

In order to make a movement of the seat not allowed in the halfway seating state, it is desirable that when reception of the load applied by seated person in a center of the seat is detected, the engaging part of the control mechanism is disengaged from the groove-shaped recess.

To facilitate assembly, it is desirable that the chair includes: an elastic member configured to bias the engaging part in a direction where the engaging part protrudes toward the sliding surface; and a conversion mechanism configured to convert an operation of the weight-receiving part due to a person sitting on the seat, into an operation in a direction where the engaging part is separated from the sliding surface, and the conversion mechanism, the elastic member, and the engaging part are integrally incorporated in a casing to form with unitized.

To allow for manual switching a movement of the movable part-between allowed and suppressed states with the addition of a simple configuration, it is desirable that the engaging part incorporated in the casing is configured to operate in the direction where the engaging part is separated from the sliding surface, also by an operation of an operating part.

To additionally provide a stopper mechanism configured to change, via an operation of an operating member, the operation of the movable part between the allowed and suppressed states, it is desirable that the stopper mechanism also includes: an elastic member configured to bias the engaging part in a direction where the engaging part protrudes toward the sliding surface; and a conversion mechanism configured to convert the operation of the operating member into an operation in a direction where the engaging part is separated from the sliding surface, and the conversion mechanism and the engaging part are integrally incorporated in the casing to form with unitized.

In a case where the chair includes a stopper mechanism configured to change, via an operation of an operating member, the operation of the movable part between the allowed and suppressed states, and the stopper mechanism also changes the allowed/suppressed states of the operation of the movable part when an engagement state between a recess being an engaged part and an engaging part changes, it is desirable that the recess of the control mechanism and the recess of the stopper mechanism are set at different positions in a front-rear direction in order to appropriately set the respective suppression positions.

To achieve a configuration to change allowed/suppressed states of an operation of the movable part without relying on a back, the chair is configured such that the height position of a seat changes due to a person sitting on a seat surface, and the change of the height position of the seat is mechanically transmitted to a control mechanism configured to control an operation of a movable part and that the control mechanism changes the operation of the movable part between allowed and suppressed states. Accordingly, the control mechanism is configured to change the allowed/suppressed states of the operation of the movable part when an engagement state between an engaged part-provided in one of the movable part and a support part configured to operatively support the movable part and an engaging part provided in the other of the movable part and the support part changes due to a load applied by seated person, and when the load applied by seated person is removed, the control mechanism is configured to return the changed operation state to an original state by an elastic member. In the configuration, it is effective that a link connected rotatably and with changeable inter-shafts distance via rotating shafts respectively provided in the support part and the movable part; an elastic body configured to act constantly in a direction where the inter-shafts distance decreases; an engagement recess provided on one of the support part and the movable part; and an engaging part provided on the other of the support part and the movable part, are provided, and the inter-shafts distance decreases by the elastic body and the engagement recess and the engaging part engage so that a relative operation between the support part and the movable part is suppressed, and the inter-shafts distance increases and the engagement recess and the engaging part are disengaged when a weight is applied to the movable part due to a person sitting on the seat, so that a swinging operation between the support part and the movable part is allowed.

In another aspect to achieve a configuration to change allowed/suppressed states of an operation of the movable part without relying on a back, the chair is configured such that the height position of a seat changes due to a person sitting on a seat surface, and the change of the height position of the seat is mechanically transmitted to a control mechanism configured to control an operation of a movable part and that the control mechanism changes the operation of the movable part between allowed and suppressed states. Accordingly, the control mechanism is configured to change the allowed/suppressed states of the operation of the movable part when an engagement state between an engaged part provided in one of the movable part and a support part configured to operatively support the movable part and an engaging part provided in the other of the movable part and the support part changes due to a load applied by seated person, and when the load applied by seated person is removed, the control mechanism is configured to return the changed operation state to an original state by an elastic member. In the configuration, the movable part is operable in a front-rear direction and includes, at a front thereof, a shaft extended to a left-right direction, a rear of the movable part is movable upward and downward due to the load applied by seated person, the chair further includes other parts not operating in the front-rear direction, an engaged part that opens either upward or downward is provided in one of the movable part and the other parts, an engaging part engageable with the engaged part is provided in the other of the movable part and the other part, an elastic force is exerted in a direction where the engaged part and the engaging part constantly engage, when the seated person leaves the seat, the engaged part and the engaging part engage so that the seat does not operate in the front-rear direction, and when the person sits on the seat, the engaged part and the engaging part are disengaged so that the seat is operable.

To operate the back in combination with the movement of the seat, it is desirable that a back frame is attached to the seat.

The present invention is particularly useful when applied to a chair configured to be freely movable by a caster.

An example of another preferred aspect of the movable part includes an aspect in which the movable part is a wheel configured to make a chair main body movable.

Effect of the Invention

According to the present invention, there is provided a new chair capable of changing an operation of the movable part between allowed and suppressed states, without causing an up-down movement of a seat or without requiring a complicated structure relying on a back.

MODE FOR CARRYING OUT THE INVENTION

Figure 1:
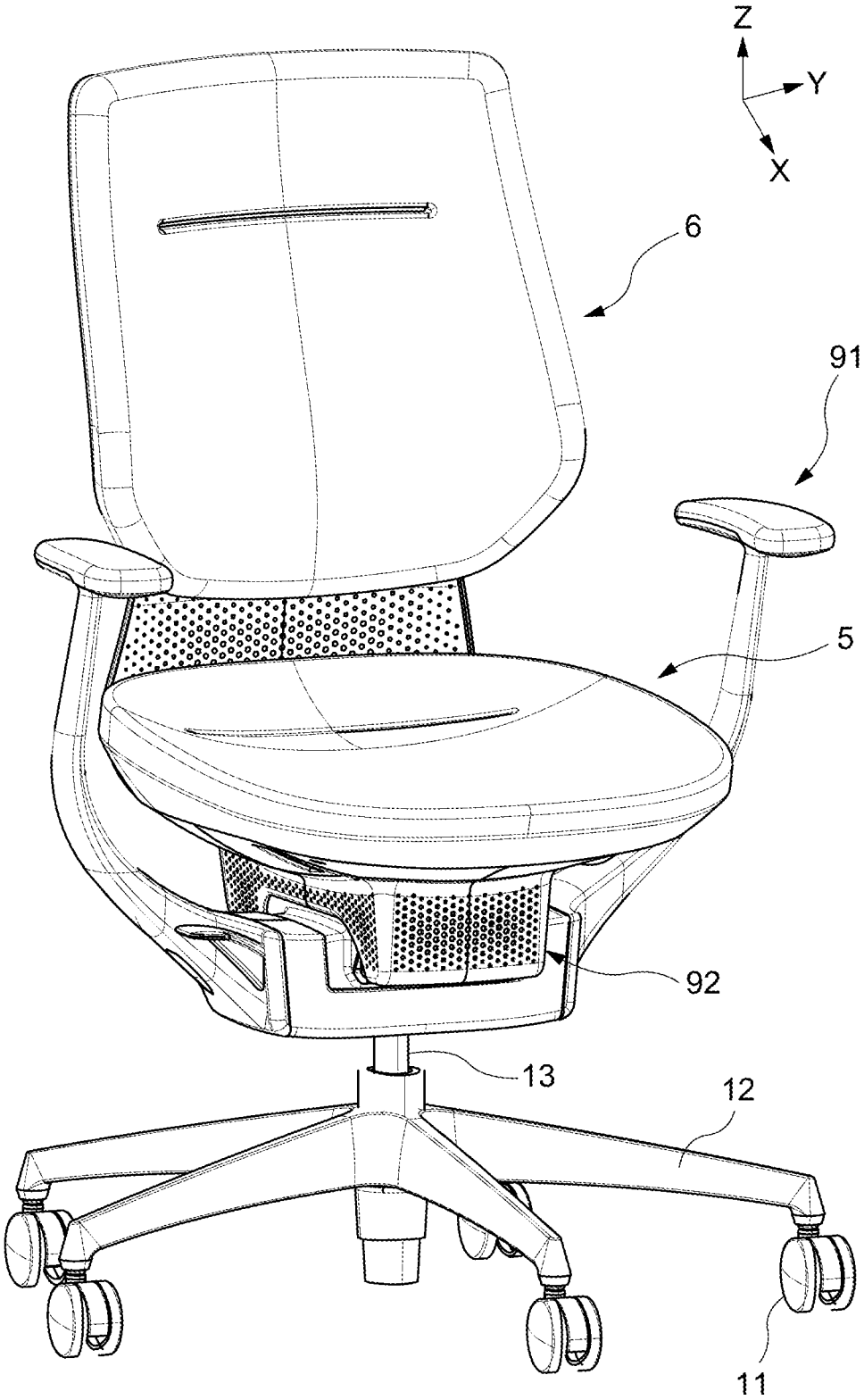
FIG. 1 is a perspective view, as viewed obliquely from the front, of a chair according to an embodiment of the present invention.

An embodiment of the present invention will be described below with reference to the drawings.

As illustrated in FIGS. 1 to 5, this chair is an office chair configured by erecting a leg supporting post 13 incorporating a lifting/lowering mechanism therein, in a central part of a leg vane 12 supported by a caster 11, and attaching a support base part 2 rotatably at an upper end side of the leg supporting post 13. In the support base part 2, a seat 5 being a movable part is supported via a front-rear swing part 3 as a one-direction operating part (movable part) operable any one of a front-rear direction (X-direction in the drawings) and a left-right direction (Y-direction in the drawings) being two directions crossing each other, and a left-right swing part 4 being an other-direction operating part (support part) operable in the other of the front-rear direction and the left-right direction and the seat 5 can swing in the front-rear direction and the left-right direction with respect to the support base part 2. Specifically, the front-rear swing part 3 is provided between the seat 5 and the support base part 2 configured to support the seat 5, and the left-right swing part 4 is provided between the front-rear swing part 3 and the support base part 2. Behind the seat 5, a back 6 is arranged.

The support base part 2 functions as a structured body for receiving the load applied by seated person, and in the support base part 2, a left-right pair of arm attachment parts 23 is integrally formed with the support base part 2 via a bearing base part 22 on both left and right sides of a support base main body 21 including a through hole 21*a* along an up-down direction into which an upper end of the leg supporting post 13 is inserted. A shaft swing damper 21*b* is attached to the hole 21*a* opening on the surface of the support base main body 21 in the front-rear direction and upper ends of left-right swing links L1, L2 are attached to holes 22*a* opening, on the front and rear surfaces of the bearing base part 22, via swing support shafts S1, S2.

Figure 4:
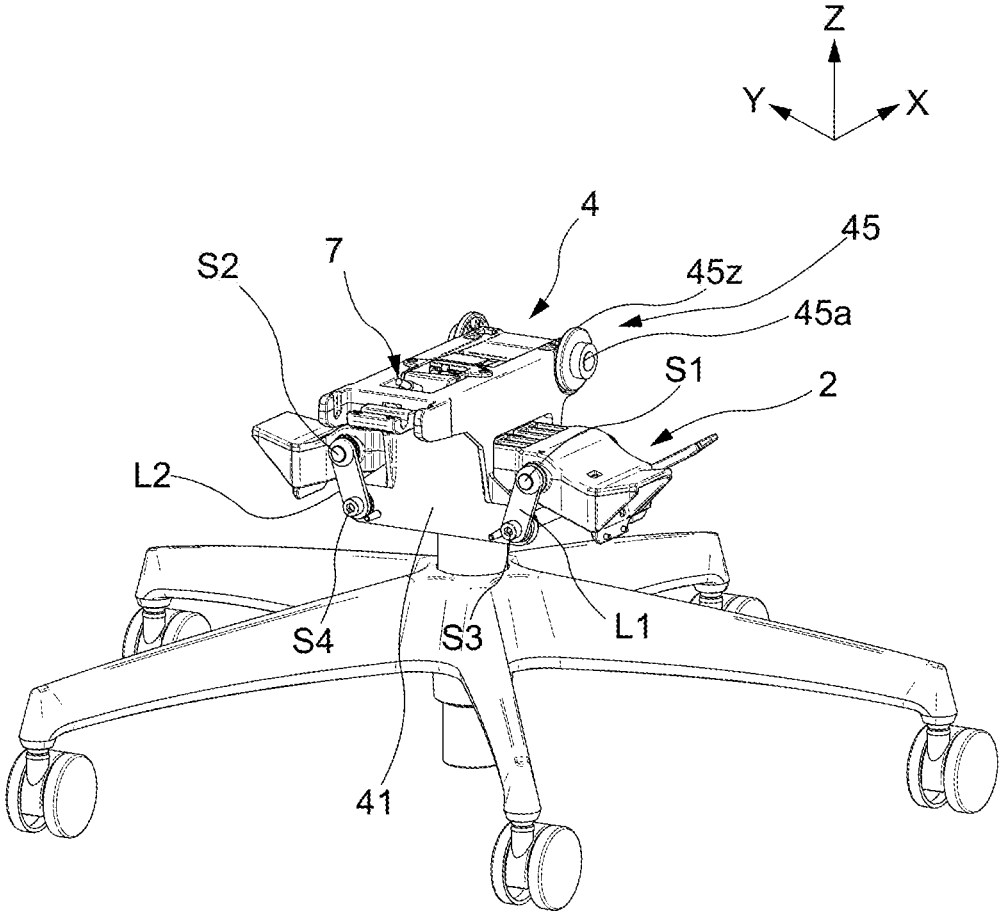
FIG. 4 is a perspective view illustrating a state where a left-right swing part is incorporated in a support base part of the chair.
Figure 5:
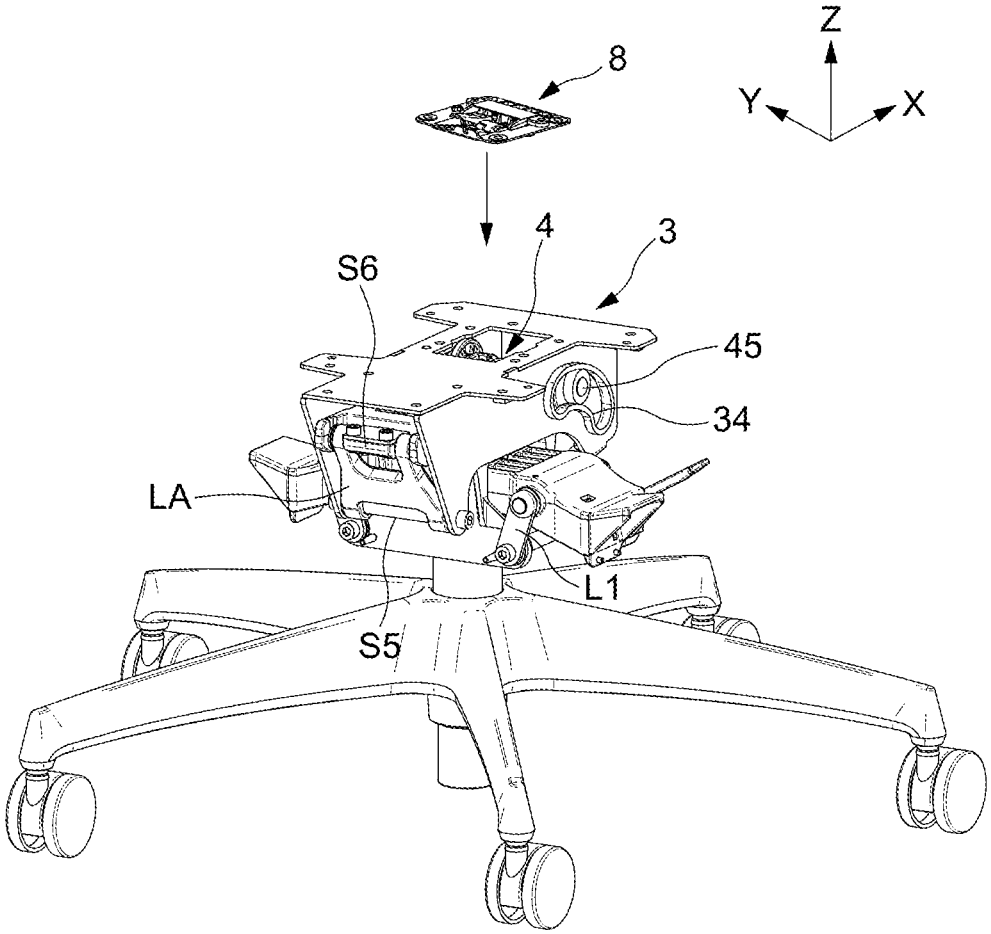
FIG. 5 is a perspective view illustrating a state where a front-rear swing part is incorporated in the left-right swing part.
Figure 6:
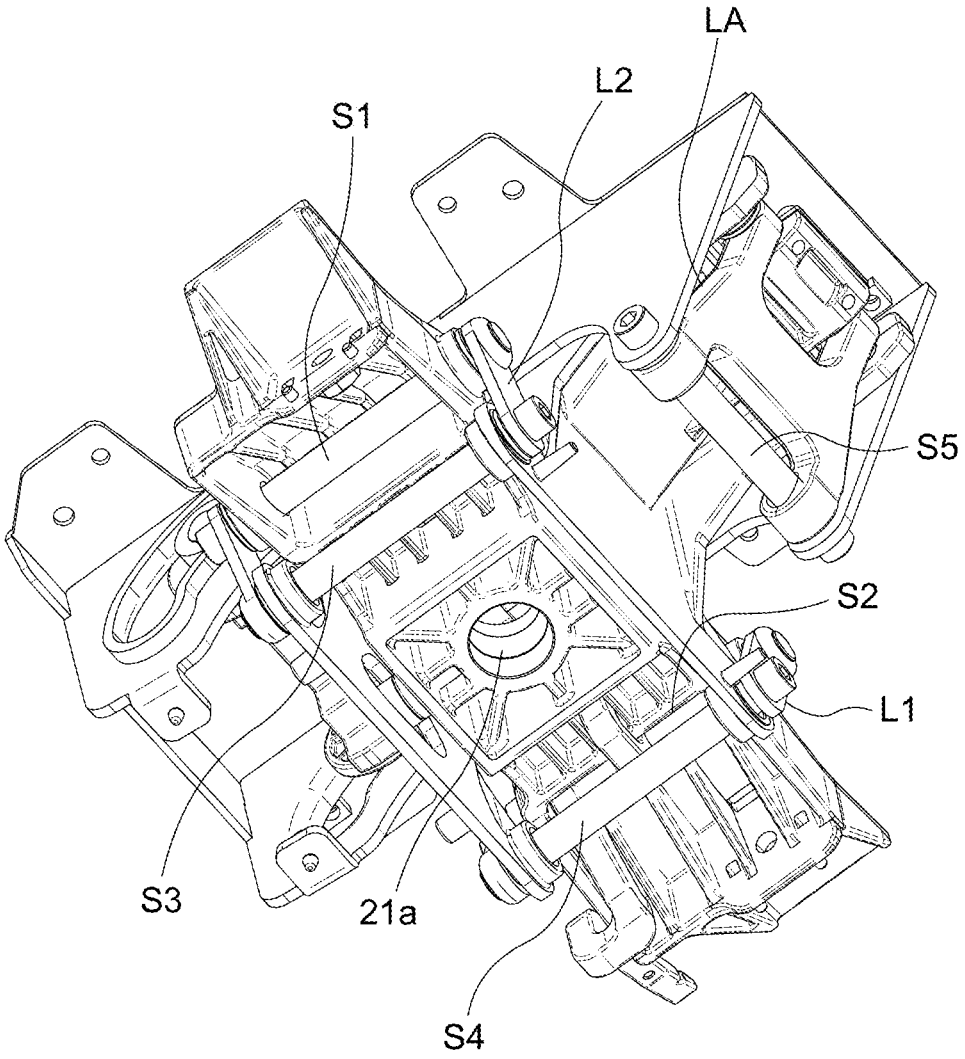
FIG. 6 is a perspective view of a part of FIG. 5, as viewed obliquely from below.
Figure 7:
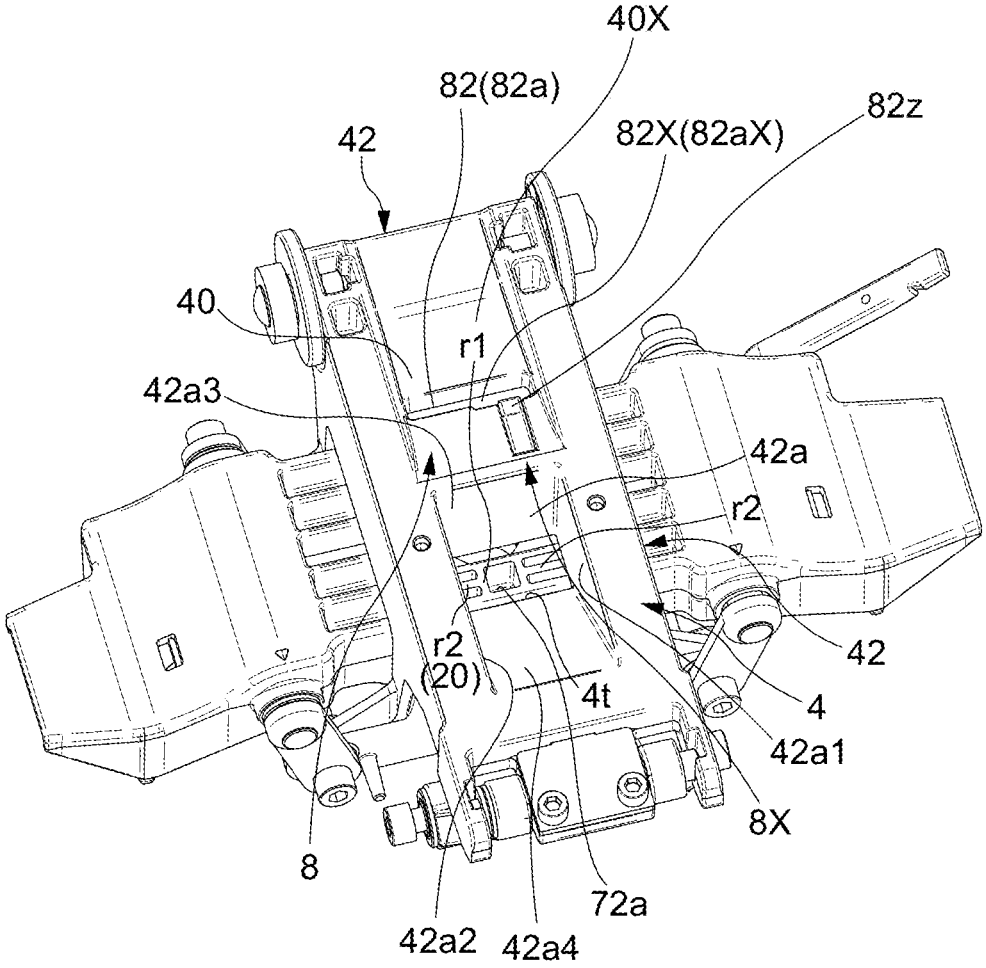
FIG. 7 is an enlarged perspective view illustrating a part of FIG. 4.
Figure 8:
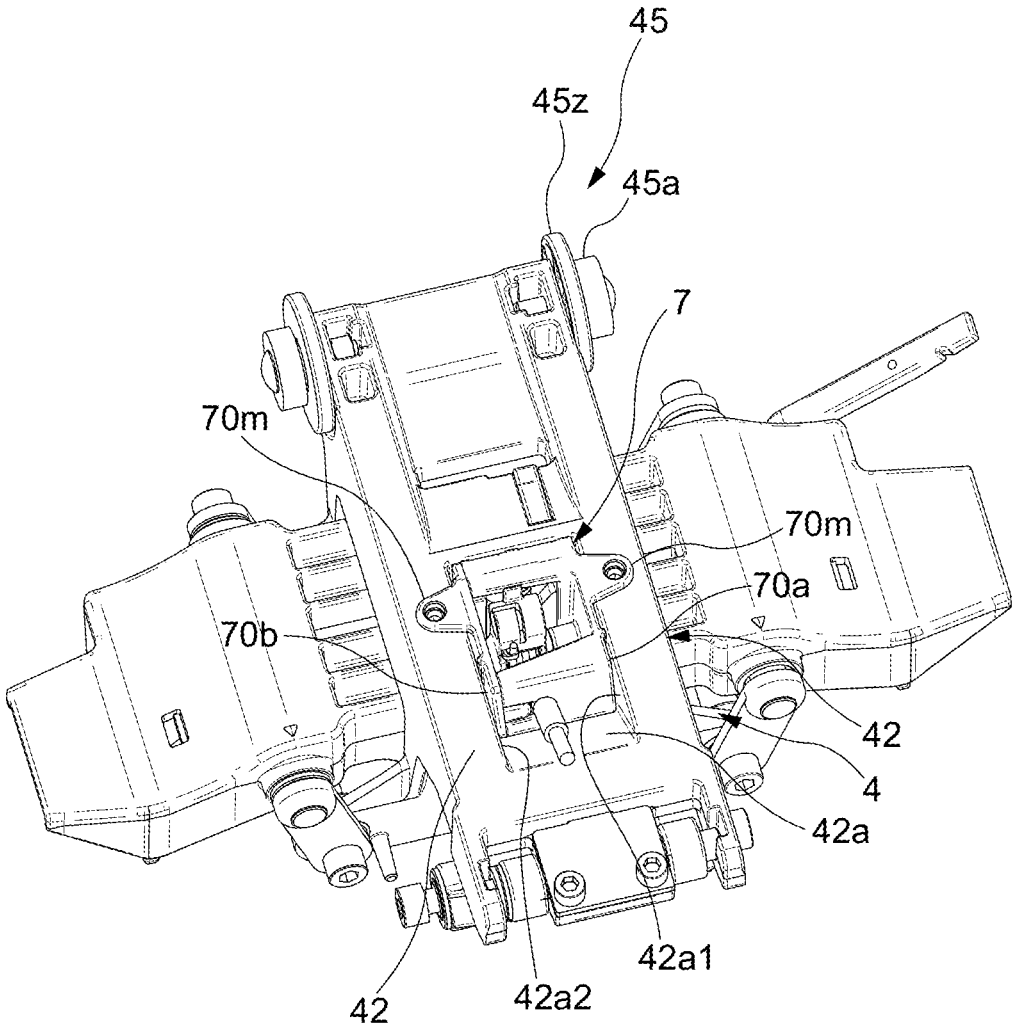
FIG. 8 is a perspective view of a state where a left-right stopper mechanism is incorporated in FIG. 4.

The left-right swing part 4 includes a pair of plate-shaped link bases 41 disposed separated from each other in the front-rear direction to perform a swinging operation in the left-right direction with respect to the support base part 2, and a left-right swing main body 42 configured to connect the pair of link bases 41, 41. At both left and right ends of the link bases 41, holes 41*a*, 41*a* are opened and the lower ends of the left-right swing links L1, L2 are attached via swing shafts S3, S4. FIG. 4 illustrates a state where the links L1, L2 are attached via the swing shafts S1 to S4. As illustrated in FIGS. 7 and 8, the left-right swing main body 42 is provided with a unit attached hole 42*a* penetrating in the up-down direction, and a later-described left-right lock part 7 is attached to the unit attached hole 42*a*. That is, the left-right swing main body 42 is disposed in a suspended state to be swingable to the left and right with respect to the support base part 2 via the left-right swing links L1, L2, and the left-right swing links L1, L2 are attached so that the distance between the lower ends is smaller than the distance between the upper ends, as illustrated in FIG. 4 and the like.

Figure 9:
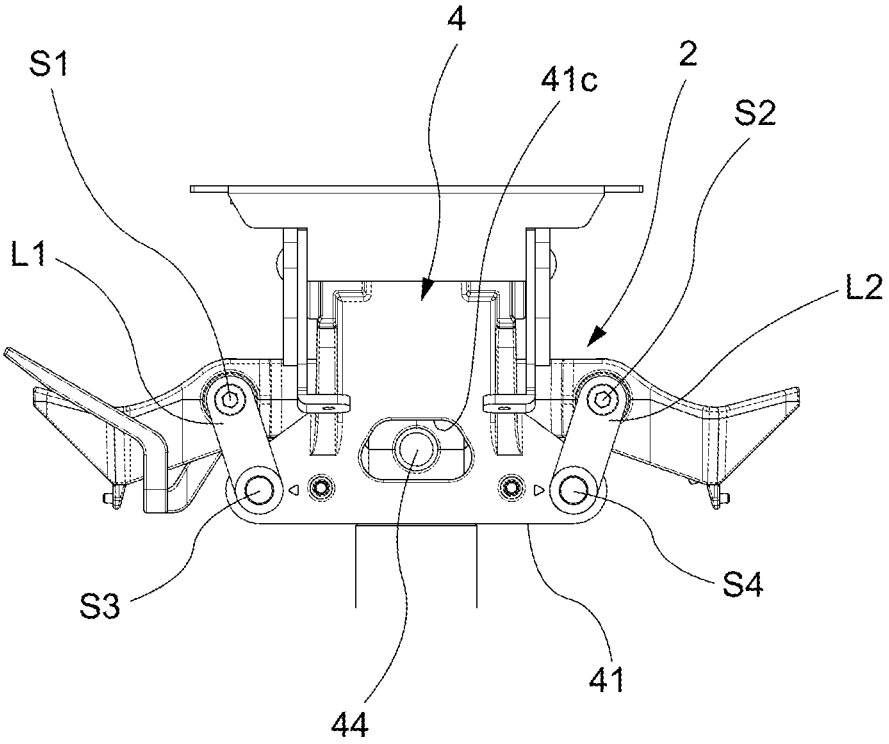
FIG. 9 is an operation explanatory diagram of the left-right swing part.
Figure 10:
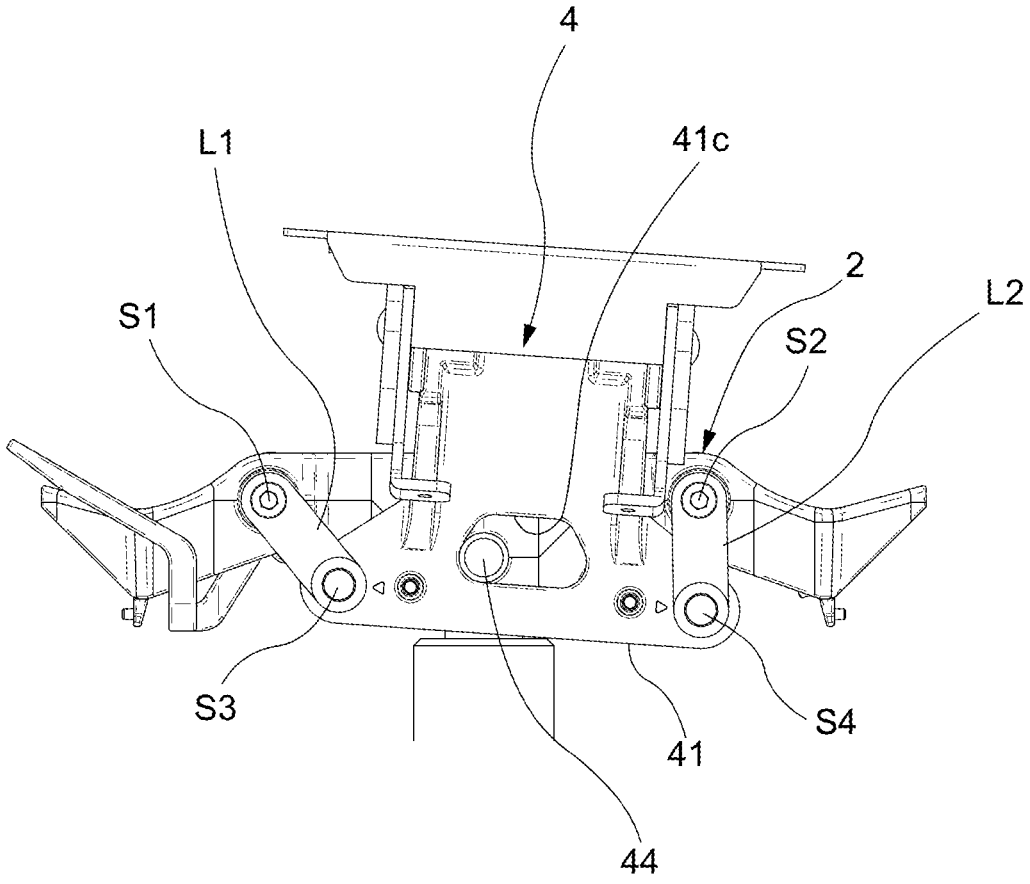
FIG. 10 is an operation explanatory diagram of the left-right swing part.

That is, as illustrated in FIGS. 9 and 10, when the left-right swing part 4 swings, the link L2 (L1) located at the swing destination approaches a vertical posture and the other link L1 (L2) approaches a horizontal posture, as a result of which an operation is performed in which a center of gravity of the left-right swing part 4 is lifted while tilting so that a moving tip side is lower.

A window 41*c* is opened at the center of the link base 41, a rolling damper 44 is positioned in the window 41*c*, and a swing range of the left-right swing part 4 is restricted to a range where the rolling damper 44 can perform a relative movement within the window 41*c*.

Figure 16:
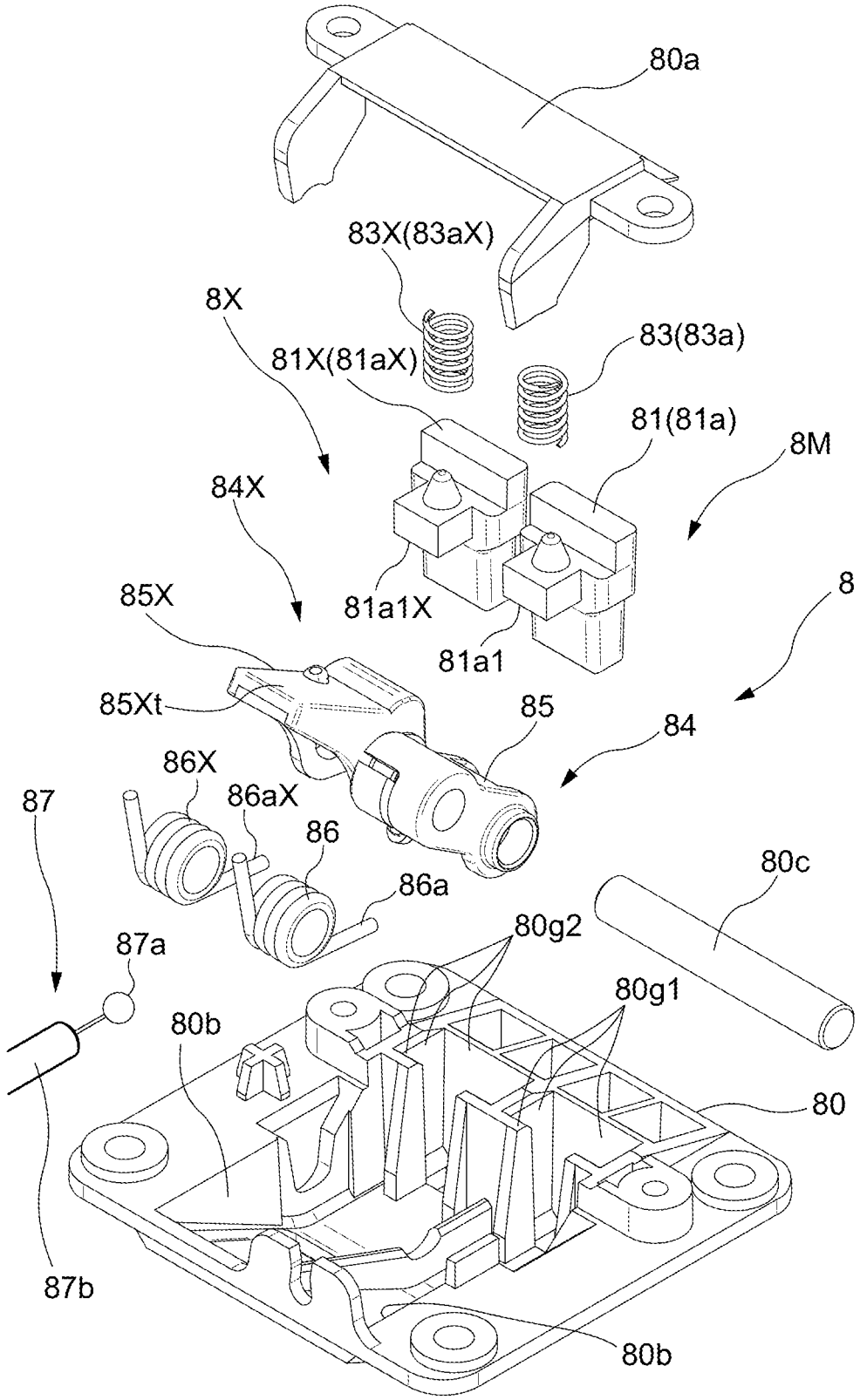
FIG. 16 is an exploded perspective view of a control mechanism and a front-rear stopper mechanism configured to suppress a front-rear operation.

The front-rear swing part 3 includes a pair of plate-shaped rail plates 31, 31 disposed separated from each other in the left-right direction to perform a swinging operation in the front-rear direction with respect to the left-right swing part 4, and an upper connection plate 32 and a front connection plate 33 configured to connect the pair of rail plates 31, 31. At a front side of the rail plates 31, a guide hole 34 is provided to penetrate the rail plates 31, a bearing 45*a* is engaged in the guide hole 34, and the bearing 45*a* is a rolling body 45 provided to be rollable independently to the left and right on a side surface at a front end side of the left-right swing main body 42. The reference sign 45*z* in the drawings indicates a spacer disposed on an inner surface side of the rail plate 31 and having a diameter larger than that of the bearing 45*a*. The rear end side of the rail plate 31 extends rearward and downward, a lower end of a link arm LA, being a swingable front-rear swing link, is attached via a swing shaft S5 to an extension end of the rail plate 31, and the upper end of the link am LA is supported by the rear end of the left-right swing part 4 via a swing shaft S6. That is, the rear end of the front-rear swing part 3 is disposed in a suspended state to be swingable forward and rearward with respect to the left-right swing part 4 via the link arm LA. The guide hole 34 has a shape that is gently curved forward and downward from the rear end side toward the front end side, and at the rear end, there is provided a shockless part SL configured to mitigate a shock when the front-rear swing part 3 moves forward together with the seat 5. The upper connection plate 32 is provided with a unit attached hole 32*a* penetrating in the up-down direction, and a front-rear lock unit 8 described later based on FIG. 16 is attached to the unit attached hole 32*a*. Axles of the bearing 45*a* being the rolling body 45 in the example of the drawings are separated to the left and right. However, as long as the bearing 45*a* being the rolling body 45 is rollable independently to the left and right, the axle may be common.

Figure 11:
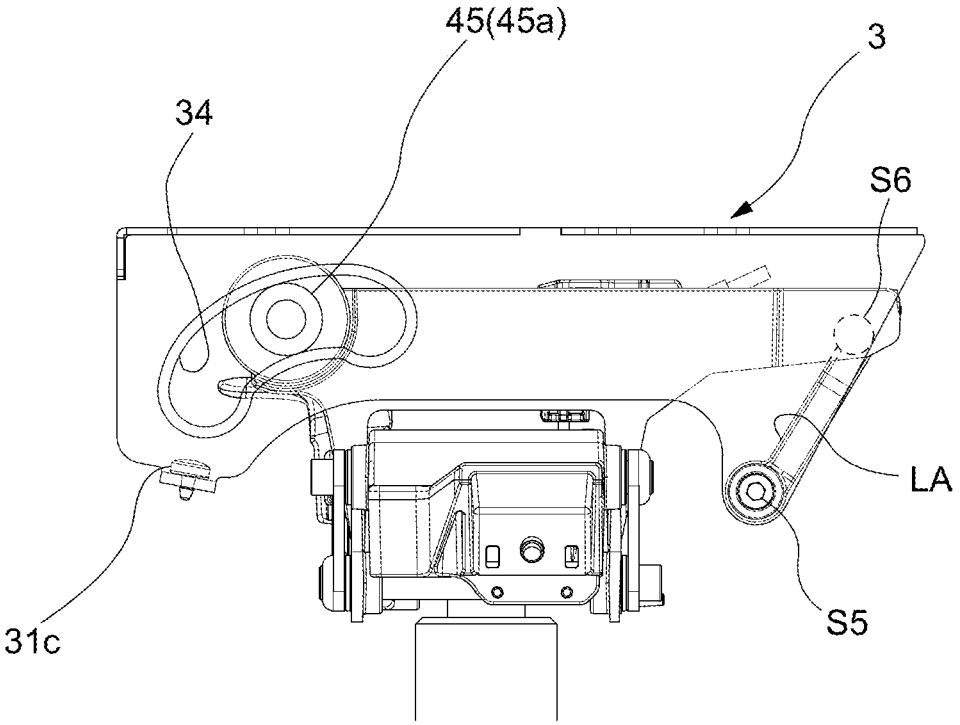
FIG. 11 is an operation explanatory diagram of the front-rear swing part, a part of which is illustrated transparently.
Figure 12:
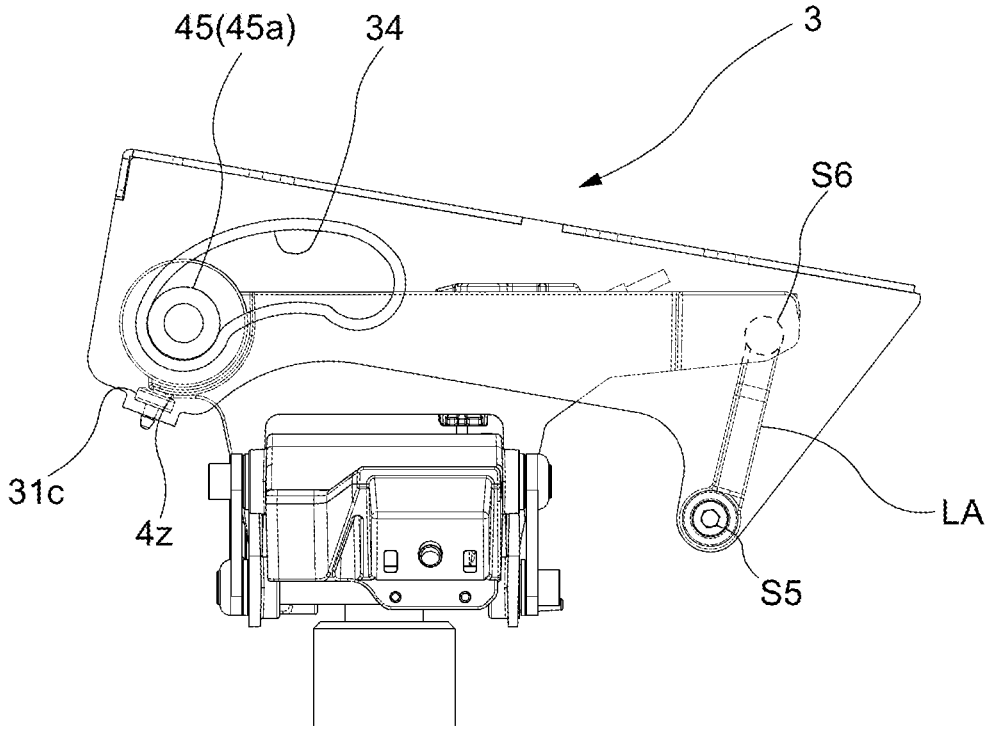
FIG. 12 is an operation explanatory diagram of the front-rear swing part, a part of which is illustrated transparently.
Figure 13:
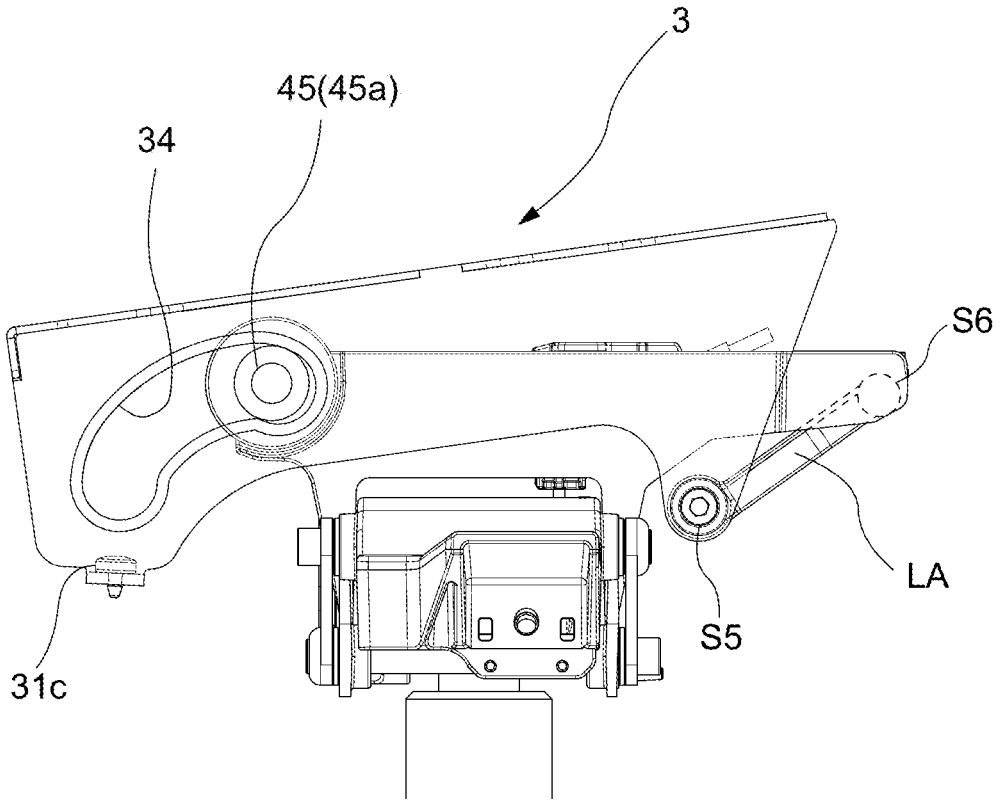
FIG. 13 is an operation explanatory diagram of the front-rear swing part, a part of which is illustrated transparently.

That is, when the front-rear swing part 3 moves rearward, as illustrated in FIG. 12, from the state of FIG. 11 where the upper surface of the front-rear swing part 3 takes a substantially horizontal posture, the bearing 45*a* performs a relative movement with respect to the front end side of the guide hole 34 at the front end of the front-rear swing part 3, so that the front end side of the front-rear swing part 3 is lifted to a high position, and the link arm LA approaches a vertical posture. As a result, au operation is performed where the rear end side of the front-rear swing part 3 is guided to a lower position. Conversely, when the front-rear swing part 3 moves forward, as illustrated in FIG. 13, from the state of FIG. 11, the bearing 45*a* performs a relative movement with respect to the rear end side of the guide hole 34 at the front end of the front-rear swing part 3, so that the front end side of the front-rear swing part 3 is guided to a lower position, and the link arm LA approaches a horizontal posture. As a result, an operation is performed where the rear end of the front-rear swing part 3 is lifted to a higher position. That is, the front-rear swing part 3 performs an inclining operation so that the moving tip side is also lower in the front-rear direction.

On the front end side of the rail plate 31 included in the front-rear swing part 3, a pitching damper 31*c* formed by bending a part of the rail plate 31 is provided, and when swinging rearward, the front-rear swing part 3 abuts against a front end lower part 4*z* (see FIG. 3) of the left-right swing part 4 in the vicinity of the swing end to mitigate the shock at the rearward movement end.

Figure 14:
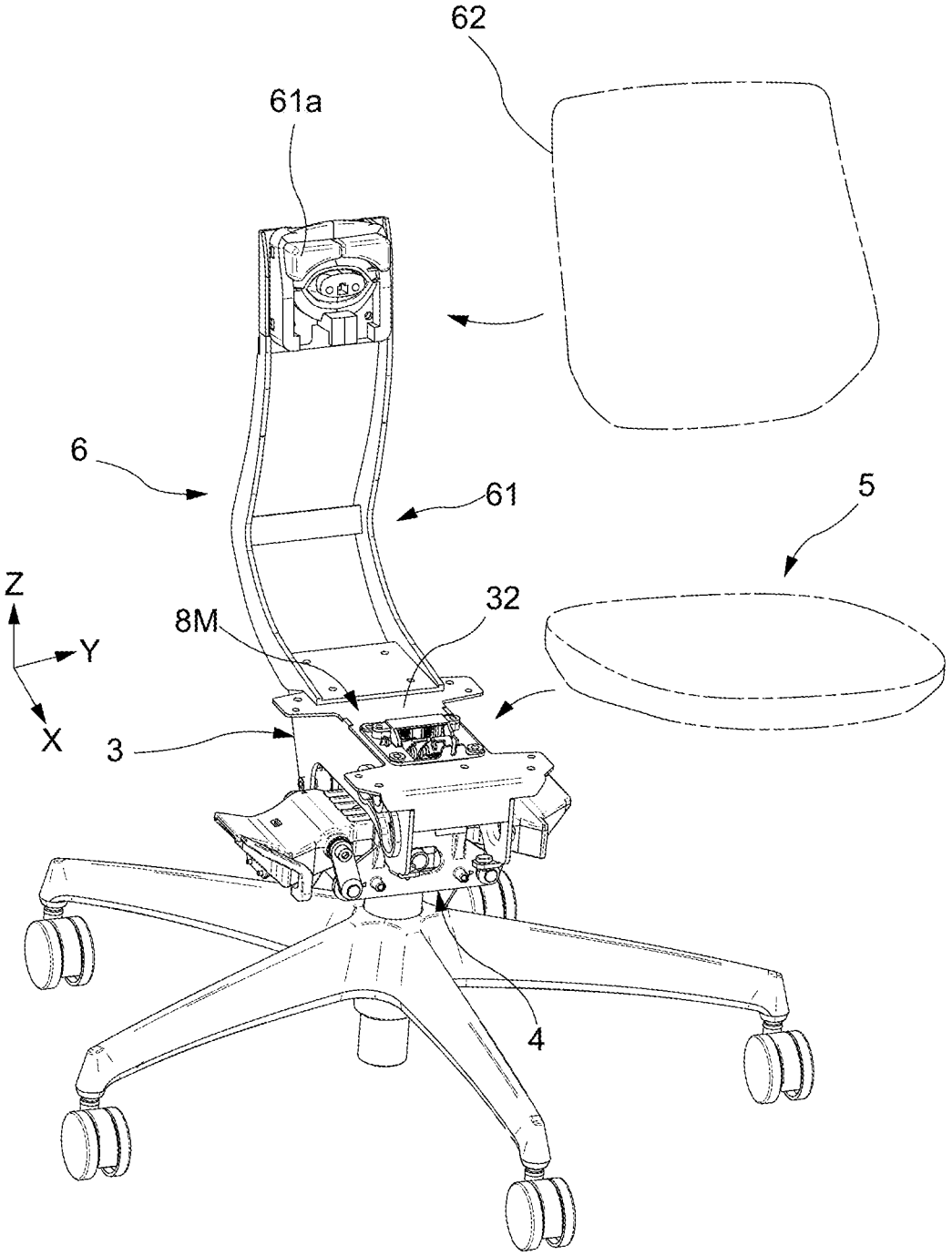
FIG. 14 is an exploded perspective view illustrating a relationship between the front-rear swing part and a back.
Figure 15:
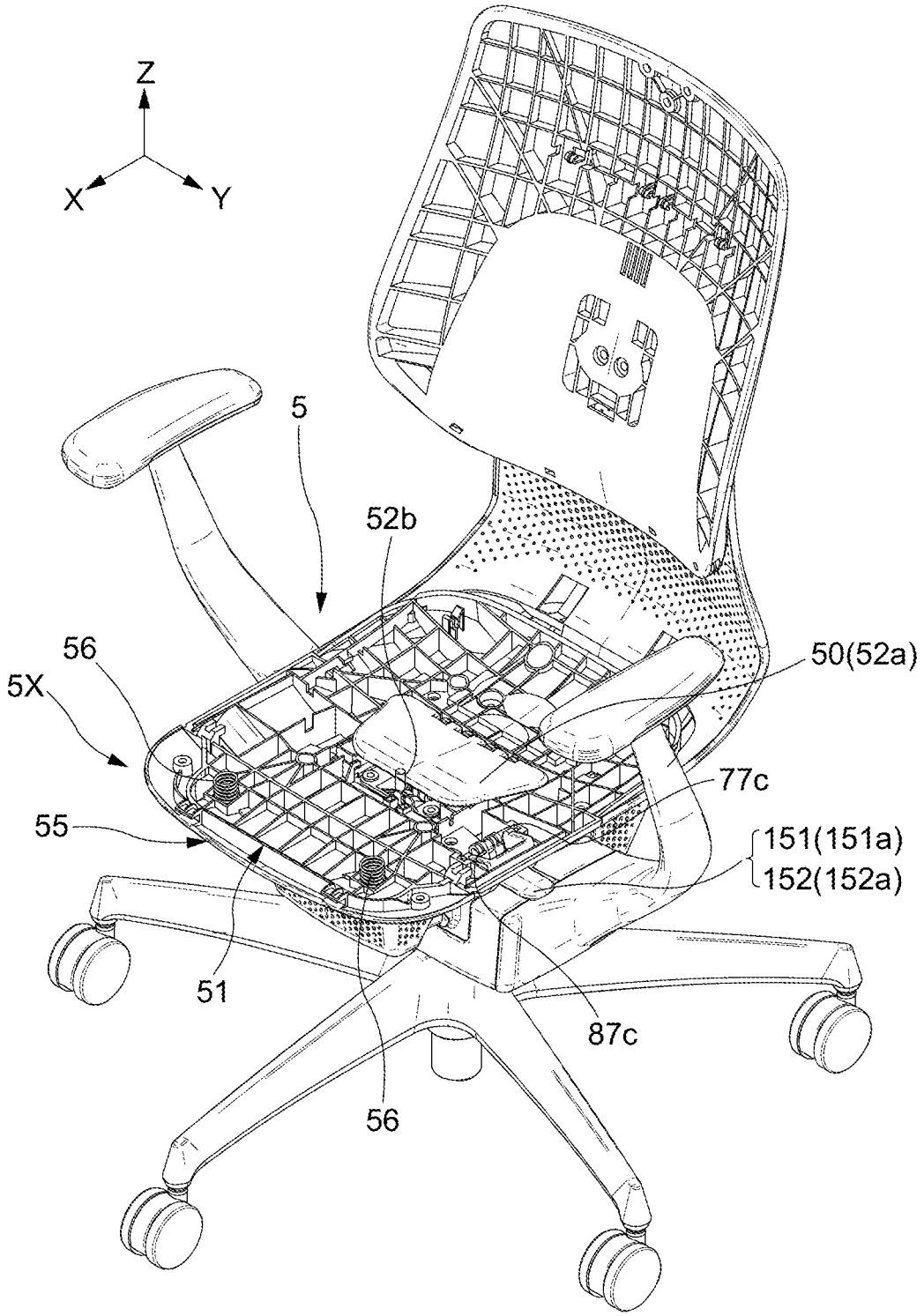
FIG. 15 is a perspective view illustrating a weight-receiving part provided on a seat.

As illustrated in FIG. 14, a back frame 61 included in the back 6 is attached to a rear part of the upper connection plate 32 included in a front-rear swing part 3, and a seat outer shell 51 (see FIG. 15 included in the seat 5 is attached to the connection plate 32 from above. That is, when the back frame 61 configured to support a backrest 62 is erected integrally behind the seat 5 and the seat 5 swings in the front-rear and left-right directions with respect to the support base part 2, as indicated by X and Y in the drawing, the back frame 61 also moves together with the seat 5, but the backrest 62 according to the present embodiment operates separately from the back frame 61 and the seat 5, as described later.

Figure 17:
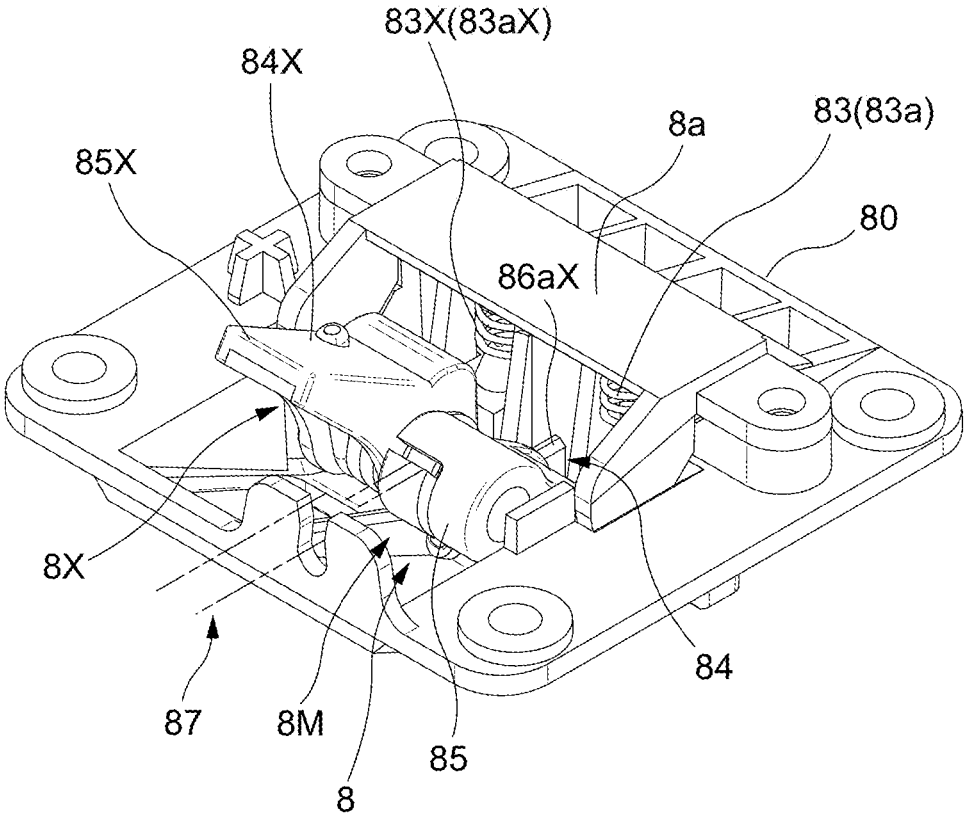
FIG. 17 is a perspective view of the assembled control mechanism and front-rear stopper mechanism configured to suppress a front-rear operation.
Figure 18:
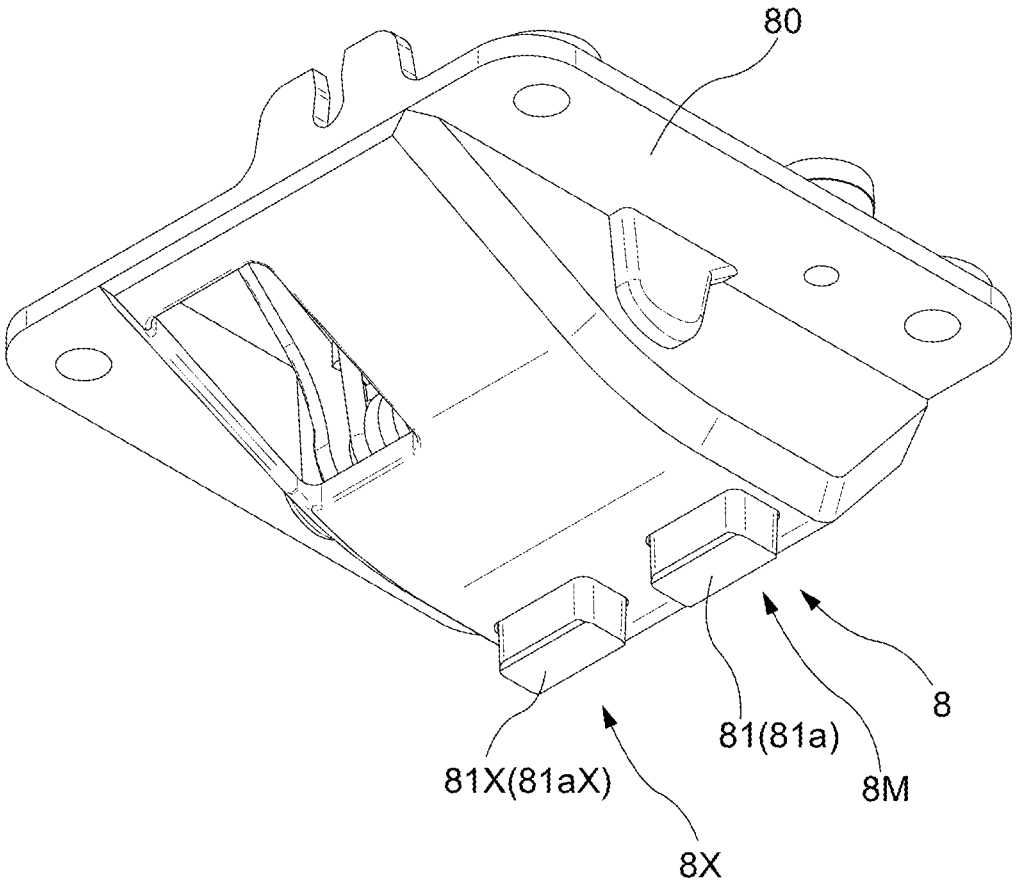
FIG. 18 is a perspective view of FIG. 17, as viewed obliquely from below.

A front-rear stopper mechanism 8M utilizing the front-rear lock unit 8 illustrated in FIGS. 16 to 18 is provided to suppress a swinging of the seat 5 in the front-rear direction relative to the support base part-2 at a predetermined position through an operation of an operating member 152 illustrated in FIG. 15. A left-right stopper mechanism 7M utilizing the left-right lock unit 7 illustrated in FIGS. 19 and 20 is provided to suppress a swinging of the seat 5 in the left-right direction relative to the support base part 2 at a position determined in advance through an operation of an operating member 151 (being an operating member common with the operating member 152 in practice) illustrated in FIG. 15.

In this embodiment, the left-right swing part 4 is supported by the support base part 2 and the front-rear swing part 3 is supported by the left-right swing part 4 so that a layered structure is formed in which the left-right stopper mechanism 7M is provided between the support base part 2 and the left-right swing part 4, and the front-rear stopper mechanism 8M is provided between the left-right swing part 4 and the front-rear swing part 3.

Figure 3:
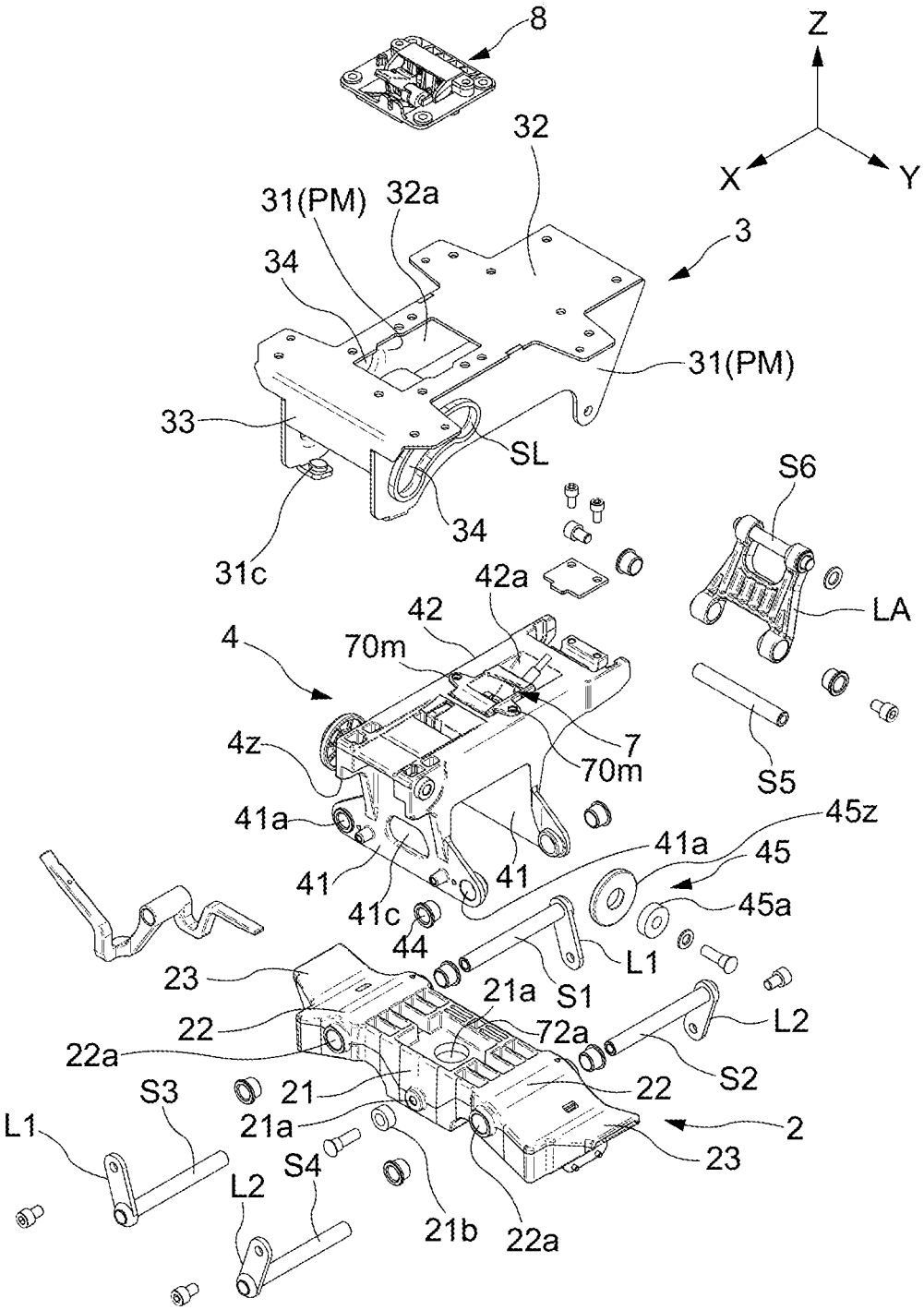
FIG. 3 is an exploded perspective view of front, rear, right, or left support portions in the chair.
Figure 20:
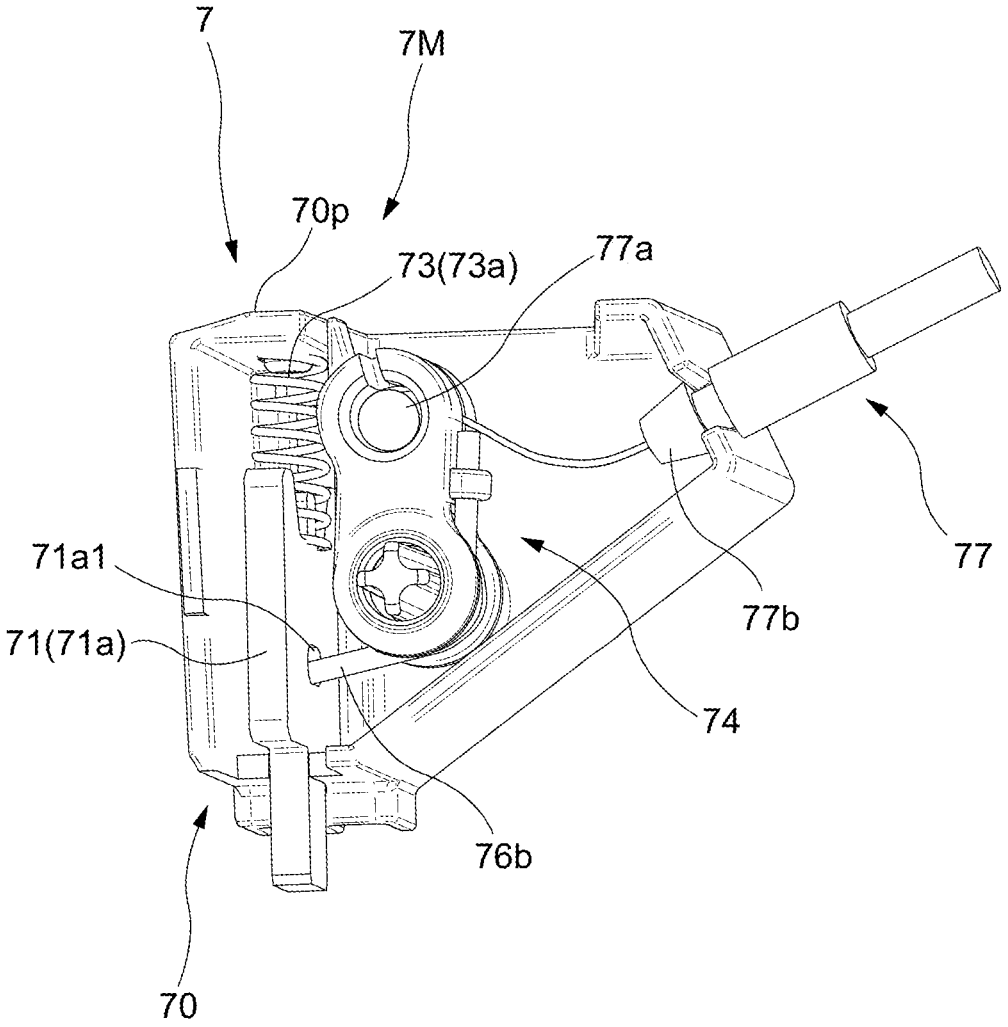
FIG. 20 is a perspective view of a partially assembled left-right stopper mechanism configured to suppress a left-right operation.
Figure 21A:
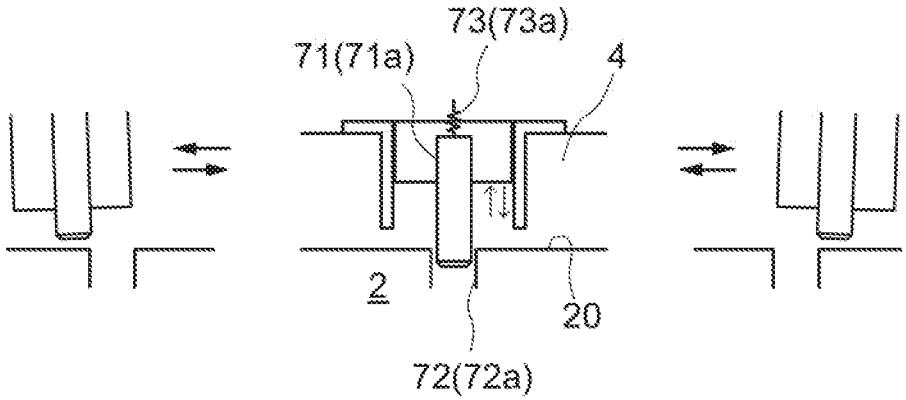
FIGS. 21A to 21C are schematic views illustrating suppressing operations for the front, rear, right, or left.
Figure 21B:
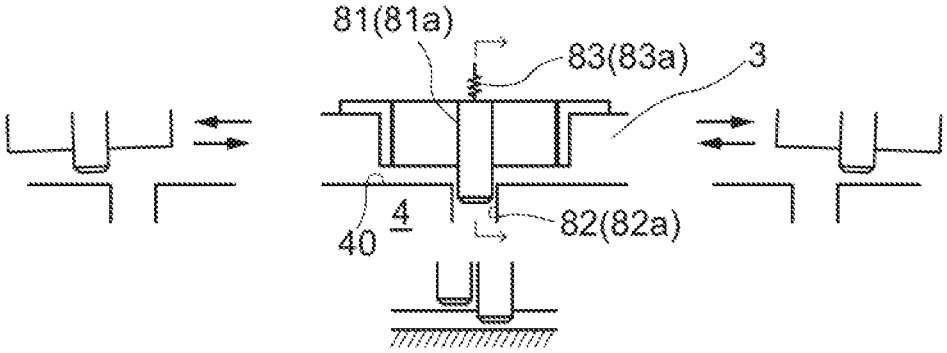
Figure 21C:
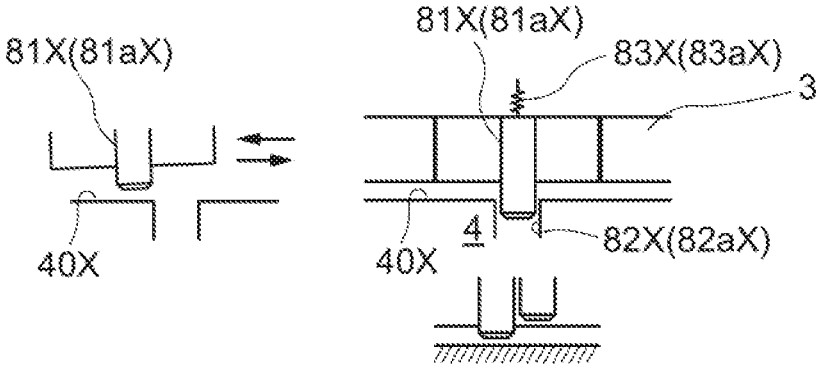

The left-right stopper mechanism 7M is configured to switch between allowing and suppressing the swinging of the seat 5 in the left-right direction, by engaging or disengaging an engaging part 71 and an engaged element 72 illustrated in FIG. 21 A when the operating member 151 illustrated in FIG. 15 is operated. Specifically, the left-right stopper mechanism 7M includes an engagement pin 71*a* being the engaging part 71 provided at the side of the left-right swing part 4 and a groove 72*a* being the engaged part 72 provided on a sliding surface 20, the engaged part 72 relatively operating at the side of the support base part 2 being a position facing the engagement pin 71*a*. The engagement pin 71*a* is configured to be elastically biased toward the sliding surface 20, and to be fitted in the groove 72*a* at a predetermined position. As illustrated in FIGS. 3 and 7, the groove 72*a* has a rectangular shape in plan view and is provided at a center reference position in the left-right direction of the support base part 2 exposed upward via an opening 4*t* of the left-right swing part 4, and the engagement pin 71*a* illustrated in FIG. 20 is engaged to and disengaged from the groove 72*a*. A coil spring 73*a* being an elastic member 73 functions to bias the engagement pin 71*a* in a direction where the engagement pin 71*a* protrudes toward the sliding surface 20. Further, the left-right stopper mechanism 7M includes a conversion mechanism 74 illustrated in FIGS. 19 and 20 configured to convert an operation of the operating member 151 into an operation in a direction in which the engagement pin 71*a* is separated from the sliding surface 20 and the conversion mechanism 74, the engagement pin 71*a* and the coil spring 73*a* are integrally incorporated into a casing 70 of the left-right lock unit 7 to form with unitized.

Figure 19:
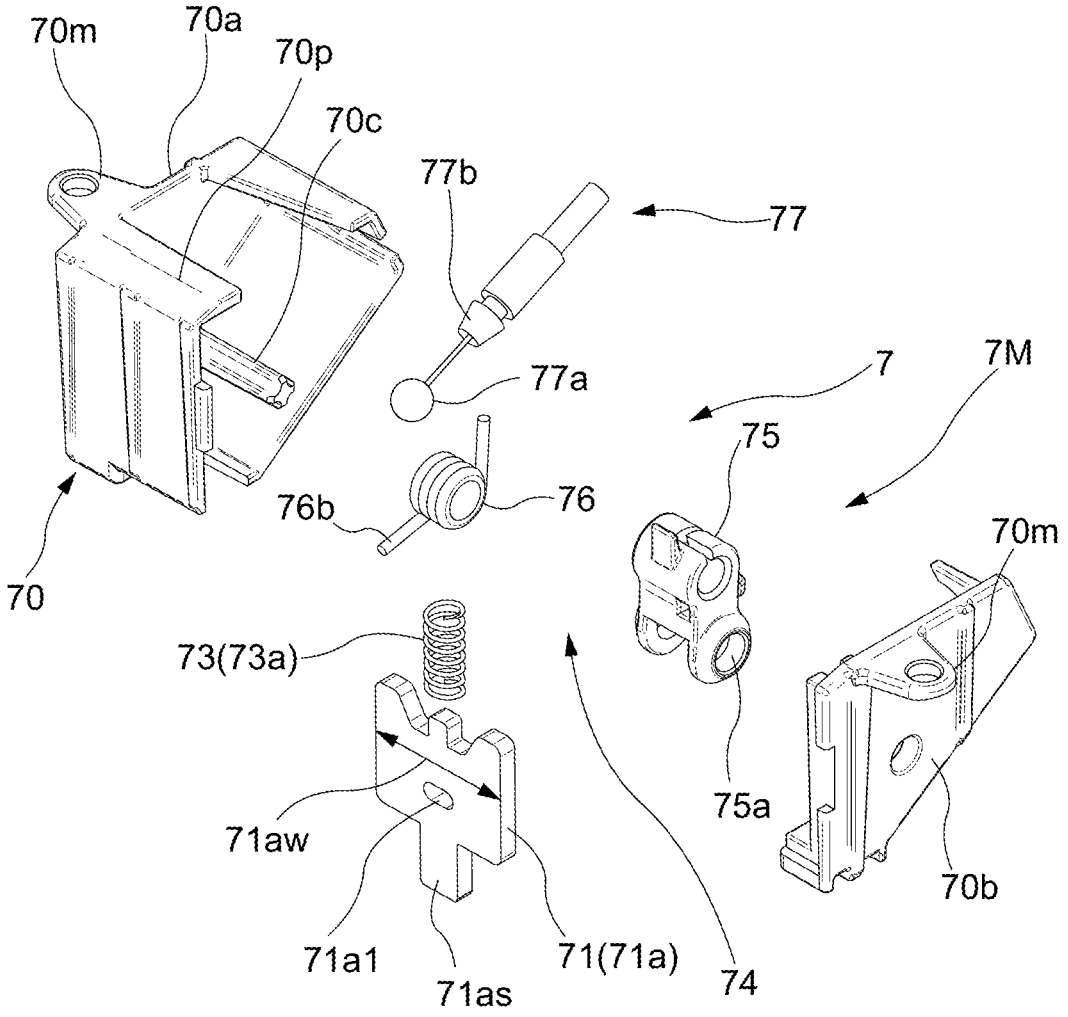
FIG. 19 is an exploded perspective view of a left-right stopper mechanism configured to suppress a left-right operation.

As illustrated in FIG. 19, the casing 70 has a halved structure, and the engagement pin 71*a* is disposed to be liftable and lowerable in a state where a wide part 71*aw* of the engagement pin 71*a* is guided by inner surfaces of side walls 70*a*, 70*b* of the casing 70 while a tip end part 71*as* being a part of the engagement pin 71*a* protrudes from a lower end of the casing 70. The conversion mechanism 74 includes the above-described coil spring 73*a* provided elastically in a compressed state between an upper end of the engagement pin 71*a* and an upper wall 70*p* of the casing 70, a stopper operation arm 75 rotatably supported via a horizontal shaft 70*c* between the side walls 70*a*, 70*b* of the casing 70 at a position adjacent to the engagement pin 71*a*, a torsion coil spring 76 rotatably attached together with the stopper operation arm 75, and a wire tube 77 including a spherical wire tip end 77*a* to be attached to the stopper operation arm 75 and a tube tip end 77*b* locked to the casing 70. As illustrated in FIG. 15, the other end of the wire tube 77 is locked in the vicinity of an operation lever 151*a* being the operating member 151 provided in the seat 5 and a wire base end 77*c* drawn therefrom is connected to the operation lever 151*a*. A tip end 76*b* of the torsion coil spring 76 is engaged with a hole 71*a*1 provided on the engagement pin 71*a*.

When the casing 70 is fitted into the unit attached hole 42*a* of a swing main body part 42 included in the left-right swing part 4 illustrated in FIG. 7 to achieve the state in FIG. 8, an attachment part 70*m* provided in the casing 70 is mounted on an upper surface of the swing main body part 42 and fixed by screwing. The left and right side walls 70*a*, 70*b* of the casing 70 are tightly accommodated between left and right side walls 42*a*1, 42*a*2 of the unit attached hole 42*a* and the engagement pin 71*a* is tightly guided in the casing 70 by the inner surfaces of the side walls 70*a*, 70*b* of the casing 70. In this way, a rattling of the engagement pin 71*a* to the left and right is suppressed, and thus, the unit attached hole 42*a* of a left-right swing part 4 illustrated in FIG. 7 includes merely the left and right side walls 42*a*1, 42*a*2, a rear wall 42*a*3, and an inclined front wall 42*a*4 to form the lower opening 4*t* without a bottom wall. The engagement pin 71*a* is configured to hang directly from the lower opening 4*t* of the unit attached hole 42*a* without being guided by the bottom wall to abut against the sliding surface 20, to engage with the groove 72*a*. Parts in the front-rear direction of the engagement pin 71*a* are supported by front and rear guide walls formed in the casing 70. The groove 72*a* is formed between longitudinal ribs r1, r1 provided in the support base part 2, lateral ribs r2 are provided around the longitudinal ribs r1, r1, and upper surfaces of the longitudinal ribs r1 and the lateral ribs r2 form the sliding surface 20 on which the engagement pin 71*a* slides until engaging with the groove 72*a*.

Figure 22:
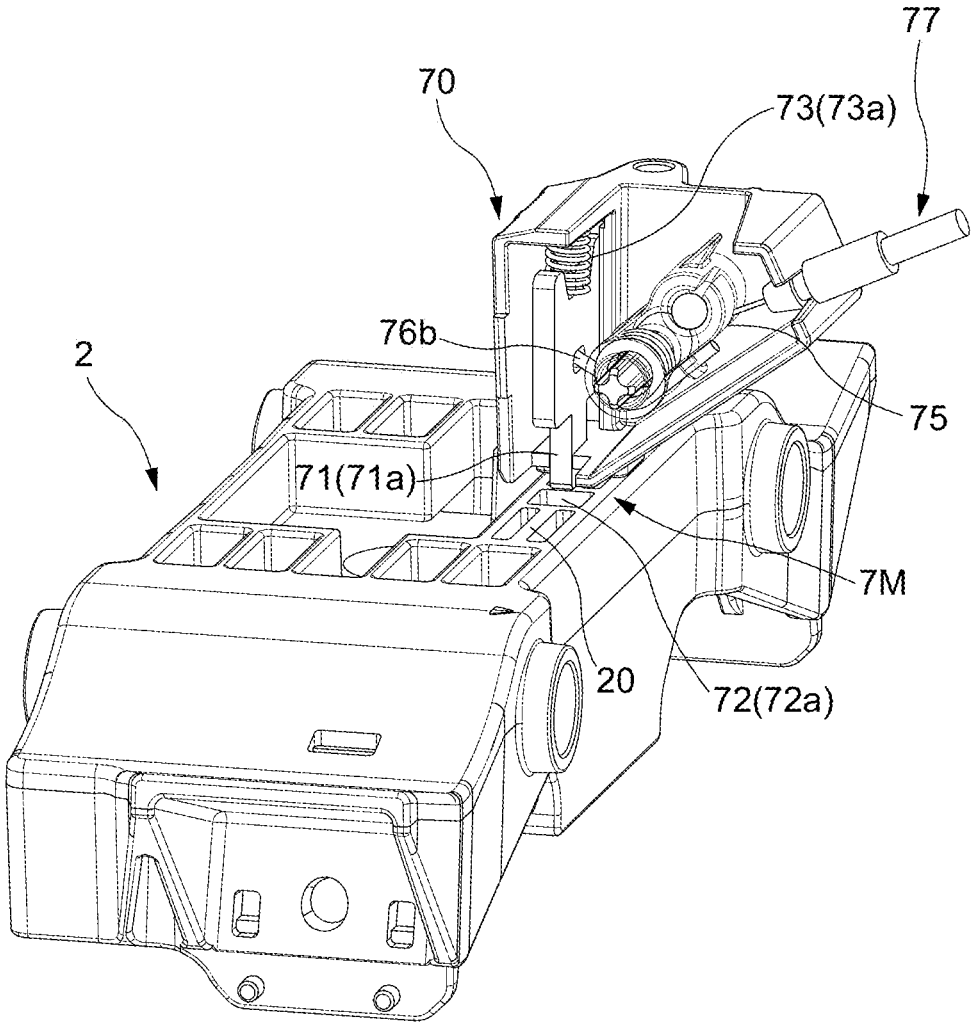
FIG. 22 is an operation explanatory diagram of the left-right stopper mechanism.
Figure 23:
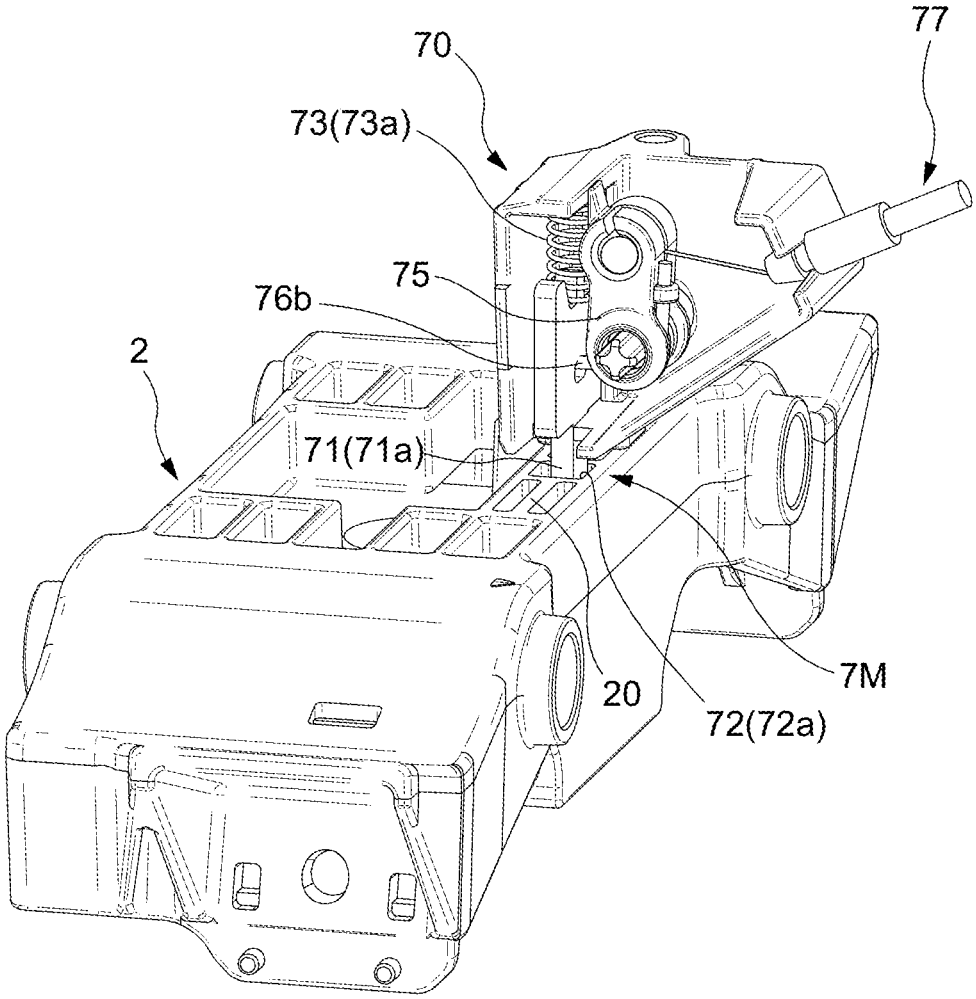
FIG. 23 is an operation explanatory diagram of the left-right stopper mechanism.

As illustrated in FIG. 22, when the operation lever 151*a* is in an unlocked position, the wire tube 77 rotates the stopper operation arm 75 to compress the coil spring 73*a* while the engagement pin 71*a* is lifted upwards at a tip end 76*b* of the torsion coil spring 76. When the operation lever 151*a* is operated to a locked position, as illustrated in FIG. 23, the tip end 76*b* of the torsion coil spring 76 rotates together with the stopper operation arm 75 by the repulsive force of the coil spring 73*a*, the engagement pin 71*a* is pressed downward, and when the engagement pin 71*a* engages with the groove 72*a* of the support base part 2, the locked state in the left-right direction is realized.

The front-rear stopper mechanism 8M is configured to switch between allowing and suppressing the swinging of the seat 5 in the front-rear direction, by engaging or disengaging an engaging element 81 and an engaged part 82 illustrated in FIG. 21 B when the operating member 152 illustrated in FIG. 15 is operated. Specifically, a configuration is so that the front-rear stopper mechanism 8M includes an engagement pin 81*a* being the engaging part 81 provided at the side of the front-rear swing part 3 and a groove 82*a* being the engaged part-82 provided on a sliding surface 40, the engaged part 82 relatively operating at the side of the left-right swing part 4 being a position facing the engagement pin 81*a*. The engagement pin 81*a* is configured to be elastically biased toward the sliding surface 40, and to fit in the groove 82*a* at a predetermined position. As illustrated in FIG. 7, the groove 82*a* is provided on an upper surface of the swing main body part 42 of the left-right swing part 4 at one or more predetermined locations (one location in the present embodiment) within a movable range of the engagement pin 81*a* when the engagement pin 81*a* of the front-rear swing part 3 mounted on the upper surface of the swing main body part 42 moves in the front-rear direction, and thus, the groove 82*a* has a shape extending in the left-right direction and an upper surface of a swing main body part 42 forms the sliding surface 40. A coil spring 83*a* being an elastic member 83 functions to bias the engagement pin 81*a* in a direction where the engagement pin 81*a* protrudes toward the sliding surface 40, a conversion mechanism 84 illustrated in FIGS. 16 and 17 is provided, the conversion mechanism 84 converting an operation of the operating member 152 into an operation in a direction in which the engagement pin 81*a* is separated from the sliding surface 40, and the conversion mechanism 84, the engagement pin 81*a*, and the coil spring 83*a* are integrally incorporated into a half-piece of the casing 80 to form with unitized.

The casing 80 has a flat saucer-shape opened upward, and thus, the engagement pin 81*a* is guided by a guide 80*g*1 in the casing 80, and is disposed to be liftable and lowerable with a part of the engagement pin 81*a* protruding from a lower end of the casing 80. The conversion mechanism 84 includes the above-described coil spring 83*a* provided elastically in a compressed state between an upper end of the engagement pin 81*a* and a cover 80*a* closing the upper opening of the casing 80, a stopper operation arm 85 rotatably supported by a horizontal shaft 80*c* disposed between side walls 80*b*, 80*b* of the casing 80 at a position adjacent to the engagement pin 81*a*, a torsion coil spring 86 rotatably attached together with the stopper operation arm 85, and a wire tube 87 having a spherical wire tip end 87*a* that is attached to the stopper operation arm 85 and a tube tip end 87*b* locked to the casing 80. As illustrated in FIG. 15, the other end of the wire tube 87 is locked in the vicinity of an operation lever 152*a* being the operating member 152 provided in the seat 5 and a wire base end 87*c* drawn therefrom is connected to the operation lever 152*a*. A tip end 86*a* of the torsion coil spring 86 is at all times smoothly slidably engaged with a downward-facing surface 81*a*1 of the engagement pin 81*a*.

Figure 24:
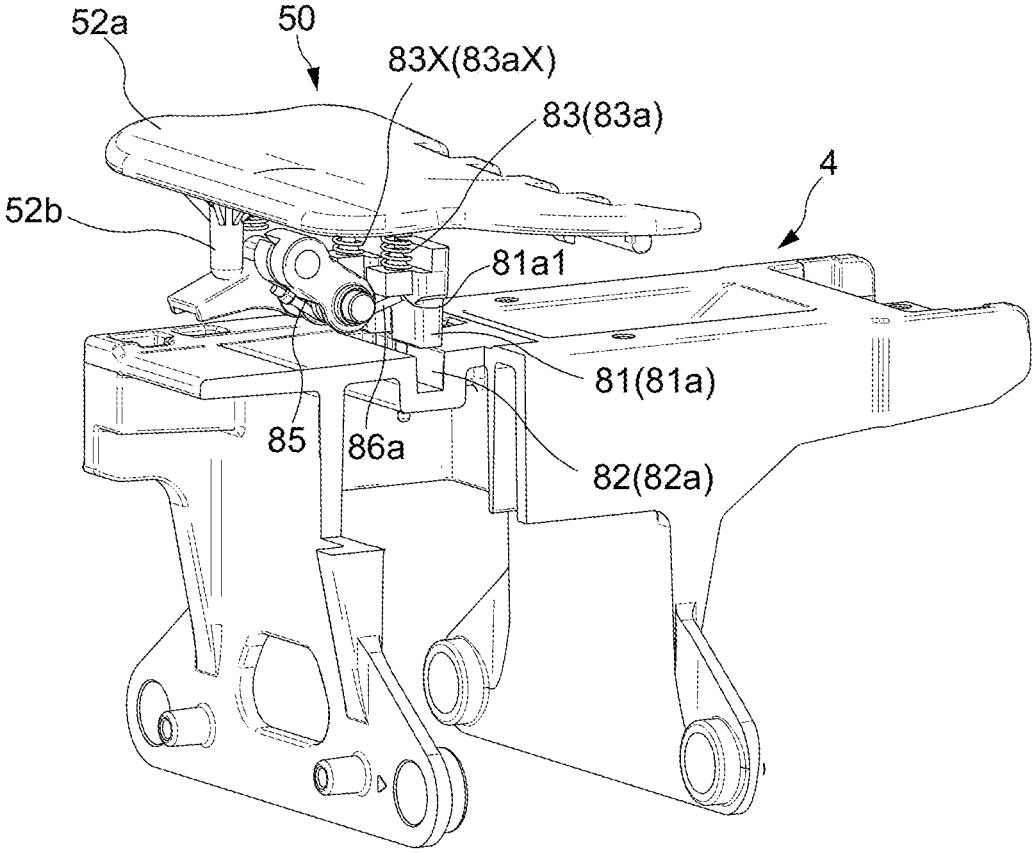
FIG. 24 is an operation explanatory diagram of the front-rear stopper mechanism.
Figure 25:
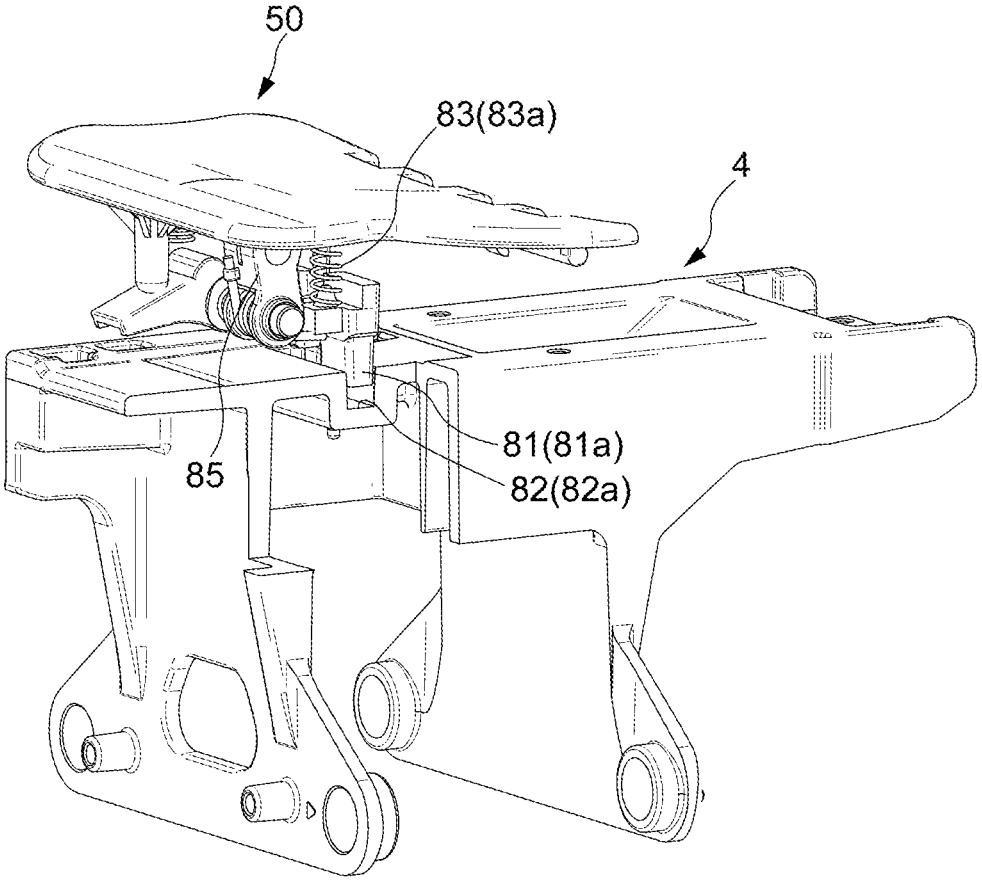
FIG. 25 is an operation explanatory diagram of the front-rear stopper mechanism.

When the operation lever 152*a* illustrated in FIG. 15 is in an unlocked position, the wire tube 87 illustrated in FIG. 17 rotates the stopper operation arm 85 to compress the coil spring 83*a* while the engagement pin 81*a* is lifted upwards at a tip end 86*a* of the torsion coil spring 86, as illustrated in FIG. 24. When the operation lever 152*a* is operated to a locked position, the tip end 86*a* of the torsion coil spring 86 rotates, as illustrated in FIG. 25, together with the stopper operation arm 85 by the repulsive force of the coil spring 83*a*, the engagement pin 81*a* is pressed downward, and when the engagement pin 81*a* engages with the groove 82*a* of the left-right swing part 4, the locked state in the front-rear direction is realized.

It is noted that, in the chair according to the embodiment, a control mechanism 8X configured to automatically suppress a movement of the seat 5 in the front-rear direction at a predetermined position when the seated person leaves the seat, is provided along with the half-piece of the front-rear lock unit 8 of the front-rear stopper mechanism 8M.

First, to detect seating of the seated person, a configuration is such that a weight-receiving part 50 (see FIG. 15), the height position of which changes due to a person sitting on a seat surface, is provided substantially at a center position of the seat 5, the change of the height position is mechanically transmitted to the control mechanism 8X illustrated in FIGS. 16 and 18 configured to control an operation of the front-rear swing part 3 being the movable part, and the control mechanism 8X changes the operation of the front-rear swing part 3, that is, the front-rear operation of the seat 5, between allowed and suppressed states.

The operation changer 8X changes the allowed/suppressed states of the operation of the front-rear swing part 3 when an engagement state of an engaging part 81X illustrated in FIG. 21 C and provided in the front-rear swing part 3 being a movable part and an engaged part 82X provided in the left-right swing part 4 being a support part configured to support the front-rear swing part 3 changes due to the load applied by seated person, and returns, by the elastic member 83X, the state of the front-rear swing part 3 from an operation state where the operation of the front-rear swing part 3 is allowed to the original state where the operation of the front-rear swing part 3 is suppressed, when the load applied by seated person is removed.

The chair is configured such that the engaged part 82X is a recess 82*a*X, and when the load applied by seated person is received in the state where the engaging part 81X is fitted into the recess 82*a*X, the fitted state is released, so that the engaging part 81X and the engaged part 82X are disengaged due to the load applied by seated person, and when the load applied by seated person is removed, the engaging part 81X and the engaged part 82X engage with each other by the elastic force to bring the front-rear swing part 3 into an operation-suppression state.

The control mechanism 8X includes an engagement pin 81*a*X being the engaging part 81X; and a groove-shaped recess 82*a*X being an engaged part 82X provided on a sliding surface 40X relatively operating at a position facing the engaging pin 81X. The engagement pin 81*a*X is configured to be elastically biased toward the sliding surface 40X, and to fit in the groove-shaped recess 82*a*X at a predetermined position. Then, when the seat 5 detects received of the load applied by seated person in a central part, the control mechanism 8X illustrated in FIGS. 16 and 17 separates the engagement pin 81*a*X from the groove-shaped recess 82*a*X. A coil spring 83*a*X being an elastic member 83X functions to bias the engagement pin 81*a*X in a direction where the engagement pin 81*a*X protrudes toward the sliding surface 40X. The control mechanism 8X includes a conversion mechanism 84X configured to convert an operation of the weight-receiving part 50 due to a person sitting on the seat, into an operation in a direction where the engagement pin 81*a*X is separated from the sliding surface 40X, and the conversion mechanism 84X, the engagement pin 81*a*X, and the coil spring 83*a*X are integrally incorporated into an other-half part of the casing 80 illustrated in FIG. 16, to form with unitized.

Figure 37:
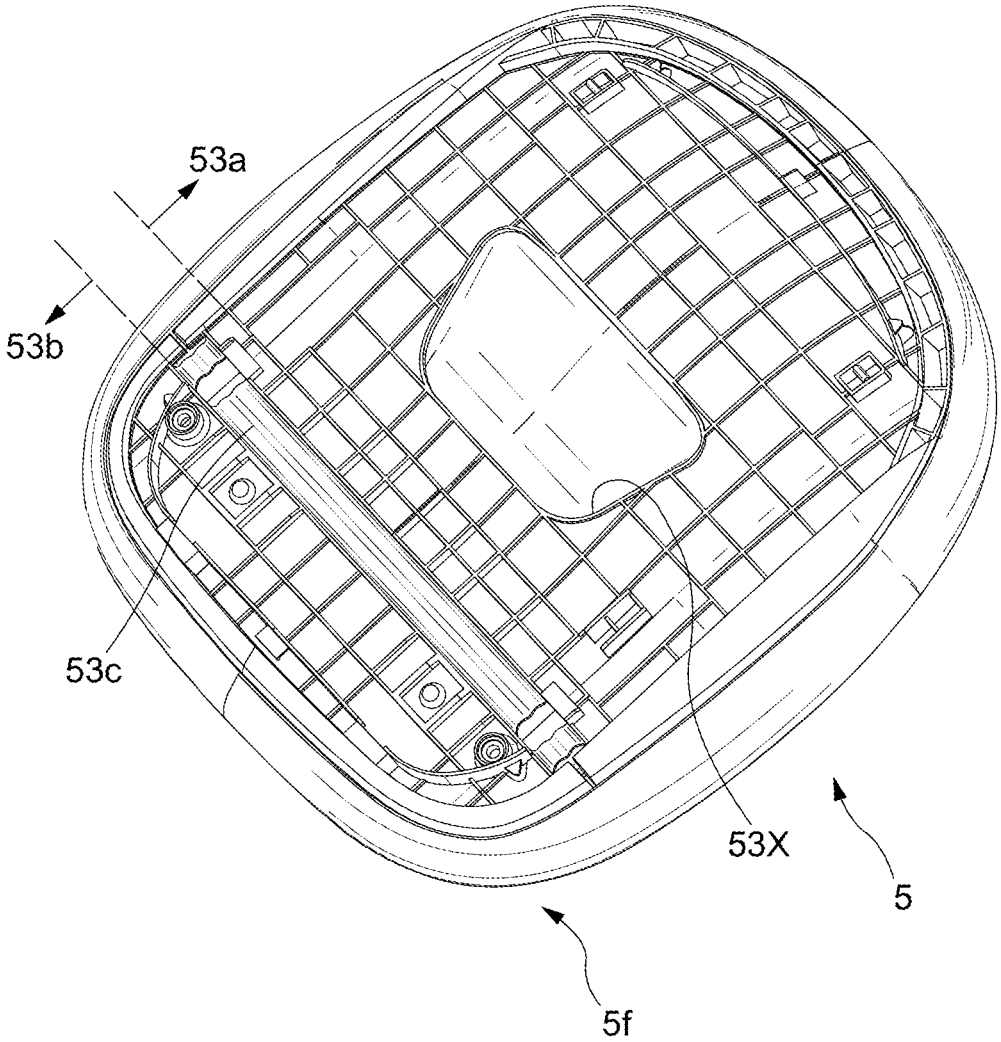
FIG. 37 is a perspective view illustrating a lower surface of the seat.

The engagement pin 81*a*X is disposed to be 1 liftable and lowerable along front, rear, right, and left guides 80*g*2 of the casing 80, in a parallel relationship with the engagement pin 81 in the flat casing 80 configuring the front-rear stopper mechanism 8M. Similarly in parts to the conversion mechanism 84, the conversion mechanism 84X includes the coil spring 83*a*X provided elastically in a compressed state between an upper end of the engagement pin 81*a*X and the cover 80*a* closing the upper opening of the casing 80, a safety operation arm 85X rotatably supported by the horizontal shaft 80*c* disposed between side walls 80*b*, 80*b* of the casing 80 at a position adjacent to the engagement pin 81*a*X, and a torsion coil spring 86X rotatably attached together with the safety operation arm 85X. On the other hand, the weight-receiver 50 is, as illustrated in FIG. 15, a pressure-receiving plate 52*a* rotatably fitted and attached to the seat outer shell 51 included in the seat 5, and a convex part 52*b* provided below the pressure-receiving plate 52*a* is disposed at a position displaced from the center of rotation of the safety operation arm 85X, where the convex part 52*b* can press a pressed part 85*xt* illustrated in FIG. 16. A tip end 86*a*X of the torsion coil spring 86X is at all times smoothly slidably engaged with a downward-facing surface of the engagement pin 81*a*X. The pressure-receiving plate 52*a* is biased in a direction away from the safety operation arm 85X by a coil spring 52*c* being an elastic body illustrated in FIG. 26. As illustrated in FIG. 37, a hole part 53*x* configured to avoid interference with the pressure-receiving plate 52*a* is provided at a corresponding position of a seat inner shell 53.

Figure 26A:
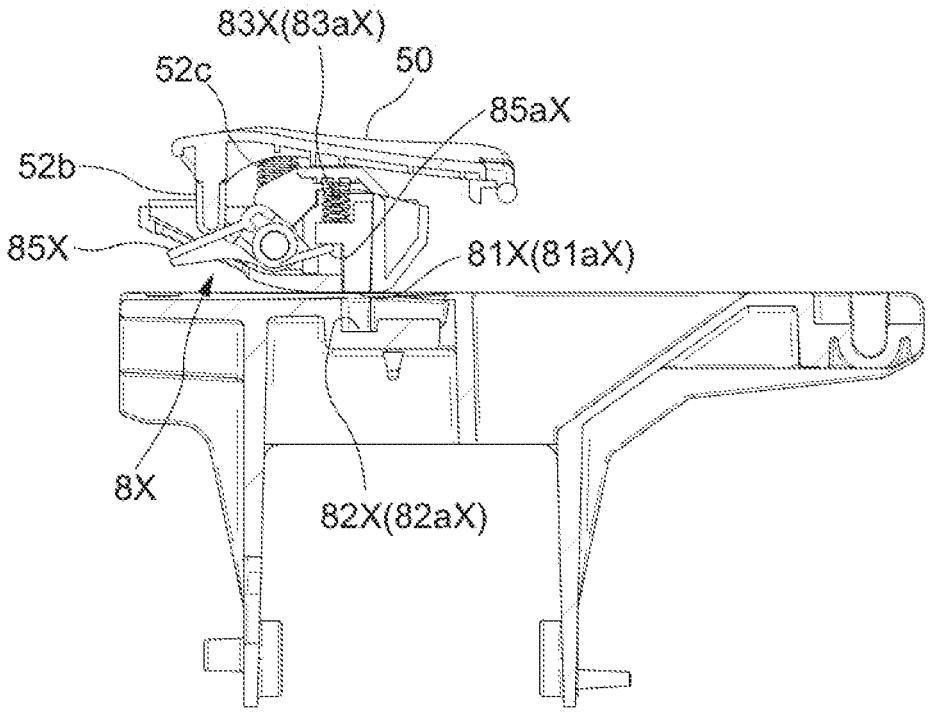
FIGS. 26A and 26B are operation explanatory diagrams of a control mechanism operating in accordance with a seating state.
Figure 26B:
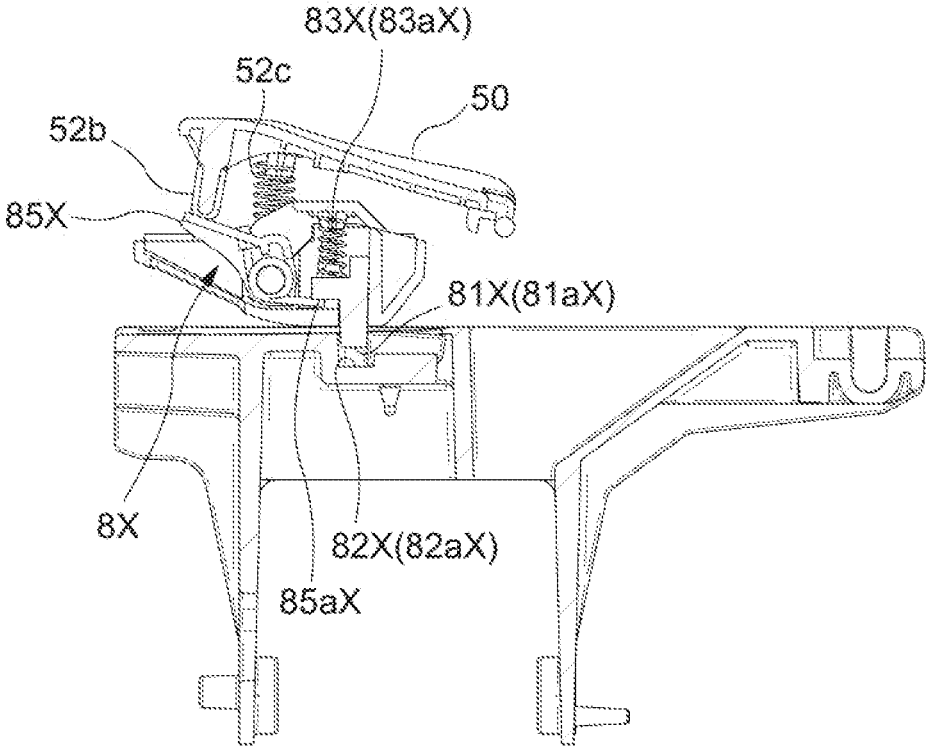

As illustrated in FIG. 26B, when the weight-receiving part 50 does not sense the weight of the seated person, the engagement pin 81X is pressed downward by the coil spring 83*a*X while a tip end 85*a*X of a torsion coil spring 86X rotates together with the safety operation arm 85X, and when the engagement pin 81X engages with a groove 82*a*X of the front-rear swing part 3, the locked state in the front-rear direction is realized. As illustrated in FIG. 26A, when the weight-receiving part 50 detects the weight of the seated person, when the engagement pin 81X is pulled upward at the tip end 86*a*X of the torsion coil spring 86X while compressing the coil spring 83*a*X, the engagement pin SIX is disengaged from the groove-shaped recess 82*a*X and the locked state in the front-rear direction is released.

That is, when a user is seated, the control mechanism 8X is unlocked, and afterwards, whether or not the seated person locks a movement in the front-rear direction depends on the state of a front-rear fixing stopper mechanism 8M, via the operation of the operating member 152, and when the seated person leaves the seat, the state is maintained unless the front-rear fixing stopper mechanism 8M is unlocked, and if the front-rear fixing stopper mechanism 8M is unlocked, the control mechanism 8X actuates to lock the front-rear operation of the seat 5.

In particular, in this chair, the seat 5 tilts at least back and forth, and when the seated person starts standing up, the seat 5 moves while tilting forward together with the front-rear swing part 3, as illustrated in FIG. 13. When the seated person leaves the seat in this state and the load applied by seated person is removed, the engagement pin 81*a*X being the engaging part 81X illustrated in FIG. 21 C settles on the sliding, surface 40X in the front of the recess 82*a*X being the engaged part 82X. Afterwards, the seat 5 starts moving while tilting rearward in accordance with a relationship of the center-of-gravity position between the back and the seat, due to the presence of the back 6. During this movement, it is expected that the engagement pin 81*a*X being the engaging part 81X engages with the recess 82*a*X being the engaged part 82X. As illustrated in FIG. 7, in the recess 82*a*X, grooves are provided in a linked manner in an orthogonal direction, and a buffer material 82*z* such as rubber is embedded. The buffer material 82*z* is for avoiding collision of the engagement pin 81*a*X with the wall of the recess 82*a*X and a shock or an abnormal noise caused, and after colliding with the buffer material 82*z*. The engagement pin 81*a*X collides with the buffer material 82*z* and fits into the recess 82*a*X.

It is noted that, when a person sits on the seat, the engagement pin 81*a*X and the recess 82*a*X are disengaged, however, the engagement pin 81*a*X and the recess 82*a*X engage with a certain degree of resistance, and thus, the locked state is not released immediately after the person sits on the seat, but is released when the resistance decreases due to a small movement of the seat 5.

That is, the control mechanism 8X switches the locked state of the seat 5 between when the seated person leaves the seat and when sitting on the seat, and thus, may be called a "seat-leaving and seat-sitting automatic stopper mechanism".

Next, the guide hole 34 illustrated in FIG. 3 will be described. Even if the rail plate 31 being a plate member PM is thickened or a separate member is attached to the rail plate 31 to provide the guide hole 34 for securing a pressure-receiving area, this may only lead to an increase in the number of parts and the cost and does not necessarily lead to improvement of strength and durability.

Figure 27:
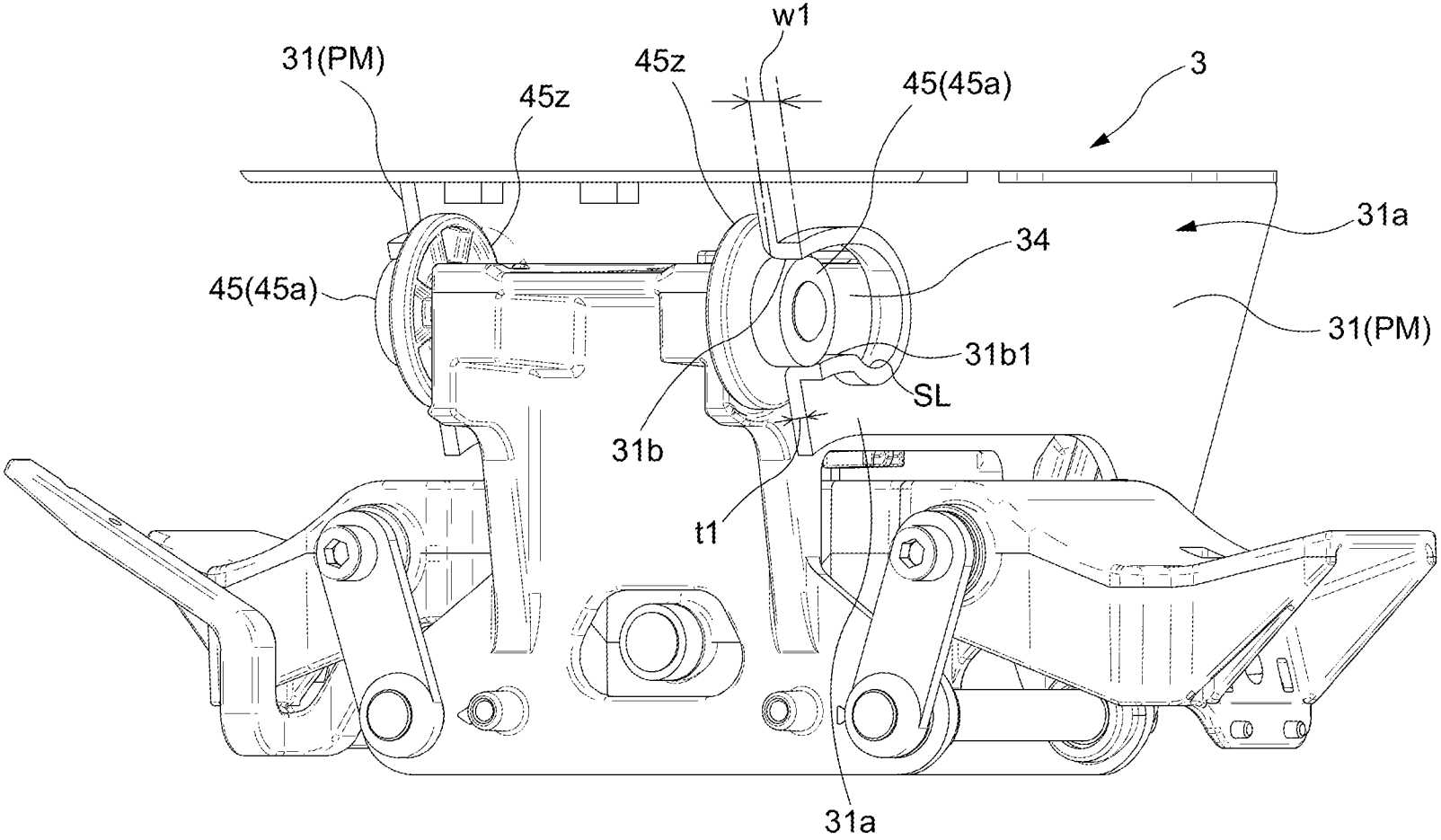
FIG. 27 is a partially broken perspective view illustrating an engaging portion of a bearing and a guide hole in the embodiment.

Therefore, in the present embodiment, as illustrated in FIG. 27, a flange part 31*b* is provided on the plate member PM of the front-rear swing part 3 being the movable portion in which the guide hole 34 is provided, that is, on a vertical surface 31*a* of the rail plate 31, and a guide surface 31*b*1 for moving the bearing 45*a* being the rolling body 45 in the longitudinal direction is provided at a position extending in the lateral direction of the flange part 31*b*, that is, in the horizontal direction in the attached state.

A lateral dimension w1 of the guide surface 31*b*1 is greater than a thickness t1 of the rail plate 31 being the plate member PM. The guide surface 31*b*1 is integrally formed of metal together with the rail plate 31. As illustrated in FIG. 3 and the like, the flange part 31*b* has a shape—that goes around the circumference of the guide hole 34 opened in the vertical surface.

The flange part 31*b* according to this embodiment is configured by plastic deformation processing of the plate member PM around the guide hole 34, and specifically, by adopting burring processing. In general, in the burring processing, a pilot hole is opened in a plate member, the periphery of the pilot hole is fixed with a jig and in this state, the edge of the pilot hole is raised, by pressing with a tool larger than the pilot hole, to form a flange part, and thus, a cylindrical flange is generally formed. So far, burring processing has only been utilized for forming tapped holes and the like and has not been considered for producing a structure for guiding a rolling body.

Figure 28A:
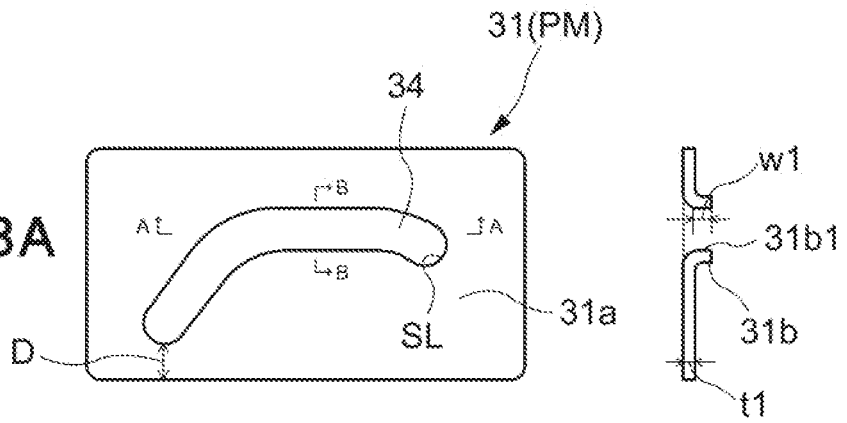
FIGS. 28A to 28C are diagrams for explaining a processing procedure of the guide hole.
Figure 28B:
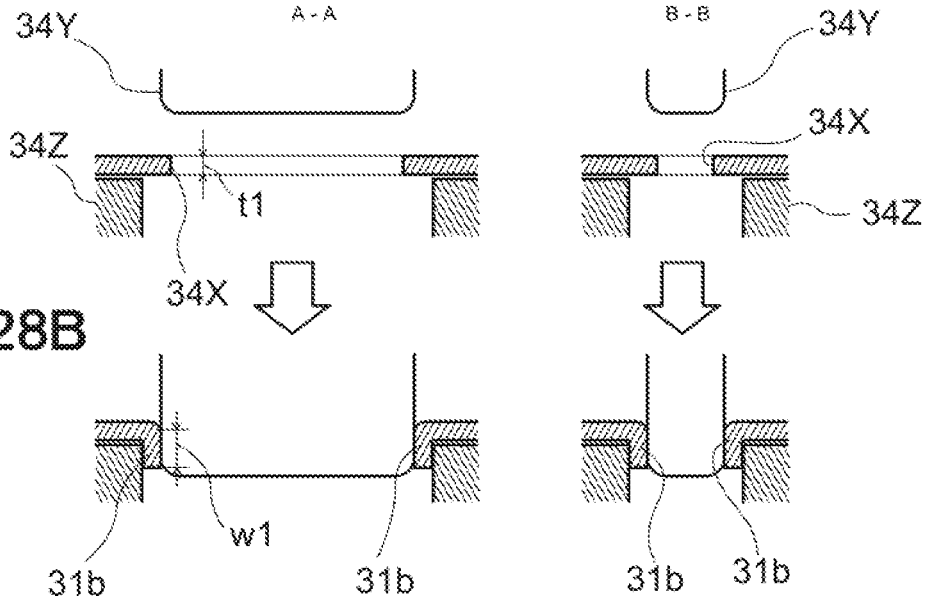
Figure 28C:
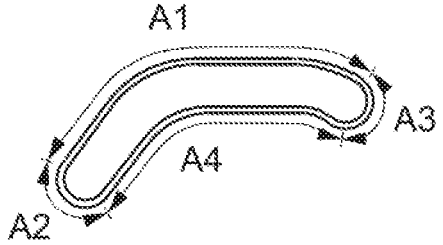

Therefore, in the present embodiment, based on this new perspective, as illustrated in FIG. 28 A, to form an asymmetrical hole, or more specifically, the guide hole 34 extending with a substantially constant width, a pilot hole 34*x* corresponding to the shape of the guide hole 34 is opened with a slightly smaller size than the guide hole 34, as illustrated in FIG. 28 B. Then, the periphery of the pilot hole 34*x* is fixed with a jig 34Z along the shape of the guide hole 34, and in this state, pressing is performed with a tool 34Y that is larger than the pilot hole 34*x* and corresponds to the inner circumferential shape of the guide hole 34. Thus, as illustrated in FIG. 27, the flange part 31*b* extending in the lateral direction via a portion R from the vertical surface 31*a* is formed over the entire circumference of the guide hole 34, and the flange part 31*b* directed in this lateral direction is substantially the pressure-receiving area. The lateral dimension of the guide surface 31*b*1 is substantially uniform over the entire circumference.

The manufacturing means for the guide hole 34 is selected based on the conditions that the guide surface 31*b*1 is smooth, the guide surface 31*b*1 has strength, and the manufacturing cost is low. Fine blanking processing and other processing were also tried, however, it turned out that, even though the fine blanking processing relatively likely to be selected was excellent in forming a smooth guide surface, the plate member needed to have a considerable thickness to obtain strength. Thus, the fine blanking processing could not be adopted due to its inappropriate cost and other processing also did not satisfy the conditions above. Overall, it turned out that burring processing met these conditions very suitably.

However, when a shortest distance D from the guide hole 34 to the nearest edge of the plate member PM is narrow in the burring processing, the plate member PM is deformed during the processing or due to the load applied during the processing. As a result of attempting various tests in this embodiment, it was found that it was necessary and sufficient, as a condition for obtaining a stable shape, to set the shortest distance D (see FIG. 28) from the guide hole 34 to the edge of the plate member PM at an appropriate position to at least 15 mm or more for 2 to 6 mm of a thin plate.

As illustrated in FIG. 27, when viewing the entire chair, the flange part 31*b* formed in this way extends outward from the pair of rail plates 31, 31, rather than inward in the left-right direction, and the guide surface 31*b*1 being a rolling surface is formed outside the rail plates 31. Further, to mitigate a shock caused from a collision with the bearing 45*a* being the rolling body 45, one end (the front end or the rear end) of the guide hole 34 is formed with a so-called shockless part in which the radius of curvature is changed, so that as the bearing 45*a* approaches the end due to an operation of the seat 5, the operation speed of the seat 5 is reduced by performing control so that the center of gravity of the seat 5 is lifted. The flange part 31*b*1 made by burring is designed to withstand the shock caused during this time.

Further, when a left-right support state of the front-rear swing part 3 for the left-right swing part 4 becomes unbalanced, a lower region of the guide hole 34 causes the bearing 45*a* being the rolling body 45 to abut against the lower region of the guide hole 34 to support the bearing 45*a* and the flange part 31*b* contributes to supporting the load during this time.

Generally speaking, as illustrated in FIG. 28 C, the flange part 31*b* includes an upper-side first flange area A1 supporting the back and forth movement of the bearing 45*a* being the rolling body 45 when the seat 5 operates back and forth, a front-side second flange area A2 supporting a portion where the bearing 45*a* being the rolling body 45 reaches the front end of the guide hole 34 when the seated person leans against the back 6, and a rear-side third flange area A3 supporting a portion where the bearing 45*a* being the rolling body 45 reaches the rear end of the guide hole 34 when the seated person leans forward. Further, the flange part 31*b* includes a lower-side fourth flange area A4 supporting the bearing 45*a* being the rolling body 45 when the left-right support state is unbalanced. This structure remains similar, even if the guide hole 34 is formed at the side of the support portion and the bearing 45*a* being the rolling body 45 is disposed at the side of the movable portion.

As described above, the guide hole 34 is formed in the vertical surface of the movable portion or the support portion of the chair and moves while receiving the load applied by seated person. The movable portion is supported at two locations on the front and rear side by the support portion including a guide structure configured by the rolling body 45 and the guide hole 34. In the present embodiment, the other movable portion of the chair is supported by the link arm LA, any one of the front and rear support structures is configured by the above-described rolling body 45 and the guide surface 31*b*1, and the other is configured by a different support structure, that is, in this embodiment, of the link structure.

Next, the support mechanism of the back 6 will be described. As illustrated in FIGS. 2, 14, 30, and 29, in this chair, the back 6 is arranged behind the seat 5 and the backrest 62 is configured to be supported by the back frame 61 via the operating mechanism 6M. A back inner cover 63 is attached to the back frame 61, an opening 63*a* is provided in the back inner cover 63, and the backrest 62 is operatively supported by the back frame 61 via the opening 63*a*.

The backrest 62 includes a cushion arranged on the front surface of a back plate 62*a* and the backrest 62 is entirely covered by an upholstery fabric. A lower end of the backrest 62 is disposed at a predetermined distance above the seat surface and the backrest 62 is supported on a back surface side by a back support part 61*a* at an upper end of the back frame 61 via the operating mechanism 6M.

Figure 29:
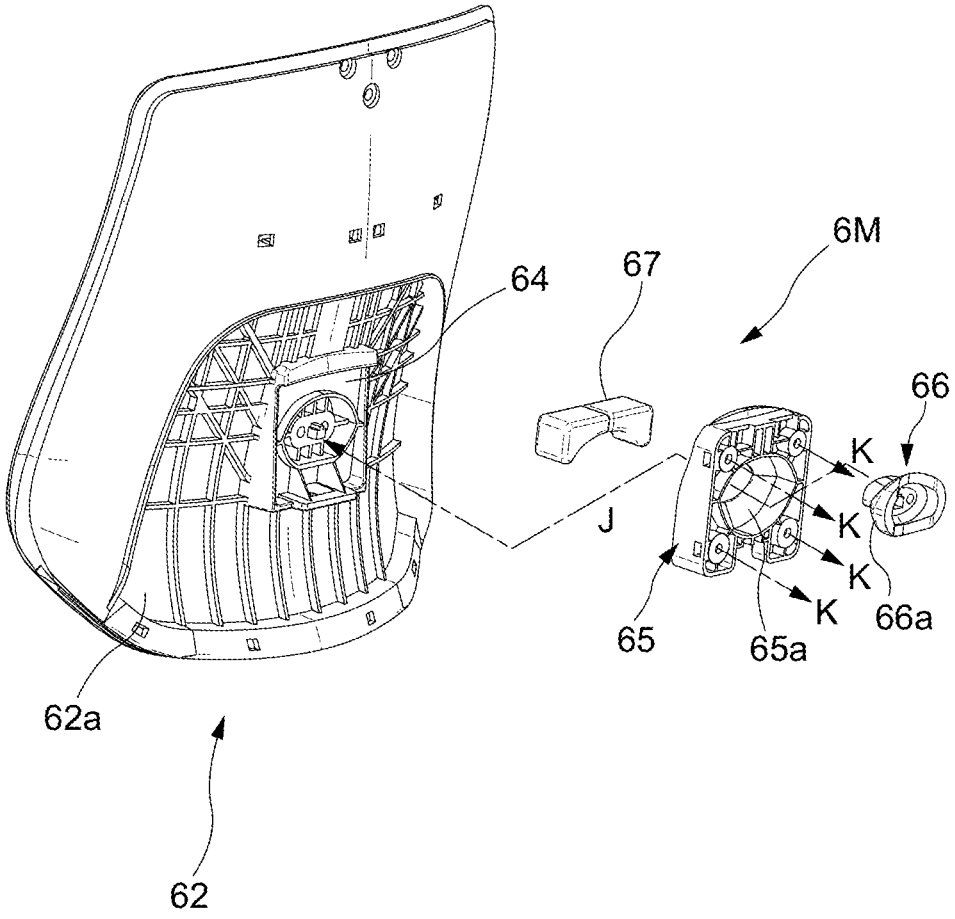
FIG. 29 is an exploded perspective view illustrating an operating mechanism of the back.
Figure 30:
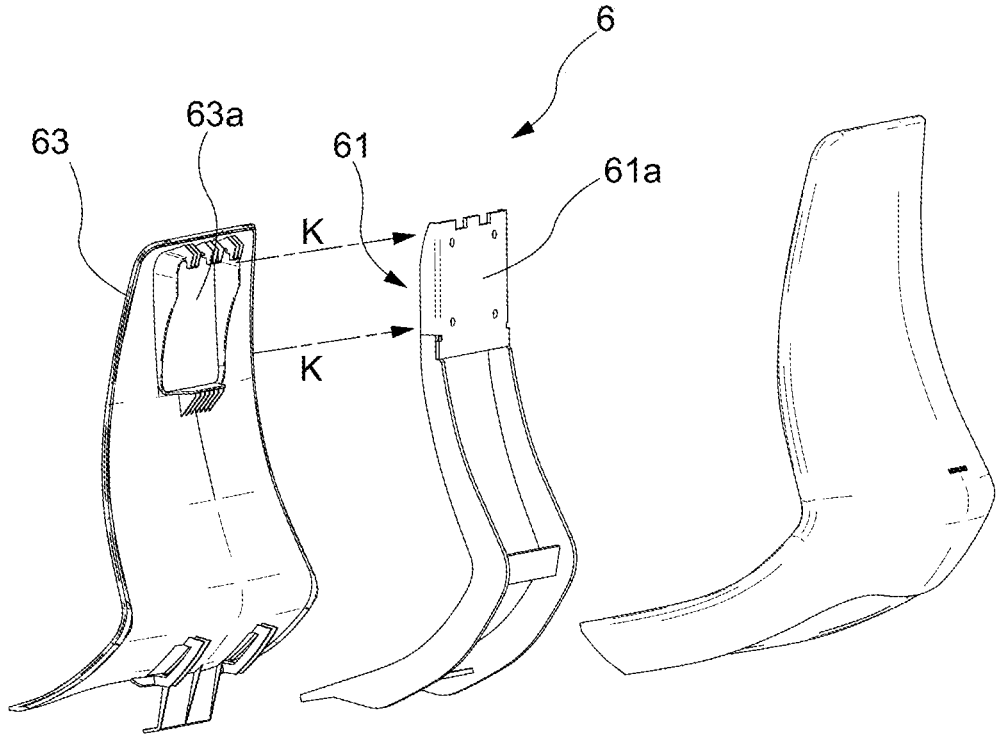
FIG. 30 is an exploded perspective view illustrating a configuration of the back.
Figure 31:
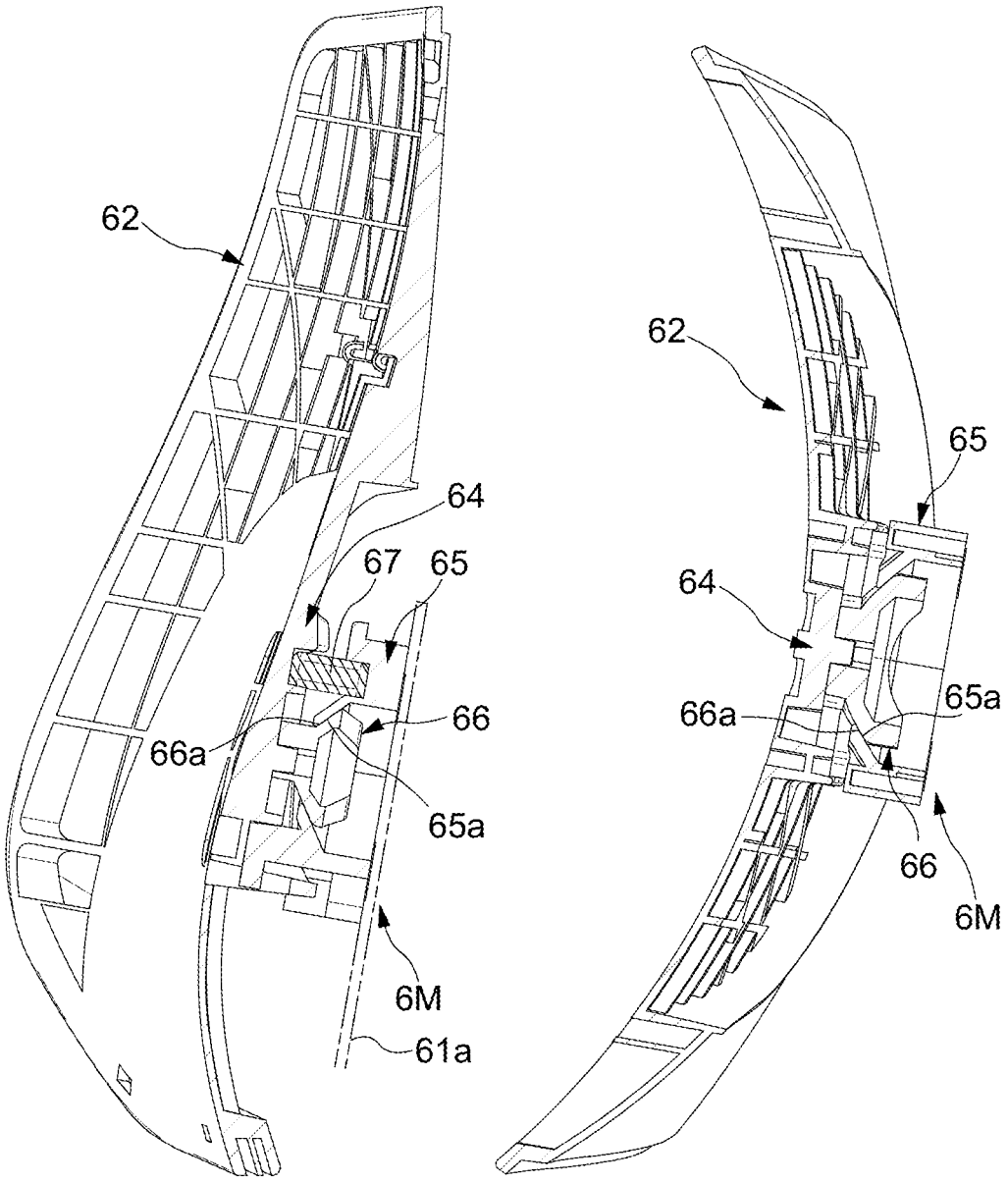
FIG. 31 is a cross-sectional view of the back including the operating mechanism.

The operating mechanism 6M includes: a base part 64 fixed to or formed integrally with the back plate 62*a* included in the backrest 62 and including an elastic body 67 arranged on a back surface side of the base part 64; a tilting part 65 disposed at a position adjacent to the base part 64 and including a guide part 65*a* recessed in a tapered shape at the back surface side, the center of the guide part 65*a* being open in the front-rear direction; and a pressing tool 66 including a convex guide part 66*a* corresponding to the guide part 65*a* on the front surface side, the pressing tool 66 being fixed to the base part 64 via the opening of the tilting part 65 in a state where the guide part 66*a* is fitted into the guide part 65*a*, as illustrated by an arrow J in FIG. 29. As illustrated by arrows K in FIGS. 29 and 30, a configuration of the operating mechanism 6M is such that the tilting part 65 is pulled and passed through the opening of the back inner cover 63 to be fixed by a screw to the back support part 61*a* at the upper end side of the back frame 61. That is, as illustrated in FIG. 31, the pressing tool 66 is fixed to the base part with the tilting part 65 interposed therebetween, and thus, the pressing tool 66 is integrally formed with the base part 64 to form a part of the base part 64. The tilting part 65 can move freely in the gap between the base part 64 and the pressing tool 66, however, a configuration is such to allow for free movement of the tilting part 65, it is necessary to compress an elastic body 67 interposed between the tilting part 65 and the base part 64 against the elastic force. The elastic body 67 exerts a force on the guide part 65*a* of the tilting part 65 in a direction where the guide part 65*a* is constantly fitted in the guide part 66*a* of the pressing tool 66.

Figure 32:
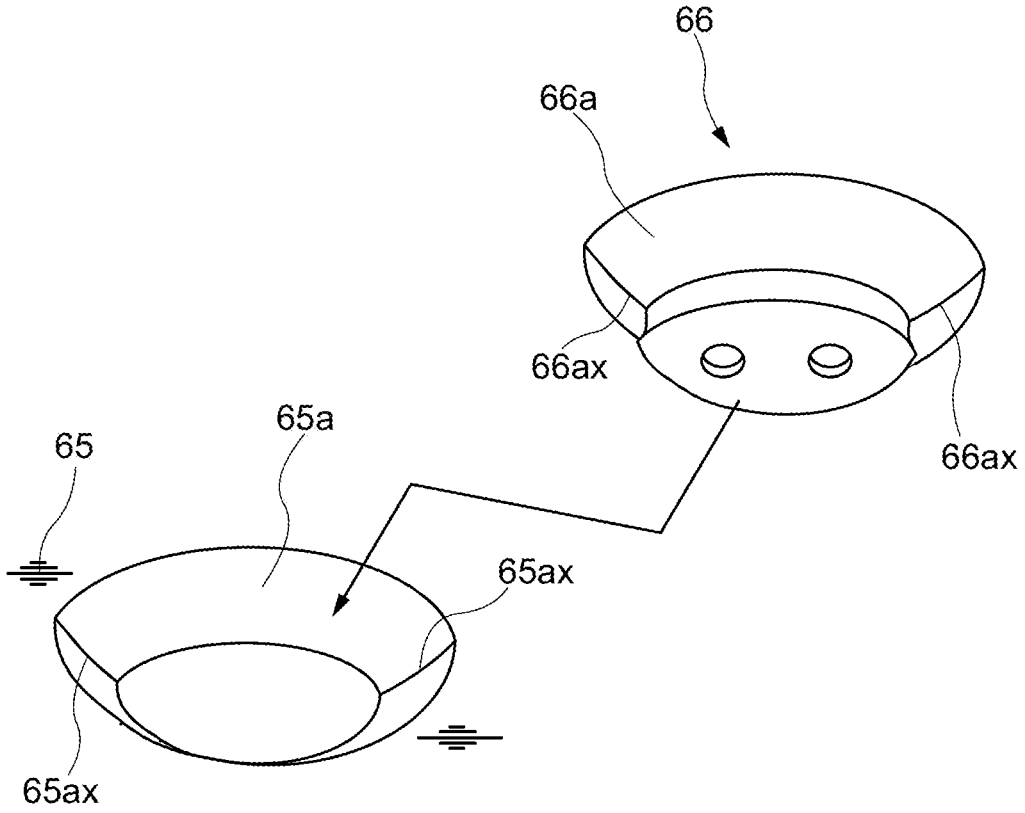
FIG. 32 is an explanatory diagram of a guide part included in the operating mechanism.

More specifically, as illustrated in FIG. 32, the recess guide part 65*a* of the tilting part 65 has a substantially partially elliptical mortar-like shape including at least one valley line 65*ax* (two in this embodiment), the convex guide part 66*a* of the pressing tool 66 has a curved shape having at least one ridge line 66*ax* (two in this embodiment) fitted smoothly into the valley line 65*ax*, and the valley line 65*ax* and the ridge line 66*ax* can be fitted into each other. The convex guide part 66*a* is similar to a shape obtained by eliminating a part of an elliptical sphere, and the ridge line 66*ax* is formed along a line by a guide surface 66*a* intersected on the long axis side of the elliptical sphere. In a corresponding position of the matching recess guide part 65*a*, the valley line 65*ax* is also formed along a line by the intersected guide surface 65*a*. The reason therefore is that a spherical body and a spherical surface-receiving seat do not have directionality and cannot perform a positioning function. In that sense, the convex guide part 66*a* and the recess guide part 65*a* are not limited to the mortar-like shape and the shape of the elliptical sphere, as long as they have different shapes that uniquely determine the directionality during fitting. However, in view of the smoothness of the guides, the guide parts 66*a*, 65*a* need to be configured of a smooth continuous surface. The ridge line 66*ax* and the valley line 65*ax* are provided to enhance the positioning function during fitting.

In this embodiment, urethane is used for the elastic body 67, and as illustrated in FIG. 29, the elastic body 67 is arranged from the left and right corner parts to the upper edge portion of the upper half of the rectangular plate-shaped base part 64. As illustrated in FIG. 31, the thickness dimension of the elastic body 67 is set to achieve an appropriately compressed state in a state where the pressing tool 66 is attached to the base part 64, the tilting part 65 is attached to the back support part 61*a* of the back frame 61, and the guide part 66*a* of the pressing tool 66 and the guide part 65*a* of the tilting part 65 are fitted into each other. In view of the fact that the load is applied to a part above the center of the operating mechanism 6M when the seated person leans against the backrest 62, the elastic body 67 is not provided in the lower half of the base part 64 where there is little occasion to perform a function substantially, however, provision of the elastic body 67 in this position shall not be precluded.

Figure 33:
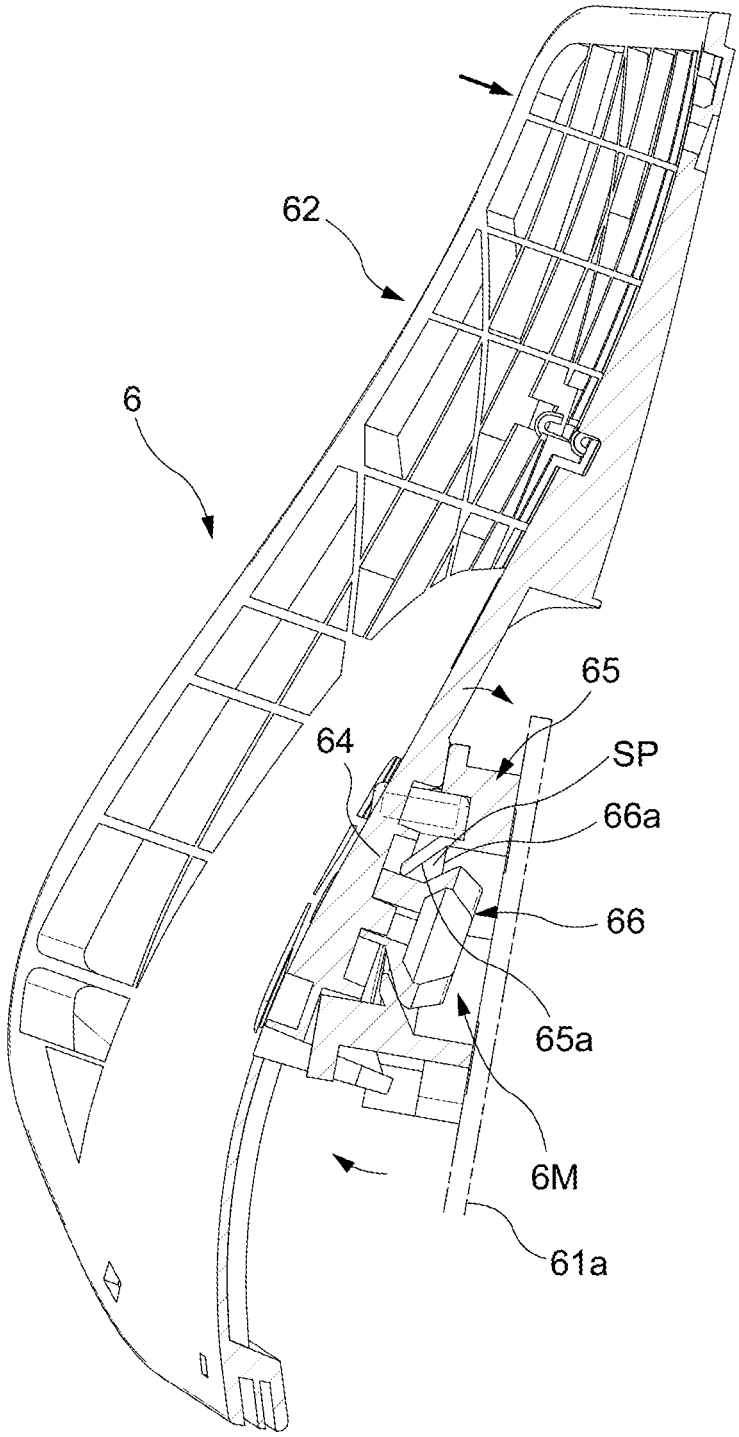
FIG. 33 is an operation explanatory diagram corresponding to FIG. 31.
Figure 34:
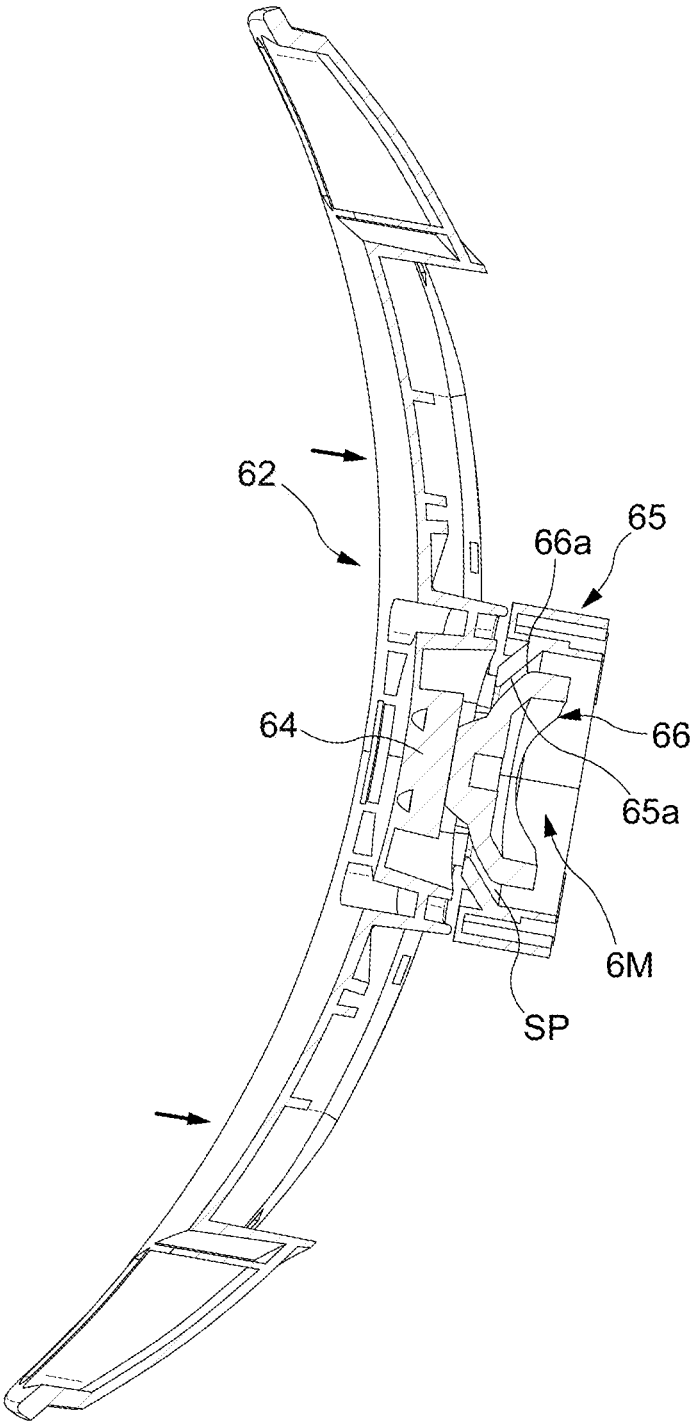
FIG. 34 is an operation explanatory diagram corresponding to FIG. 31.
Figure 35:
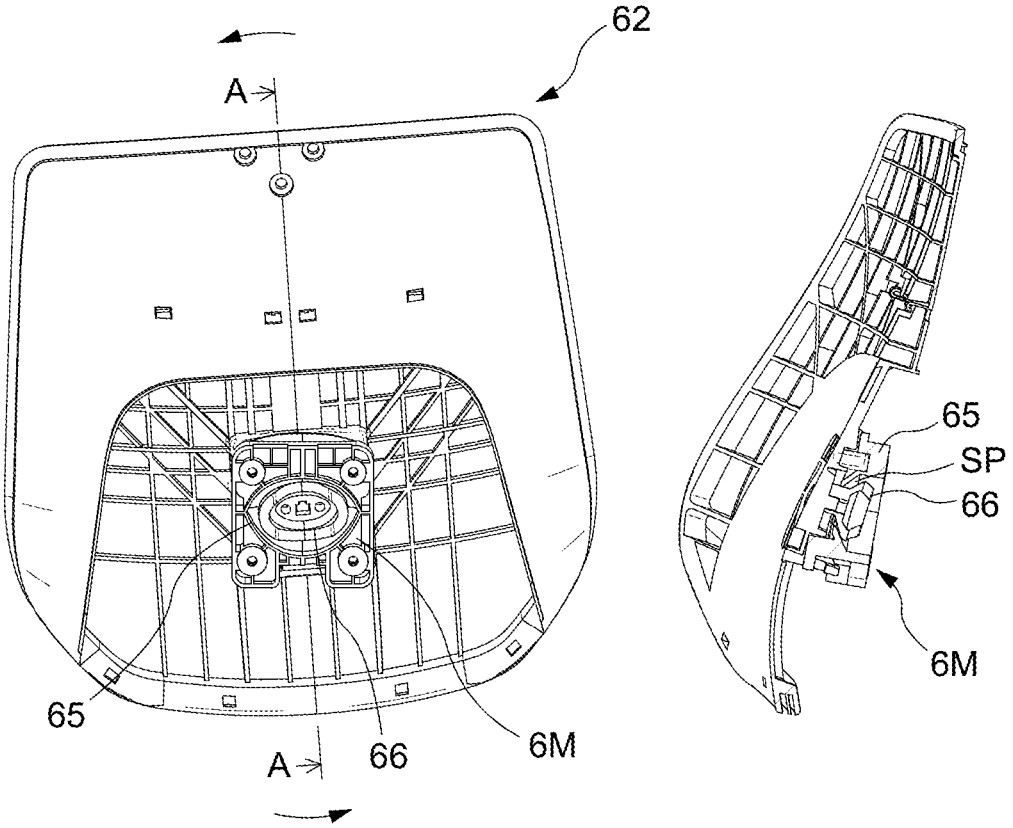
FIG. 35 is an operation explanatory diagram according to a turning operation off backrest.

FIG. 33 illustrates a rearward tilted state when a load is applied to the upper part of the back 6, and FIG. 34 is a plane cross section thereof. Further, FIG. 35 illustrates a turning operation of the back 6 in a case where the seated person twists its body and the like.

That is, the backrest 62 is disposed in a positional relationship where the backrest 62 moves against the elastic reaction force in the rearward direction and the turning direction while being supported by the elastic body 67, and a configuration is such that, when the elastic body 67 is deformed to the front, rear, right, or left in accordance with the amount of turning movement in the front, rear, right, or left directions, the reaction force returning the backrest 62 to a neutral position increases. The turning direction includes a turning movement in the left-right direction in front view, as illustrated in FIG. 35, and further, in a clockwise or counterclockwise direction in front view.

The guide part 65*a* of the tilting part 65 and the guide part 66*a* of the pressing tool 66 included in the base part 64 are guided to and stopped in a reference position illustrated in FIG. 31 because of the shape of the guide parts 66*a*, 65*a* by pressure contact with the elastic body 67. Subsequently, when the pressure contact is loosened due to an elastic body 67 being compressed by a load being applied due to receiving pressure from the seated person, the guide part 65*a* of the tilting part 65 and the guide part 66*a* of the pressing tool 66 included in the base part 64 are at least partly separated, as illustrated in FIGS. 33, 34, and 35, so that the backrest 62 moves freely. The base part 64 and the tilting part 65 relatively move relative to the reference position in accordance with an amount of the received pressure and when the load is removed, the operating position is automatically returned, along the guide parts 66*a*, 65*a*, to the neutral position of FIG. 31 where the ridge line 66*ax* and the valley line 65*ax* coincide with each other. At this time, the backrest 62 is configured so that a gap SP between the guide parts 66*a*, 65*a* widens in accordance with a movement in the rear direction with respect to the back frame 61, and as a result, a turning range in the left-right direction expands and a return reaction force generated when the load is removed increases in accordance with the amount of turning movement in both the left and right directions.

Figure 36:
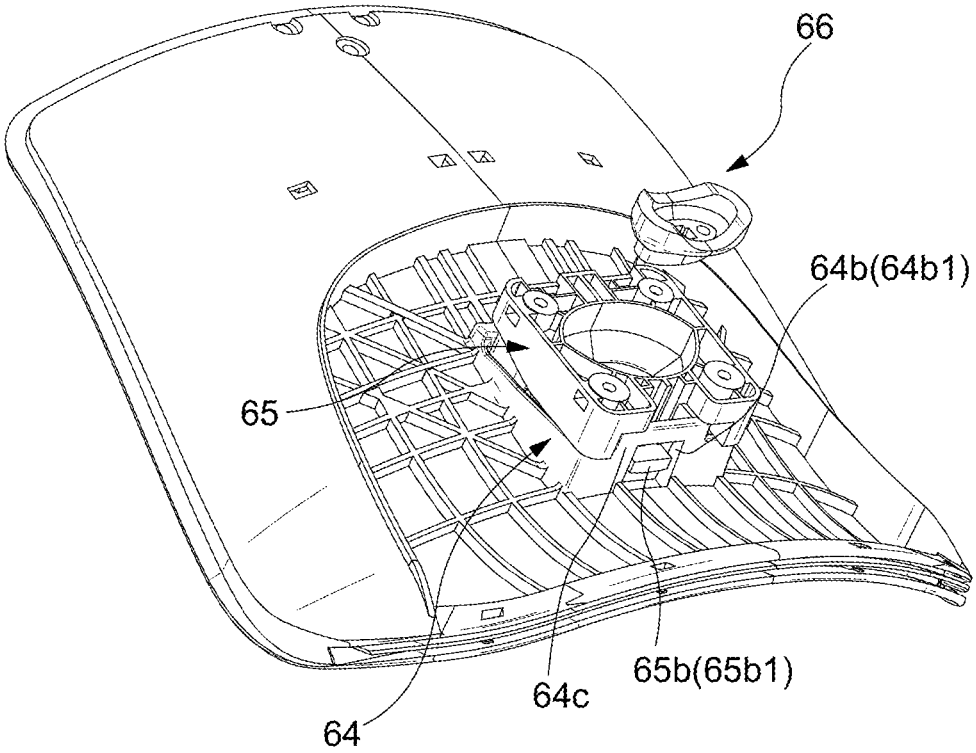
FIG. 36 is an exploded perspective view illustrating a restricting portion configured to restrict the operation of the back.

It is noted that, as illustrated in FIG. 36, the base part 64 and the tilting part 65 are provided with engaging parts 64*b*, 65*b* configured to restrict a relative movement of the base part 64 and the tilting part 65 in collaboration with the guide parts 65*a*, 66*a*. The base part 64 includes an upright wall 64*c* at a peripheral edge, and a window 64*b*1 to be the engaging part 64*b* opens in a rectangular shape in the upright wall 64*c*. On the other hand, in the tilting part 65, an L-shaped claw 65*b*1 to be the engaging part 65*b* is formed at a position displaced downward on the front side. Then, the base part 64 and the tilting part 65 are assembled with the claw 65*b*1 loosely fitted in the window 64*b*1, and a movable range of the tilting part 65 with respect to the base part 64 is restricted to a range where the claw 65*b*1 can move in the window 64*b*1. When the movable range is restricted, a part of the backrest load is also supported in this restriction portion.

As described above, the left-right turning operation of the back 6 occurs with respect to the back frame 61 and the seat 5 is attached to the front-rear swing part 3 to which the back frame 61 is attached, and thus, the back frame 61 and the seat 5 integrally swing in the left-right direction in front view, however, the backrest 62 further performs a different movement separately from the left-right turning operation of the seat 5 and the back frame 61.

It is noted that, in this embodiment, the base part 64 is attached to the backrest 62 and the tilting part 65 is attached to the side of the back frame 61, however, a configuration may be so that the base part 64 is attached to the side of the back frame 61 and the tilting part 65 is attached to the side of the backrest 62.

Next, a front support mechanism of the seat will be described.

As described above, in this chair, the seat 5 is configured to be supported to be swingable to the front, rear, right, or left with respect to the support base part 2, however, a feeling of pressure on a femoral region of the left and right legs of the seated person sitting on the chair configured to swing to front, rear, right, or left, may change to be unbalanced depending on the posture of the seated person. Further, in this chair, the back 6 is provided to tilt rearward behind the seat 5 and when the back 6 tilts rearward, the seat 5 moves together with the back 6 and performs an operation in which the front part of the seat 5 rises relative to the back part of the seat 5 which descends, and as a result, the seated person may experience a feeling of pressure on the femoral region of the legs when leaning rearward and anxiety or instability due to the legs of the seated person being lifted in the air.

Figure 38:
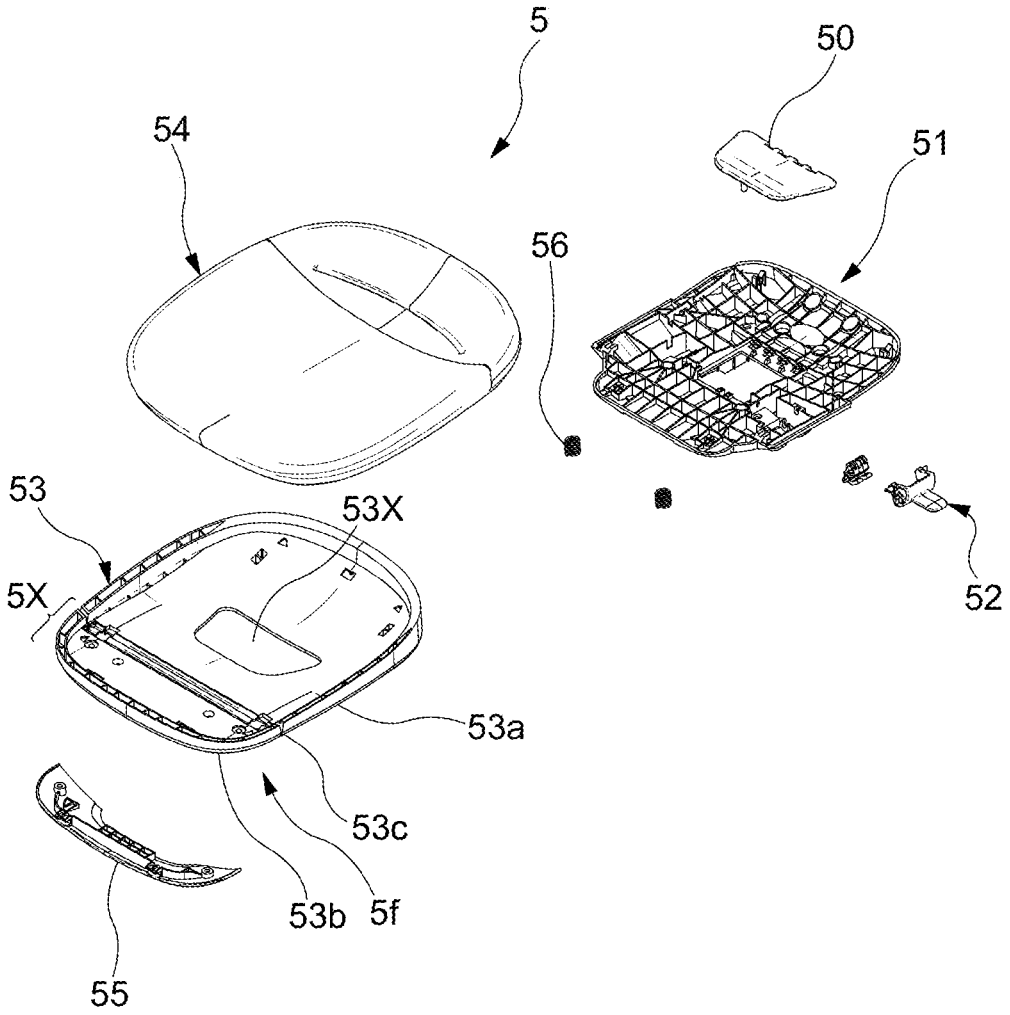
FIG. 38 is an exploded perspective view of the seat.
Figure 39:
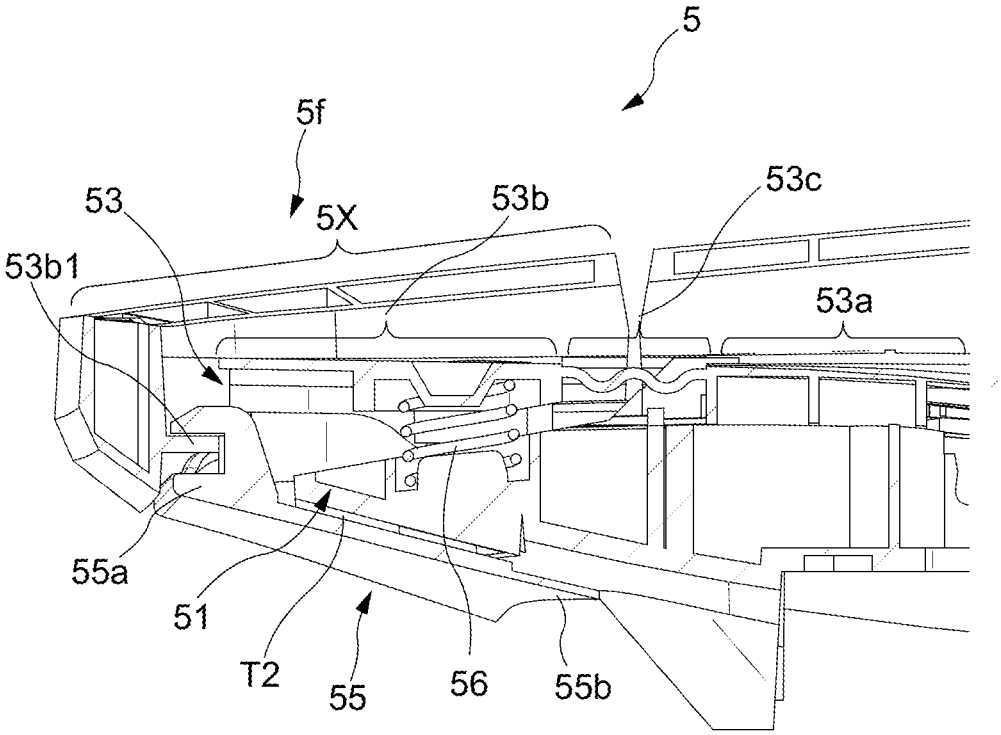
FIG. 39 is an enlarged cross-sectional view of a front part of the seat.

Thus, as illustrated in FIGS. 38, 37, and 39, this chair is provided with a deformation part 5X configured to change its shape in the up-down direction when receiving the load applied by seated person on a front part 5*f* of the seat 5.

The deformation part 5X is provided at a position receiving the weight of the legs of the seated person, and is configured to deform downward when receiving the weight of the legs and to return upward when the weight of the legs is removed.

Specifically, as illustrated in FIG. 38, in the seat 5, a cushion material 54 covered by a non-illustrated upholstery fabric is arranged on the seat inner shell 53, and the seat outer shell 51 is attached below the seat inner shell 53. The seat inner shell 53 is configured by connecting a rear part 53*a* and a front part 53*b* with a resin hinge part 53*c*, and the front part 53*b* is elastically deformed with respect to the rear part 53*a* with the resin hinge part 53*c* as a boundary. Together with this deformation, the cushion material 54 is also deformed, and thus, these portions configure the deformation part 5*x*.

Then, the seat outer shell 51 is fixed to the front-rear swing part 3, and the rear part 53*a* of the seat inner shell 53 is attached above the seat outer shell 51. Thus, the deformation part 5*x* including the front part 53*b* of the seat inner shell 53 is deformed toward the seat outer shell 51.

Figure 40:
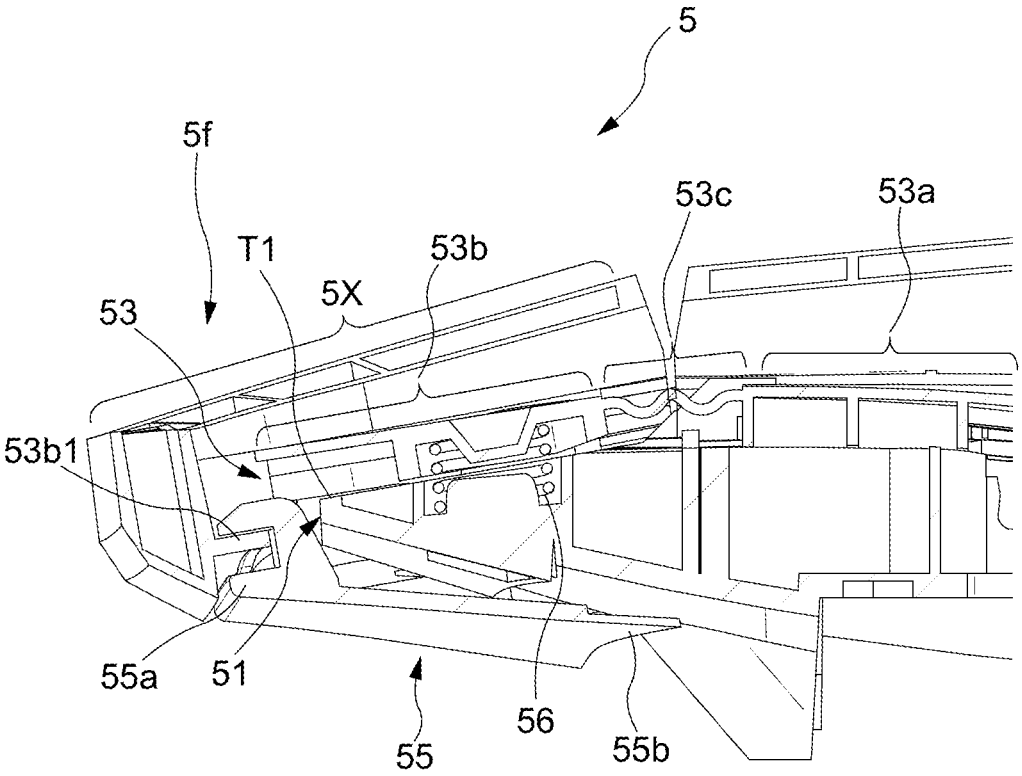
FIG. 40 is a diagram illustrating an operation of a deformation part.

In this embodiment, a front seat lower cover 55 is attached to the front part 53*b* forming the deformation part 5X of the seat inner shell 53, with the seat outer shell 51 interposed therebetween. Although FIG. 15 gives the impression that the front seat lower cover 55 is attached to the front part of the seat outer shell 51, the front seat lower cover 55 is actually arranged below the front part of the seat outer shell 51 in a non-connected state and is coupled to the deformation part 5X of the seat inner shell 53 above, as illustrated in FIGS. 39 and 40. As illustrated in FIG. 15, the left-right dimensions of the front seat lower cover 55 correspond substantially to the left-right dimensions of the front part 53*b* of the seat inner shell 53, and thus, a base end 55*a* of the front seat lower cover 55 is attached to an engaged part 53*b*1 (refer to FIGS. 39 and 40) set in the front part 53*b* of the seat inner shell 53, with the seat outer shell 51 interposed therebetween and a rear end 55*b* of the front seat lower cover 55 is shaped to extend rearward and downward along the seat outer shell 51.

At two locations on the left and right of the front part of the seat outer shell 51, compression springs 56 being elastic bodies are arranged at positions compressed between the front part 53*b* of the seat inner shell 53 and the front part of the seat outer shell 51.

When the deformation part 5X at the side of the seat inner shell 53 approaches the seat outer shell 51, as illustrated in FIGS. 39 and 40, that is, when the deformation part 5*x* of the seat inner shell 53 is deformed downward while compressing the compression spring 56, an appropriate portion of the front part 53*b* of the seat inner shell 53 abuts against an upper front surface of the seat outer shell 51 (abutment point T1). Conversely, when the front part 53*b* of the seat inner shell 53 moves upward in a direction where the deformation of the deformation part 5*x* is eliminated by the compression springs 56, as illustrated in FIGS. 40 and 39, the front seat lower cover 55 abuts against a lower front surface of the seat outer shell 51 (abutment point T2). That is, a deformable range of the deformation part 5*x* of a seat inner shell 53 is restricted both downward and upward.

Here, as illustrated in FIGS. 37 and 39, a resin hinge part 53*c* is shaped as a corrugated plate having a series of uneven portions, and the deformation part 5X has a structure that easily causes, in accordance with an unbalanced load received in a left-side region and a right-side region of the seat 5, regardless of the up-down direction, torsional deformation so that one side of the seat 5 in the left-right direction is lifted higher than the other side.

Figure 2:
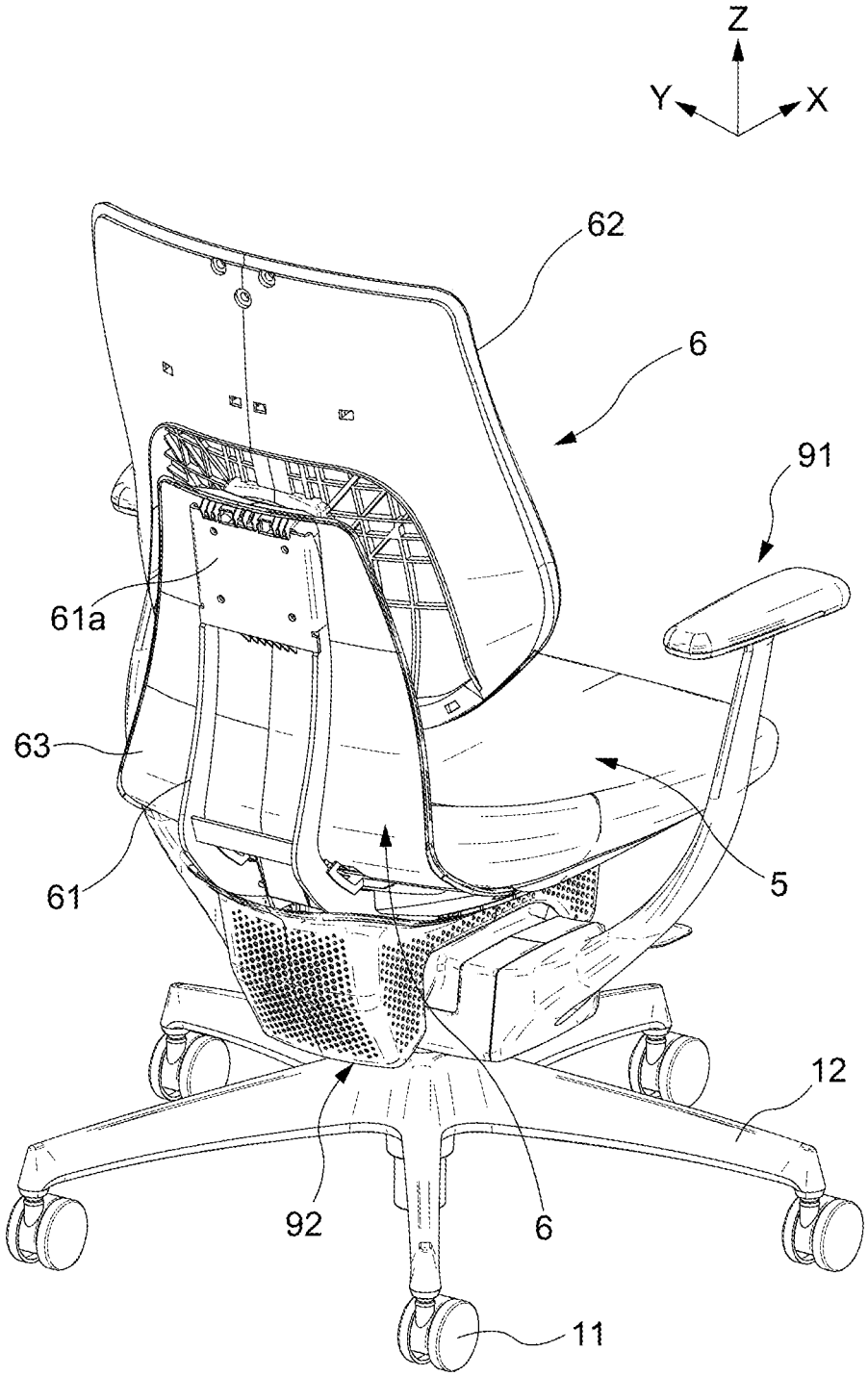
FIG. 2 is a perspective view thereof, as viewed obliquely from behind, in which a part of the chair is removed.

It is noted that, in the chair according to the present embodiment, as illustrated in FIGS. 1 and 2, a fixed attachment part 91 extending upward is attached to an arm attachment part 23 of the support base part 2 to bypass the seat 5 and even if the seat 5 swings to the front, rear, right, or left, the fixed attachment part 91 remains in a fixed position that does not interfere with the seat 5. Further, a movable cover mechanism 92 in which a plurality of covers are combined, is disposed below the seat 5 to not interfere with the relative operation of the front-rear swing part 3 and the left-right swing part 4 and to hide the front-rear swing part 3 and the left-right swing part 4.

As described above, in the chair according to the present embodiment, a weight-receiving part 50, the height position of which changes due to a person sitting on a seat surface, is provided on a seat 5, the change of the height position is mechanically transmitted to a control mechanism 8X configured to control an operation of a front-rear swing part 3 being a movable part, and the control mechanism 8X changes the operation of the front-rear swing part 3 being a movable part between allowed and suppressed states. With such a configuration, a seating state is detected based on the change of the height position of the weight-receiving part 50, and the control mechanism 8X controls the operation of the front-rear swing part 3 being the movable part through the mechanical transmission. Thus, when suppression of swinging of the seat 5 before sitting is desired, the suppression can be achieved by the chair without performing a separate operation. Further, since the height change of the weight-receiving part 50 provided in the seat 5 rather than the height change of the seat 5 itself is utilized, no movement of the seat 5 itself is necessary for allowing and suppressing the operation of the front-rear swing part 3 being the moving element, and thus, ease of use without discomfort is achieved and the control mechanism 8X can be configured independently of the support force of the seat 5.

Further, the control mechanism 8X changes the allowed/suppressed states of the operation of the front-rear swing part 3 being the movable part, when the engagement state between the engaging part 81X provided in the front-rear swing part 3 being the movable part and the engaged part 82X provided in the left-right swing part 4 being the support part changes, due to the load applied by seated person. Moreover, the changed operation state is returned to the original state by the elastic member 83X when the load applied by seated person is removed, and the operation state is switched utilizing the load applied by seated person and the elastic member 83X, and thus, there is no need for a manual operation.

Further, the engaging part 81X and the engaged part 82X are disengaged due to the load applied by seated person, and are engaged by the elastic force when the load applied by seated person is removed, to bring the front-rear swing part 3 being the movable part into an operation-suppression state, and the operation-suppression state is only released when the person sits on the seat, and thus, a failure in seating can be prevented and a sense of security during sitting can be realized. Further, there is no need to manually release the operation-suppression state, and thus, effortless ease of use can be realized.

Further, the chair is configured such that the engaged part 82X is the recess 82*a*X, and when the load applied by seated person is received in the state where the engaging part 81X is fitted into the recess 82*a*X, the fitted state is released, and thus, reliable suppression can be realized by the fitting structure between the engaging part 81X and the recess 82*a*X.

Further, in the present embodiment, an operation direction of the front-rear swing part 3 being the movable part includes a plurality of directions including one direction and the left-right direction being another direction crossing the one direction in plan view, and the allowed/suppressed states of the operation in the front-rear direction being at least one of the plurality of directions is changed. However, the present invention can also be applied to the left-right direction and a configuration may be so that the front-rear and left-right directions are interchanged, and thus, a direction in which to stop the seat and a direction in which to move the seat can be selected according to a preference of the seated person and the seating state, from among the plurality of operation directions.

In particular, in the description above, the movable part is the seat 5 in a wider sense, and the weight-receiving part 50 provided in the seat 5 detects the seating state to switch between allowing and suppressing the movement of the seat 5, and thus, a timing for controlling the seat 5 can be easily taken.

Further, in the chair according to the present embodiment, the seat 5 tilts at least back and forth, and when the load applied by seated person is removed while the seat 5 tilts forward, the seat 5 tilts rearward, and during this operation, the engaging part 81X engages with the engaged part 82X. Considering that, when the seated person leaves the seat, the weight of the seated person is applied to the front part of the seat 5 such that the seat 5 inclines forward, and considering that after the seated person has left the seat, the seat 5 usually returns to the rear position, it is possible to reliably apply suppression at a predetermined position and to avoid a situation where an initial state of the chair is different every time a person sits on the chair.

Further, the seat 5 is attached to the front-rear swing part 3 being a one-direction operating part operable in one of a front-rear direction and a right-left direction, the front-rear swing part 3 being the one-direction operating part is operatively supported by the left-right swing part 4 being an other-direction operating part operable in the other of the front-rear direction and the right-left direction, a left-right swing part 4 being the other-direction operating part is operatively supported by the support base part 2 being a seat support part, and the control mechanism 8X is configured between the front-rear swing part 3 being the one-direction operating part and the left-right swing part 4 being the other-direction operating part. In this manner, because the seat 5 swings in the front-rear and left-right directions, the seated person can sit with an appropriate weight balance in accordance with the sitting posture of the seated person, and obtain a usage feeling not found in conventional chairs. At that time, the control mechanism 8X can be utilized when the operation is suppressed in the one direction or in the both directions.

Further, the control mechanism 8X includes: the engagement pin 81*a*X being the engaging part 81X; and the groove-shaped recess 82*a*X being the engaged part 82X provided on the sliding surface 40X relatively operating at a position facing the engagement pin 81X, and a configuration is so that the engagement pin 81*a*X is elastically biased toward the sliding surface 40X, and the engagement pin 81*a*X is fitted in the groove-shaped recess 82*a*X at a predetermined position, and thus, the engagement pin 81*a*X can smoothly slide on the sliding surface 40X to engage with the groove-shaped recess 82*a*X being the engaged part 82X, at a predetermined position.

Further, when detecting reception of the load applied by seated person in the center, the seat 5 disengages the engagement pin 81*a*X of the control mechanism 8X from the groove-shaped recess 82*a*X, and thus, it is possible to prevent a movement of the seat 5 in an unfinished seating state.

Further, the control mechanism 8X includes the elastic member 83X configured to bias the engagement pin 81*a*X in a direction where the engagement pin 81*a*X protrudes toward the sliding surface 40X, as well as the conversion mechanism 84X configured to convert an operation of the weight-receiving part 50 due to a person sitting on the seat, into an operation in a direction in which the engagement pin 81*a*X is separated from the sliding surface 40X, and the conversion mechanism 84X, the elastic member 83X, and the engagement pin 81*a*X are integrally incorporated into the casing 80 to form with unitized. It is sufficient to attach this unit to the side of the front-rear swing part 3 being the movable part and to provide the sliding surface 40X at the side of the left-right swing part 4 being the support part, and thus, a simple assembly is achieved.

Further, the front-rear stopper mechanism 8M is provided, the front-rear stopper mechanism 8M is configured to change, via an operation of the operating member 152, the operation of the front-rear swing part 3 being the movable part between allowed and suppressed states. This front-rear stopper mechanism 8M also includes the elastic member 83 configured to bias the engagement pin 81*a* in a direction where the engagement pin 81*a* protrudes toward the sliding surface 40, as well as the conversion mechanism 84 configured to convert an operation of the operating member 152 into an operation in a direction in which the engagement pin 81*a* is separated from the sliding surface 40. The conversion mechanism 84 and the engagement pin 81*a* are integrally incorporated in the casing 80, and thus, a conversion mechanism 84 of another system can also be provided in the casing 80 to form with unitized.

Further, the back frame 61 is configured integrally with the seat 5 to obtain a constant sense of stability in the chair swinging to the front, rear, right, or left, and similarly to the seat 5, the back 6 can also be in an operation-suppression state and a release state. Further, when the chair is moved while holding an appropriate portion of the back 6, the back and the seat do not swing, which makes the chair easy to move.

Further, this chair is freely movable by the caster 11, and in a chair with a caster, such a configuration is particularly effective as the chair may easily run in an unexpected direction due to the caster 11 before a person sits down.

Although an embodiment of the present invention was explained above, the specific configuration of each part is not limited to those in the embodiment described above.

For example, in the embodiment above, the recess and the convex engaging part are engaged, however, the engaging part may be a friction-generating member, the engaged part may be a sliding surface, and suppression may be applied by a sliding resistance when the friction-generating member is pressed on the sliding surface, for example. With such a configuration, the chair may be stopped when the seated person stands up.

Further, in the embodiment described above, the seat is attached to the one-direction operating part operable in the front-rear direction, the one-direction operating part is operatively supported by an other-direction operating part operated in a left-right direction, the other-direction operating part is operatively supported by the seat support part, and the control mechanism is configured between the other-direction operating part and a front-rear operating part. However, the seat may be attached to a one-direction operating part operable in the left-right direction, the one-direction operating part may be operatively supported by an other-direction operating part operable in the front-rear direction, the other-direction operating part may be operatively supported by the seat support part, and the control mechanism may be configured between the seat support part and the other-direction operating part.

Further, the engagement pin in the embodiment described above is configured to operate in a direction away from the sliding surface according to the state of the weight-receiving part. However, the configuration may be added to operate in the direction away from the sliding surface also by an operation of the operating part.

Figure 41:
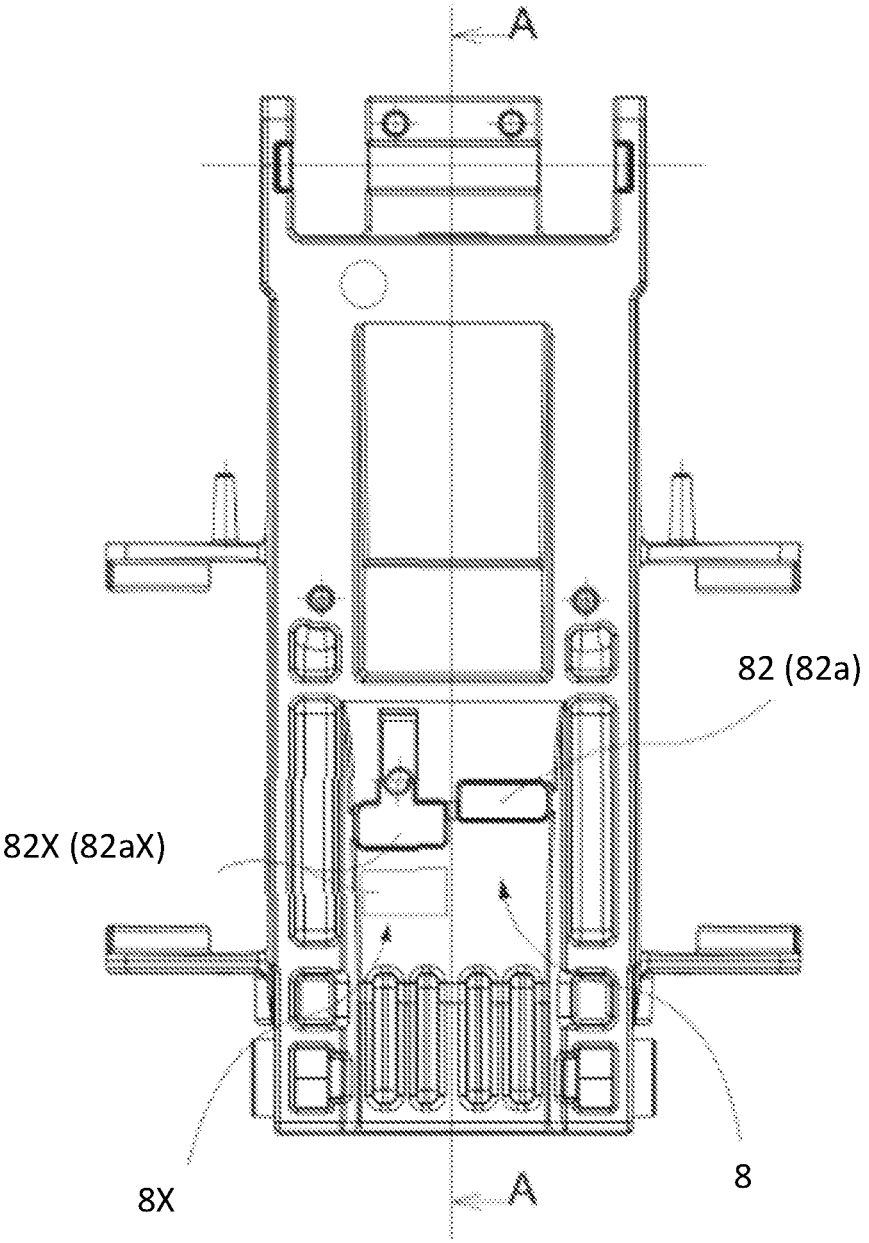
FIG. 41 is a diagram illustrating recess included in the front-rear stopper mechanism and the control mechanism according to a modification of the present invention.
Figure 42:
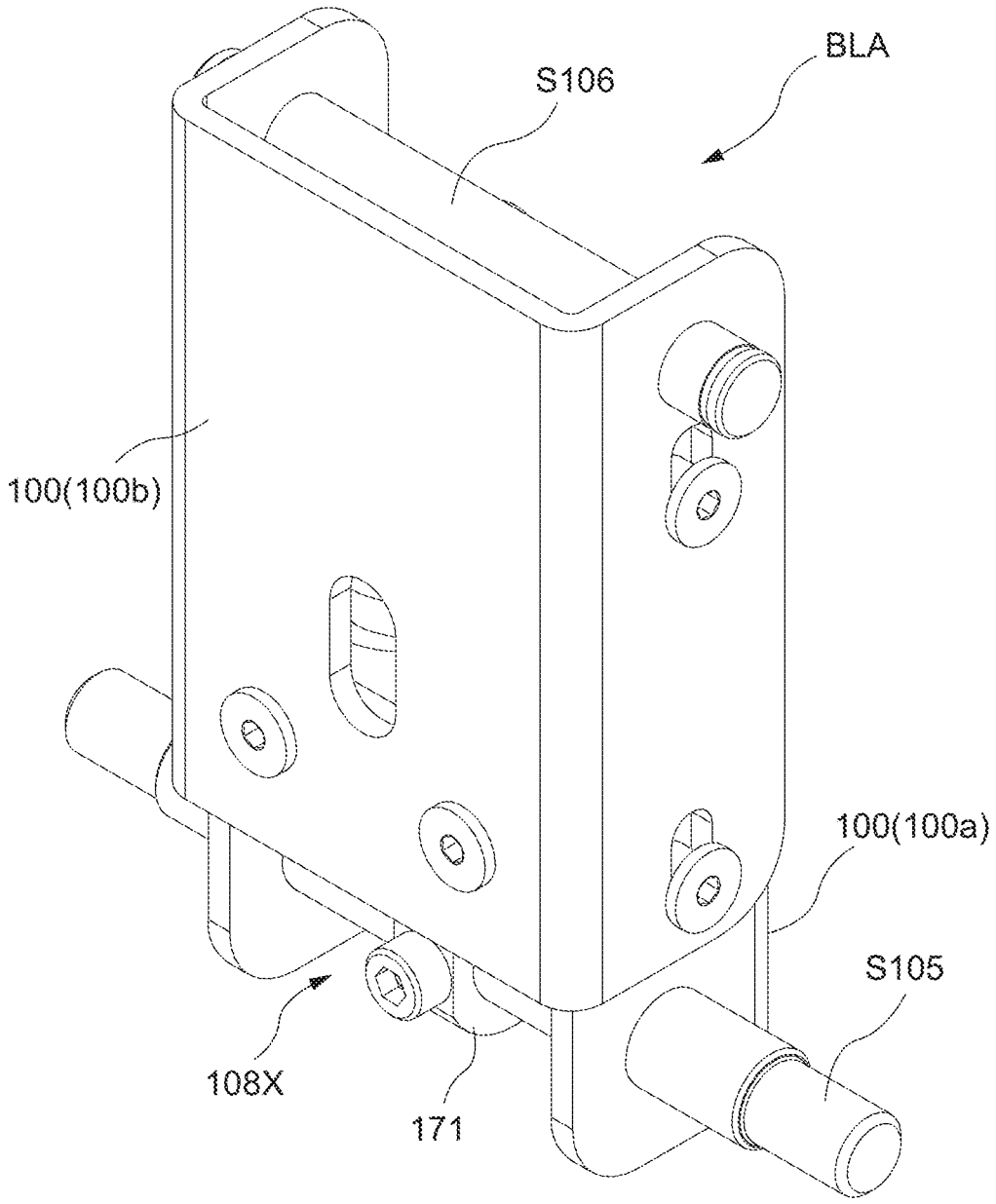
FIG. 42 is a perspective view of an assembled control mechanism according to another, modification of the present invention.
Figure 43:
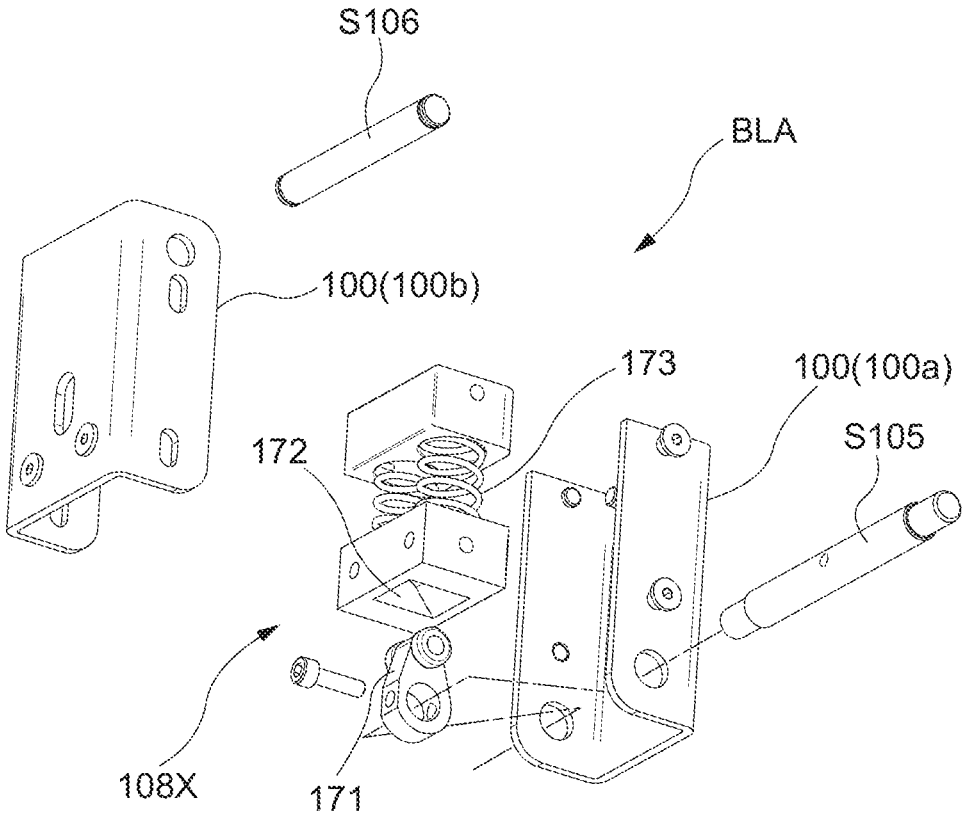
FIG. 43 is an exploded perspective view of the control mechanism according to another modification of the present invention.

Further, in the embodiment above, the position of the recess 82*a*X being the engaged part 82X included in the control mechanism 8X and the position of the groove 82*a* being the engaged part 82 included in a front-rear stopper mechanism 8M are aligned in the front-rear direction (X-direction) and the position where the seat 5 is locked when a person sits on the seat and the position where the seat 5 is locked when the seated person leaves the seat 5 are configured to be the same position. However, as illustrated in FIG. 41, the position of a recess 82*an*X being an engaged part 82*n*X included in a control mechanism 8*n*X and the position of a groove 82*an* being an engaged part 82*n* included in a front-rear stopper mechanism 8*n*M may be shifted in the front-rear direction so that the seat 5 is locked in different positions. As a result, movement of the movable part can be conveniently suppressed at a plurality of positions, and the movement of the seat can be suppressed at the nearest engagement position when the seated person leaves the seat.

Further, the engagement pin incorporated in the casing may be configured to operate in a direction away from the sliding surface also by the operation of the operating part. By choosing a configuration in which the engagement pin can also be operated by the operating member, it is possible to realize a configuration in which the movement of the movable part is manually switched between allowing and suppressing the movement with a simple addition to the configuration.

Further, the weight-receiving part and the control mechanism can be configured as illustrated in FIGS. 42, 43, 44 and 45.

In the weight-receiving part and the control mechanism illustrated in FIGS. 42, 43, 44, and 45, a configuration is such that the height position of a seat 105 is changed due to a person sitting on the seat surface so that the link arm LA illustrated in FIG. 11 serves a function of the weight-receiving part and the control mechanism, the change of the height position of the seat 105 is mechanically transmitted to a control mechanism 108X configured to control an operation of a front-rear swing part 103 being the movable part, and the control mechanism 108X changes the operation of the front-rear swing part 103 between allowed and suppressed states, when the engagement state between an engagement recess 172 being an engaged part provided at the side of a left-right swing part 104 supporting the front-rear swing part 103 and an engagement recess 171 being an engaging part provided at the side of the front-rear swing part 103 changes due to the he load applied by seated person so that the control mechanism 108X changes the allowed/suppressed states of the operation of the front-rear swing part 103, and when the load applied by seated person is removed, the changed operation state is returned to the original state by an elastic member 173.

The control mechanism 108X includes a link 100 including link elements 100*a*, 100*b* connected rotatably and with changeable inter-shafts distance S105,S106, via the shafts S105, S106 respectively provided in the front-rear swing part 103 being the movable part and the left-right swing part 104 being the other-direction operating part, and an elastic member 173 configured to act constantly in a direction where the inter-shafts distance decreases. The engagement recess 172 is provided at one of the left-right swing part 104 being the support part and the front-rear swing part 103 being the movable part, and the engagement convex part 171 being the engaging part is provided at the other of the left-right swing part 104 and the front-rear swing part 103. When the inter-shafts distance decreases due to the acting of the elastic body 173 and the engagement recess 172 and the engagement convex part 171 engage, a relative operation between the left-right swing part 104 being the support part and the front-rear swing part 103 being the movable part is suppressed, and the inter-shafts distance increases and the engagement recess 172 and the engagement convex part 171 are disengaged when a weight is applied to the front-rear swing part 103 being the movable part due to a person sitting on the seat, so that a swinging operation between the left-right swing part 104 being the support part and the front-rear swing part 103 being the movable part is allowed.

Figure 44:
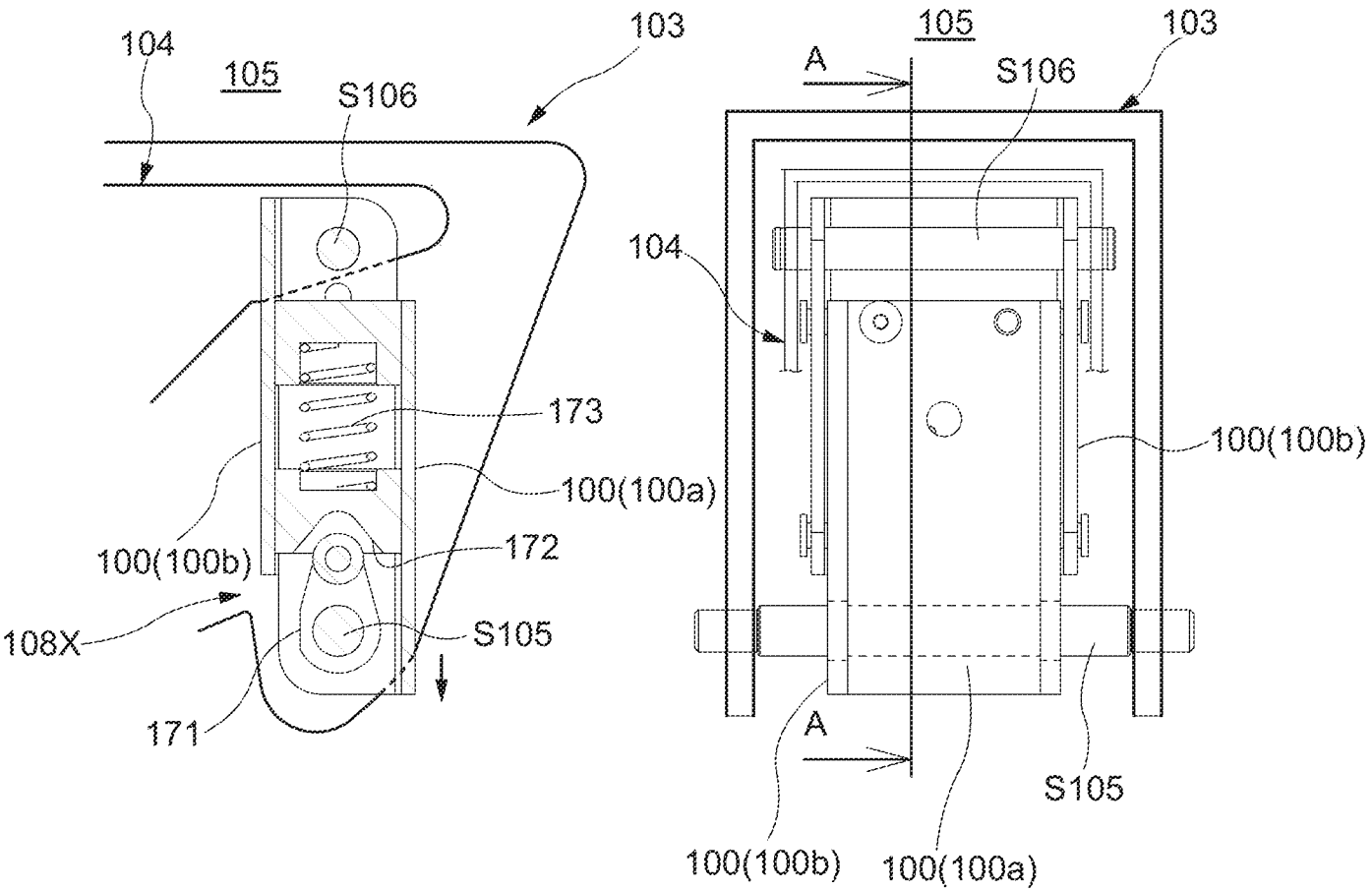
FIG. 44 is a cross-sectional view of the control mechanism according to another modification of the present invention.
Figure 45:
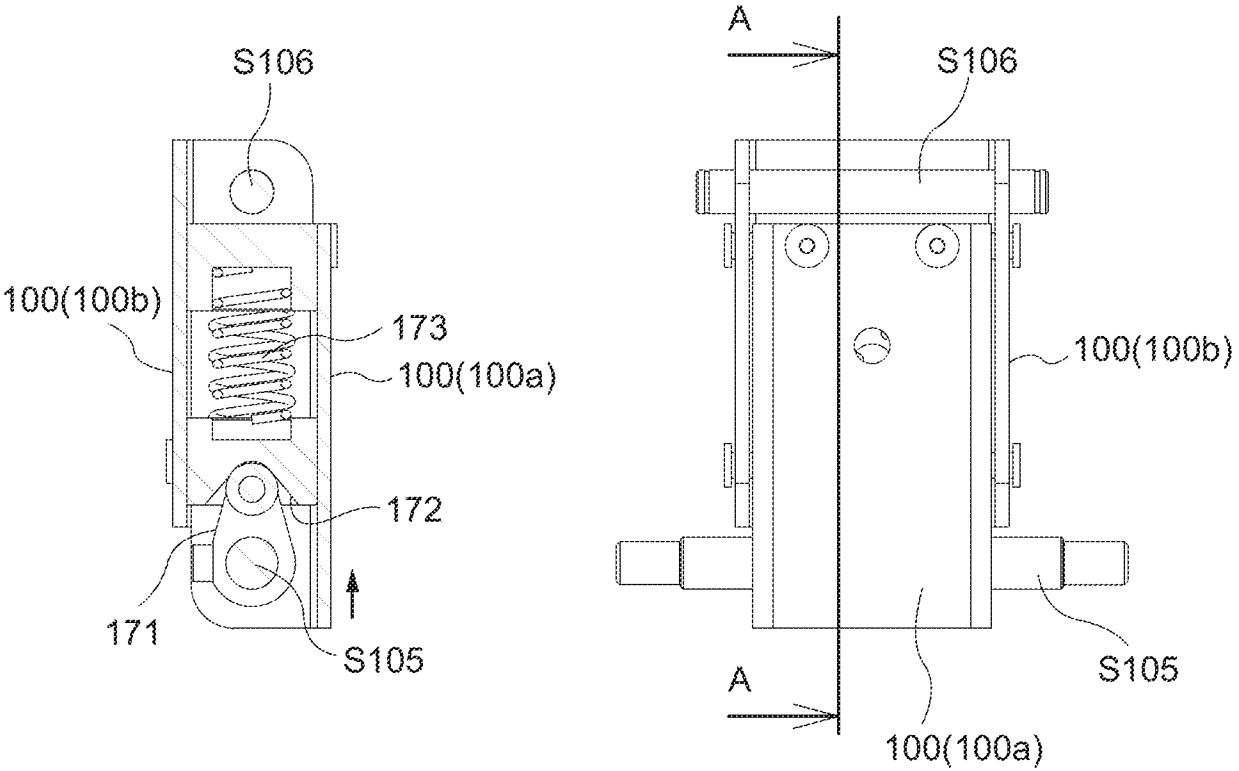
FIG. 45 is an operation explanatory diagram corresponding to FIG. 44.
Figure 46:
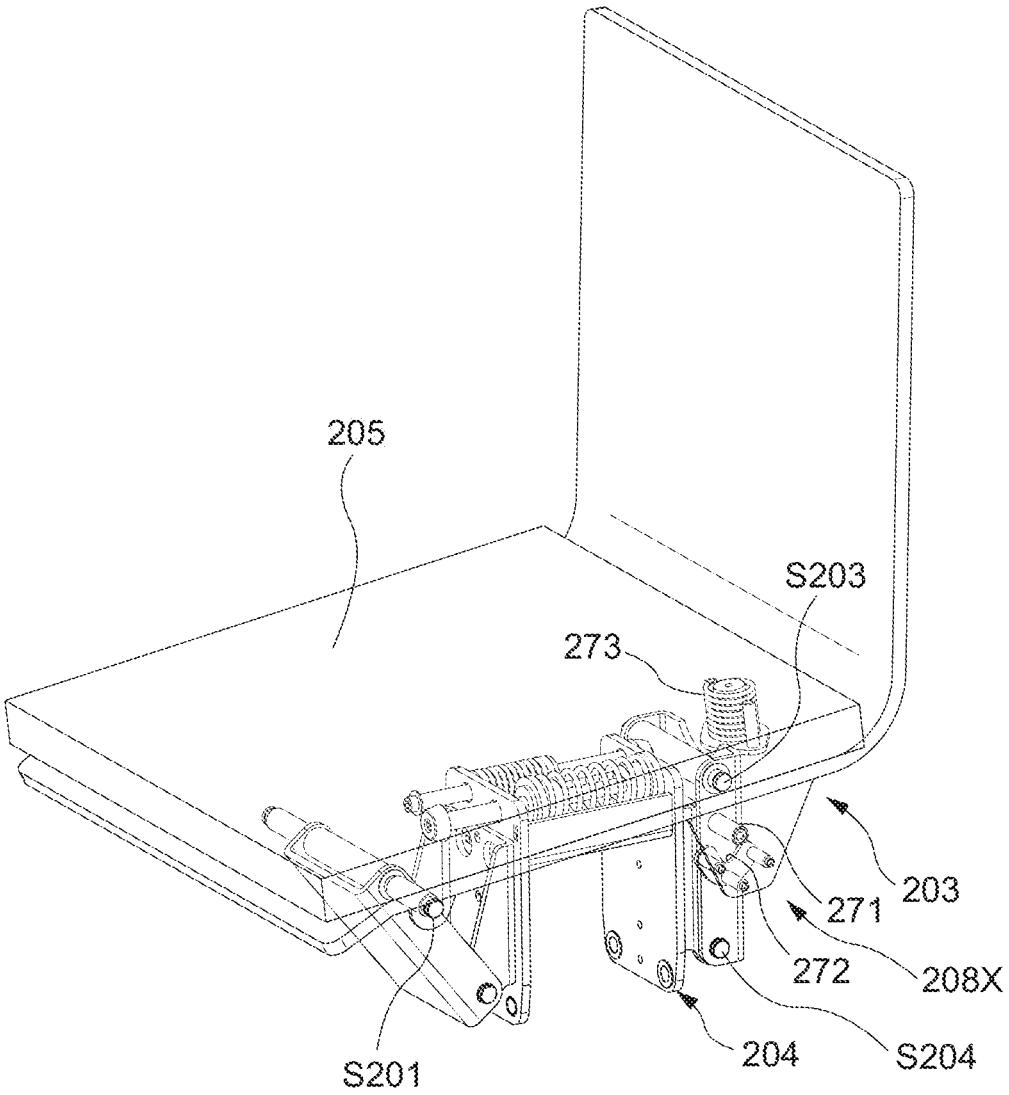
FIG. 46 is a perspective view of an assembled control mechanism according to still another modification of the present invention.
Figure 47:
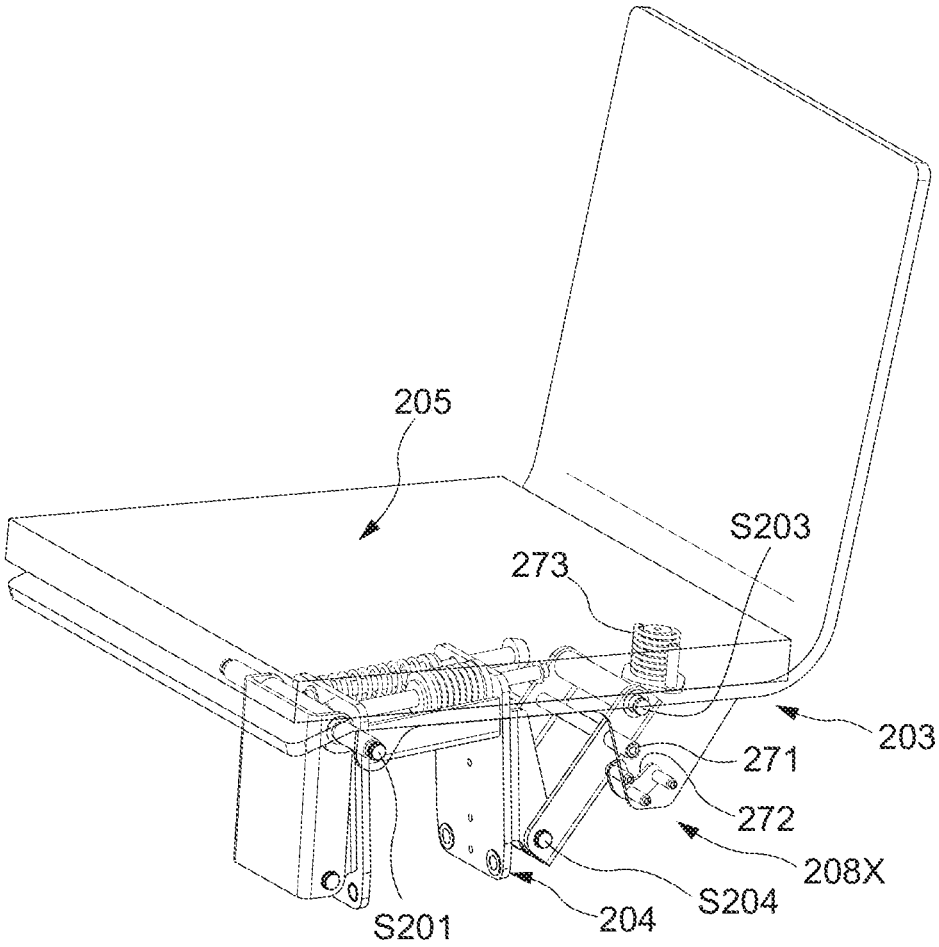
FIG. 47 is an operation explanatory diagram corresponding to FIG. 46.

Specifically, in the control mechanism 108X, the link element 100*b* disposed rotatably about the shaft S106 in the left-right swing part 104 being the support part and the link element 100*a* disposed rotatably about the shaft S105 in the front-rear swing part 103 being the movable part, are fitted with each other to be stretchable, and therebetween, a compression coil spring 173 being the elastic member is interposed to form, as a whole, the link 100. The engagement recess 172 is provided in one part of the link element 100*b* and the engagement convex part 171 is fixed to the shaft S105. The shaft S105 does not rotate with respect to the front-rear swing part 103. Then, when the front-rear swing part 103 sinks down due to receiving the load applied by seated person, the engagement convex part 171 separates from the engagement recess 172, as illustrated in FIG. 44, and by the swinging of the link 100, the front-rear swing part 103 can swing in a range where the engagement recess 172 does not interfere with the engagement convex part 171. When the load applied by seated person is removed, the engagement convex part 171 engages with the engagement recess 172 due to the compression coil spring 173, as illustrated in FIG. 45, and the front-rear swing part 103 is configured to be constrained by the left-right swing part 104 via the link 100. As described above, the control mechanism can be incorporated into the link, and thus, a compact configuration is obtained, which can also be applied to a chair having no back attached to the seat, and can also be applied to a chair in which the back is attached to the seat for which a swinging operation of the seat to the front, rear, right, or left is pursued, the swinging operation not found in conventional chairs.

Further, in FIGS. 46, 47, 48, 49, and 50, configurations are illustrated such that a height position of a seat 205 changes due to a person sitting on the seat surface, the change of the height position of the seat 205 is mechanically transmitted to a control mechanism 208X configured to control an operation of a front-rear swing part 203 being the movable part, and the control mechanism 208X changes the operation of the front-rear swing part 203 between allowed and suppressed states, by the control mechanism 208X, the allowed/suppressed states of the operation of the front-rear swing part 203, are changed, when the engagement state between an engagement recess 272 being an engaged part provided at the side of a left-right swing part 204 supporting the front-rear swing part 203 and an engagement recess 271 being an engaging part provided at the side of the front-rear swing part 203 changes due to the load applied by seated person, and when the load applied by seated person is removed, the changed operation state is configured to be returned to the original state by an elastic member 273.

Figure 48:
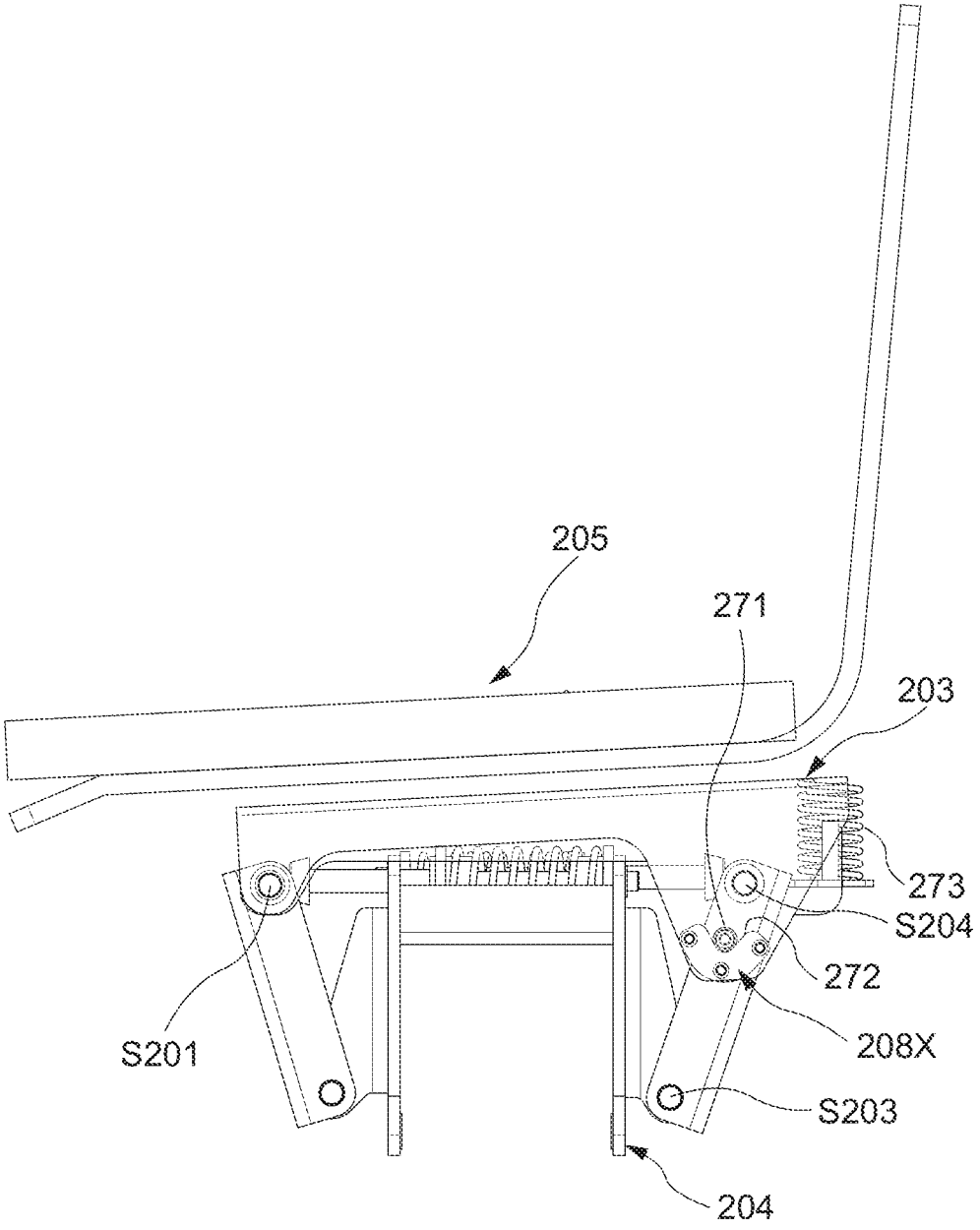
FIG. 48 is a side view illustrating the control mechanism according to still another modification of the present invention.
Figure 49:
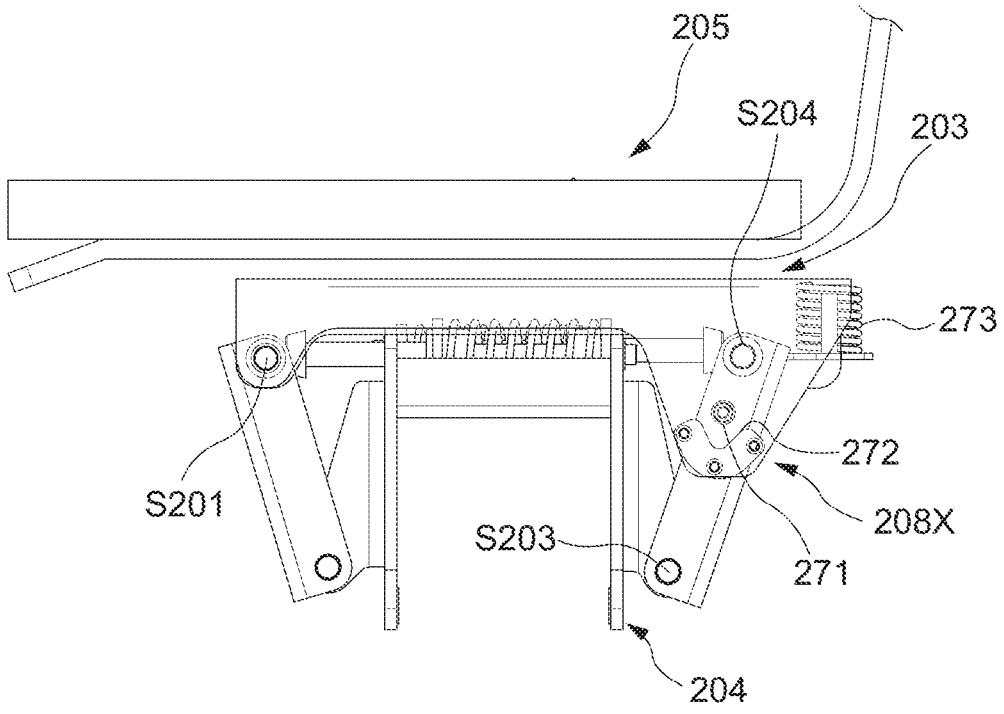
FIG. 49 is an operation explanatory diagram corresponding to FIG. 48.
Figure 50:
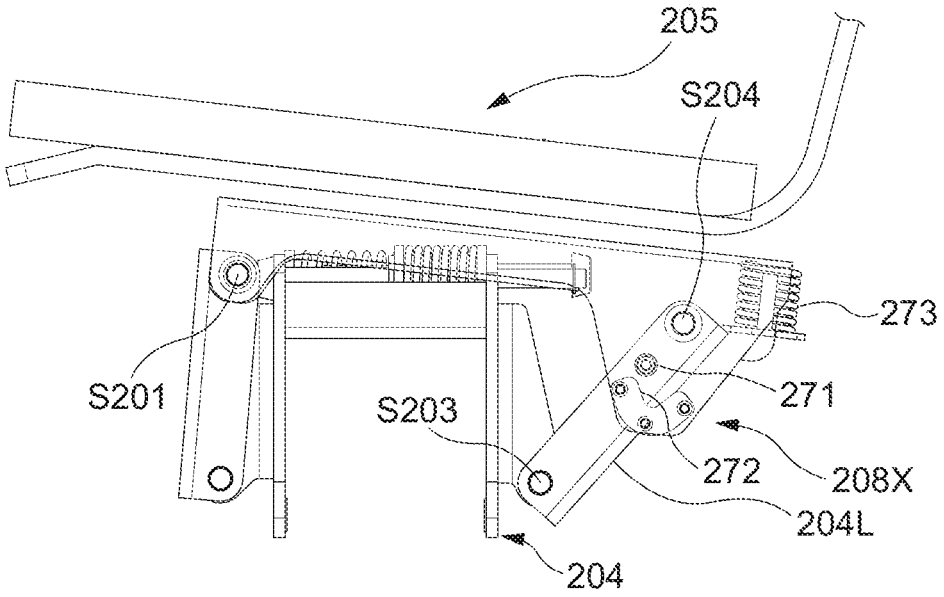
FIG. 50 is an operation explanatory diagram corresponding to FIGS. 48 and 49.

Specifically, the front-rear swing part 203 being the movable part is operable in the front-rear direction and includes a shaft S201 extended to the left-right direction, in the front part of the front-rear swing part 203. A rear part of the front-rear swing part 203 is movable upward and downward due to the load applied by seated person during sitting, and the left-right swing part 204 being another part not operating in the front-rear direction is further provided. In one of the front-rear swing part 203 and the left-right swing part 204, that is, at the side of the front-rear swing part 203, the engaged part 272 opening upward or downward (upward in the illustrated example) is provided, and in the other of the front-rear swing part 203 and the left-right swing part 204, that is, at the side of the left-right swing part 204, the engaging part 271 engageable with the engaged part 272 via a link 204L is provided. One end of the link 204L is mounted on the left-right swing part 204 via a shaft S203 and the other end of the link 204L is mounted on the front-rear swing part 203 via a shaft S204. An elastic force is exerted by a compression coil spring 273 being the elastic member in a direction where the engaged part 272 and the engaging part 271 constantly engage. As illustrated in FIG. 48, when the seated person leaves the seat, the engaged part 272 and the engaging part 271 engage so that the seat 205 does not operate in the front-rear direction, and when the seated person is seated, the engagement parts 272, 271 are disengaged so that the seat 205 is operable, as illustrated in FIGS. 46, 47, 49, and 50.

Even in this case, an operation and an effect according to the embodiment can be achieved.

It is noted that a configuration is also effective in which the movable part is a wheel that makes a chair in body movable and the weight-receiving part receives a weight to unlock the wheel and lock the wheel when the seated person leaves the seat. In this way, the wheel itself is restrained when the seated person leaves the seat to perform a seating operation reliably.

Further, when rearward tilting of the back and rotation of the seat should be suppressed before the person sits on the seat, an output of the control mechanism 8X may be transmitted to the back and the seat.

Various other changes may be applied to other configurations without departing from the spirit of the present invention.

INDUSTRIAL APPLICABILITY

Since the chair according to the present invention is configured as described above, the chair can be utilized especially suitably in an office and the like.

DESCRIPTION OF REFERENCE NUMERALS

2 . . . Seat support part (support base part)
3 . . . Movable part, one-direction operating part (front-rear swing part)
4 . . . Other-direction operating part (left-right swing part)
5 . . . Seat
6 . . . Back
8M . . . Front-rear stopper mechanism
8X . . . Control mechanism
11 . . . Caster
40 . . . Sliding surface
40X . . . Sliding surface
50 . . . Weight-receiving part
61 . . . Back frame
80 . . . Casing
81X . . . Engaging part
81*a* . . . Engagement pin
81*a*X . . . Engagement pin
82X . . . Engaged part
82*a*X . . . Recess
83 . . . Elastic member
83X . . . Elastic member
84X . . . Conversion mechanism
8*n*X . . . Control mechanism
8*n*M . . . Front-rear stopper mechanism
82*n* . . . Engaged part
82*an* . . . Groove
103 . . . Movable part, one-direction operating part (front-rear swing part)
104 . . . Other-direction operating part (left-right swing part)
105 . . . Seat
108X . . . Control mechanism

172 . . . Engaged part (engagement recess)
171 . . . Engaging part (engagement recess)
173 . . . Elastic member
S105 . . . Shaft
S106 . . . Shaft
100 . . . Link
273 . . . Elastic member
203 . . . Movable part (front-rear swing part)
204 . . . Left-right swing part
208X . . . Control mechanism
271 . . . Engaging part (engagement recess)
272 . . . Engagement recess
S201 . . . Shaft

The invention claimed is:

1. A chair, comprising:

a leg supporting post extending in a vertical direction;

a seat extending in a first direction and a second direction, the vertical direction being perpendicular to each of the first direction and the second direction, the first direction being perpendicular to the second direction;

a movable part provided between the leg supporting post and the seat, the movable part supporting the seat;

a weight-receiving part provided on the seat, wherein a height position of the weight-receiving part is changeable when the weight-receiving part receives a weight of a person sitting on the seat and wherein a change of the height position is mechanically transmitted to a control mechanism;

the control mechanism configured to control an operation state of the movable part, wherein the control mechanism controls the operation state between an allowed state and a suppressed state, the allowed state allowing the movable part to move, and the suppressed state suppressing the movable part from moving;

wherein the movable part can move along an operation direction comprising the first direction and the second direction crossing the first direction, and wherein the control mechanism controls the operation state of the movable part in at least one of the first direction and the second direction into the allowed state or the suppressed state.

2. The chair according to claim 1, wherein the control mechanism changes the operation state between the allowed state and the suppressed state when an engagement state between a first engaged part provided in one of the movable part and a support part configured to operatively support the movable part and a first engaging part provided in the other of the movable part and the support part is changed due to a load applied by the person, and wherein when the load applied by the person is removed, the control mechanism returns the operation state of the movable part into an original state by an elastic member.

3. The chair according to claim 2, wherein the movable part serves as the seat, wherein the seat of the chair can tilt at least back and forth, and when the load applied by the person is removed in a state where the seat tilts forward, the seat tilts rearward and the first engaging part engages with the first engaged part in a middle thereof.

4. The chair according to claim 2, wherein the first engaging part and the first engaged part are disengaged due to the load applied by the person, and when the load applied by the person is removed, the first engaging part and the first engaged part are engaged by an elastic force so that the operation of the movable part reaches the suppressed state.

5. The chair according to claim 4, wherein the chair is configured such that the first engaged part is formed by a first recess, and when the weight-receiving part receives the load by the person, the first engaging part is released from the first recess.

6. The chair according to claim 5, wherein either one of the first recess or the first engaging part is provided at a plurality of locations along the operation direction of the movable part.

7. The chair according to claim 5, comprising a stopper mechanism configured to change, via an operation of an operating member, the operation of the movable part between the allowed state and the suppressed state, wherein the stopper mechanism also changes the allowed state and the suppressed state of the operation of the movable part by changing an engagement state between a second recess serving as the second engaged part and the second engaging part, and wherein the first recess of the control mechanism and the second recess of the stopper mechanism are set at different positions in a front-rear direction.

8. The chair according to claim 4, wherein the control mechanism comprises: an engagement pin serving as the first engaging part; and a groove-shaped first recess serving as the first engaged part provided on a sliding surface relatively operating at a position facing the first engaging part, and the first engaging part is configured to be elastically biased toward the sliding surface and to fit in the groove-shaped first recess at a predetermined position.

9. The chair according to claim 8, wherein when reception of the load applied by the person in a center of the seat is detected, the first engaging part of the control mechanism is disengaged from the groove-shaped first recess.

10. The chair according to claim 8, comprising: an elastic member configured to bias the first engaging part in a direction where the first engaging part protrudes toward the sliding surface; and a conversion mechanism configured to convert an operation of the weight-receiving part due to the person sitting on the seat, into an operation in a direction where the first engaging part is separated from the sliding surface, wherein the conversion mechanism, the elastic member, and the first engaging part are integrally incorporated in a casing to form with unitized.

11. The chair according to claim 10, wherein the first engaging part incorporated in the casing operates in the direction where the first engaging part is separated from the sliding surface, also by an operation of an operating member.

12. The chair according to claim 10, comprising a stopper mechanism configured to change, via an operation of an operating member, the operation of the movable part between the allowed state and the suppressed state, wherein the stopper mechanism also includes: an elastic member configured to bias the second engaging part in a direction where the second engaging part protrudes toward the sliding surface; and wherein a conversion mechanism configured to convert the operation of the operating member into an operation in a direction where the second engaging part is separated from the sliding surface, and the conversion mechanism and the second engaging part are integrally incorporated in the casing to form with unitized.

13. A chair, comprising:

a leg supporting post extending in a vertical direction;

a seat extending in a first direction and a second direction, the vertical direction being perpendicular to each of the first direction and the second direction, the first direction being perpendicular to the second direction;

a movable part provided between the leg supporting post and the seat, the movable part supporting the seat;

a weight-receiving part provided on the seat, wherein a height position of the weight-receiving part is changeable when the weight-receiving part receives a weight of a person sitting on the seat and wherein a change of the height position is mechanically transmitted to a control mechanism;

the control mechanism configured to control an operation state of the movable part, wherein the control mechanism controls the operation state between an allowed state and a suppressed state, the allowed state allowing the movable part to move, and the suppressed state suppressing the movable part from moving;

wherein the movable part can move along an operation direction comprising the first direction and the second direction crossing the first direction, and wherein the control mechanism controls the operation state of the movable part in at least one of the first direction and the second direction into the allowed state or the suppressed state, wherein the chair further comprising:

a link comprising:

a first link element provided with a first shaft rotatably supported by the first link element;

a second link element provided with a second shaft rotatably supported by the second link element;

an elastic body provided between the first shaft and the second shaft to bias constantly in a direction to decrease an inter-shaft distance between the first shaft and the second shaft;

an engagement recess provided on one of the support part and the movable part; and an engaging part provided on the other of the support part and the movable part, are provided, wherein when the inter-shafts distance decreases by the elastic body such that the engagement recess engages with the engaging part, a relative operation between the support part and the movable part is suppressed, and wherein when the inter-shafts distance increases such that a weight is applied to the movable part due to a person sitting on the seat and the engagement recess is disengaged from the engaging part, a swinging operation between the support part and the movable part is allowed.

14. A chair, comprising:

a leg supporting post extending in a vertical direction;

a seat extending in a first direction and a second direction, the vertical direction being perpendicular to each of the first direction and the second direction, the first direction being perpendicular to the second direction;

a movable part provided between the leg supporting post and the seat, the movable part supporting the seat;

a weight-receiving part provided on the seat, wherein a height position of the weight-receiving part is changeable when the weight-receiving part receives a weight of a person sitting on the seat and wherein a change of the height position is mechanically transmitted to a control mechanism;

the control mechanism configured to control an operation state of the movable part, wherein the control mechanism controls the operation state between an allowed state and a suppressed state, the allowed state allowing the movable part to move, and the suppressed state suppressing the movable part from moving;

wherein the movable part can move along an operation direction comprising the first direction and the second direction crossing the first direction, and wherein the control mechanism controls the operation state of the movable part in at least one of the first direction and the second direction into the allowed state or the suppressed state, the movable part is operable in a front-rear direction and includes, at a front thereof, a shaft extended to a left-right direction, a rear of the movable part is movable upward and downward due to the load applied by seated person, the chair further includes other parts not operating in the front-rear direction, an engaged part that opens either upward or downward is provided in one of the movable part and the other part, an engaging part engageable with the engaged part is provided in the other of the movable part and the other part, an elastic force is exerted in a direction where the engaged part and the engaging part constantly engage, when the seated person leaves the seat, the engaged part and the engaging part engage so that the movable part does not operate in the front-rear direction, and when the person sits on the seat, the engaged part and the engaging part are disengaged so that the movable part is operable.

15. The chair according to claim 1, wherein the movable part serves as the seat.

16. The chair according to claim 15, wherein the seat is attached to a one-direction operating part operable in one of a front-rear direction and a right-left direction, the one-direction operating part is operatively supported by an other-direction operating part operable in the other of the front-rear direction and the right-left direction, the other-direction operating part is operatively supported by a seat support part, and the control mechanism is configured between the one-direction operating part and the other-direction operating part and/or between the other-direction operating part and the seat support part.

17. The chair according to claim 1, wherein a back frame is attached to the seat.

18. The chair according to claim 1, wherein the chair is freely movable by a caster.

* * * * *